US010100450B2

(12) United States Patent
Takizawa et al.

(10) Patent No.: US 10,100,450 B2
(45) **Date of Patent: *Oct. 16, 2018**

(54) SEWING MACHINE

(71) Applicant: NSD CORPORATION, Nagoya-shi (JP)

(72) Inventors: Yoshichika Takizawa, Nagoya (JP); Masayoshi Ono, Nagoya (JP); Hirotsugu Uenishi, Nagoya (JP)

(73) Assignee: NSD CORPORATION, Nagoya-shi (JP)

( * ) Notice: Subject to any disclaimer, the term of this patent is extended or adjusted under 35 U.S.C. 154(b) by 366 days.

This patent is subject to a terminal disclaimer.

(21) Appl. No.: 14/900,767

(22) PCT Filed: Sep. 2, 2014

(86) PCT No.: PCT/JP2014/073077
§ 371 (c)(1),
(2) Date: Dec. 22, 2015

(87) PCT Pub. No.: WO2015/033934
PCT Pub. Date: Mar. 12, 2015

(65) Prior Publication Data

US 2016/0153129 A1 Jun. 2, 2016

(30) Foreign Application Priority Data

Sep. 9, 2013 (JP) ..... 2013-186052

(51) Int. Cl.
*D05B 21/00* (2006.01)
*D05C 7/02* (2006.01)
(Continued)

(52) U.S. Cl.
CPC ..... *D05C 7/02* (2013.01); *D05B 19/08* (2013.01); *D05B 19/12* (2013.01); *D05B 47/04* (2013.01); *D05C 7/00* (2013.01); *D05C 11/08* (2013.01)

(58) Field of Classification Search
CPC ..... D05B 19/08; D05B 57/143; D05B 57/00; D05B 47/00; D05B 51/00; D05B 69/12;
(Continued)

(56) References Cited

U.S. PATENT DOCUMENTS 4,215,641 A * 8/1980 Dobrjanskyj ..... D05B 19/12 112/241
4,480,554 A * 11/1984 Brodeur ..... B61D 3/184 105/165
(Continued)

FOREIGN PATENT DOCUMENTS

JP 11-021758 A 1/1999
JP 2003-250611 A 9/2003
WO WO-98/59101 A1 12/1998

*Primary Examiner* — Tejash Patel
(74) *Attorney, Agent, or Firm* — Locke Lord LLP

(57) ABSTRACT

A presser foot 12*c* of a sewing machine is provided with a main body 210, a swayingly reciprocating mechanism section 230, and a thread hooking rod drive motor 240. The swayingly reciprocating mechanism section 230 has a thread hooking rod 236, and a needle thread receiving section for fixing a needle thread together with the thread hooking rod 236 is provided inside a leading-end structure section 216 of the main body 210. As a result of driving of the thread hooking rod drive motor 240, the swayingly reciprocating mechanism section 230 reciprocally moves while swaying with respect to the main body 210. When a thread take-up lever pulls up the needle thread, a circular movement arm which performs rotation movement while hooking the needle thread adjusts a rotational angle of the circular
(Continued)

movement arm, thereby enabling adjustment of a length of a needle thread in one preceding stitch.

20 Claims, 30 Drawing Sheets

(51) Int. Cl.

| | |
|---|---|
| ***D05C 7/00*** | (2006.01) |
| ***D05B 19/08*** | (2006.01) |
| ***D05B 19/12*** | (2006.01) |
| ***D05B 47/04*** | (2006.01) |
| ***D05C 11/08*** | (2006.01) |

(58) Field of Classification Search
CPC ..... D05B 19/12; D05B 23/00; D05C 17/00; D05C 11/08
See application file for complete search history.

(56) References Cited

U.S. PATENT DOCUMENTS

| | | | | |
|---|---|---|---|---|
| 5,404,824 | A * | 4/1995 | Hiraoka | D05B 49/04 112/254 |
| 8,794,167 | B2 | 8/2014 | Takizawa et al. | |
| 9,016,218 | B2 | 4/2015 | Fujiura et al. | |
| 2007/0193484 | A1 * | 8/2007 | Rodrigues Couto | D05B 47/00 112/2 |
| 2012/0097084 | A1 * | 4/2012 | Takizawa | D05B 57/00 112/229 |
| 2014/0109814 | A1 * | 4/2014 | Fujiura | D05B 19/12 112/102.5 |

* cited by examiner

[Fig. 1]
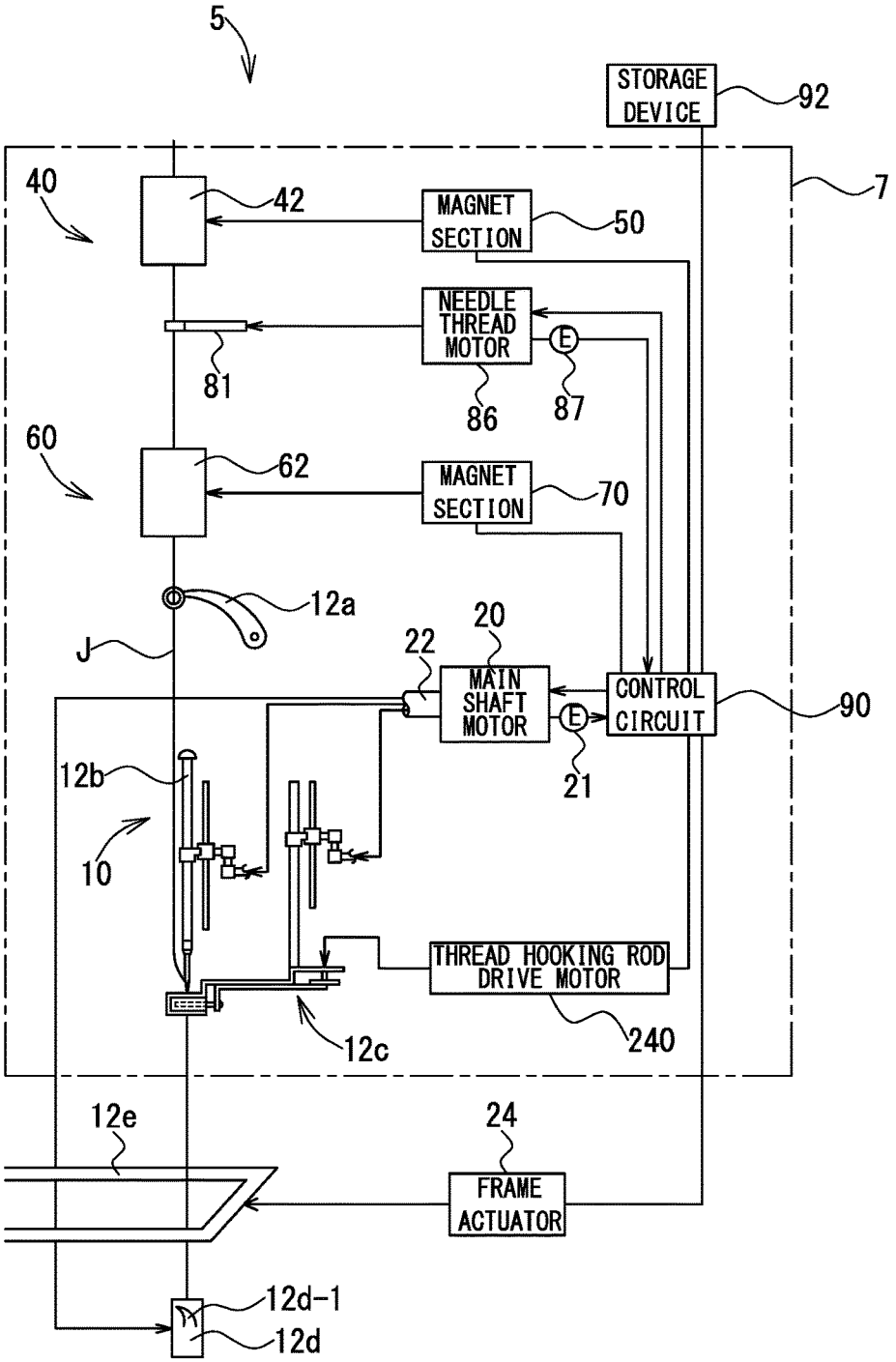

[Fig. 2]
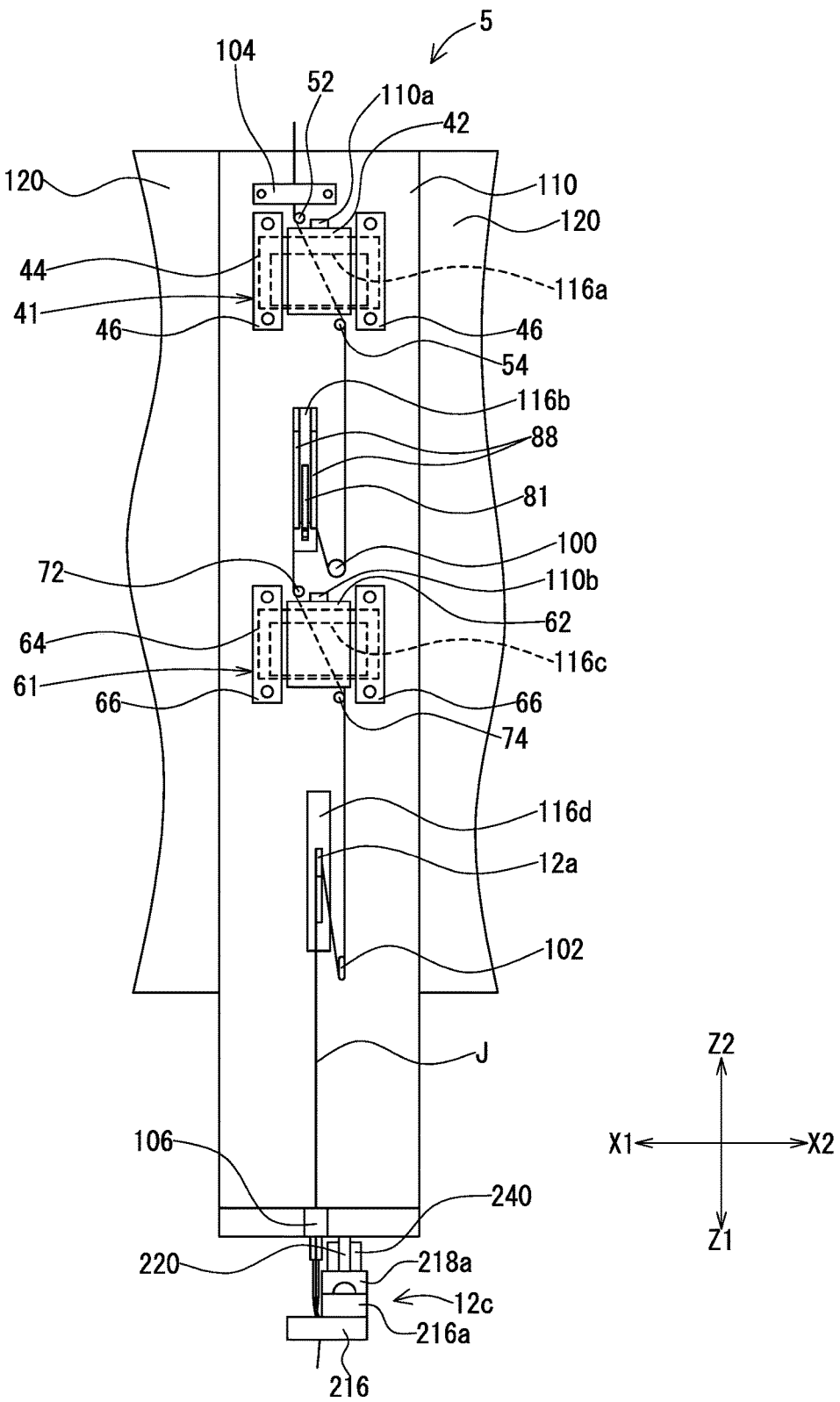

[Fig. 3]
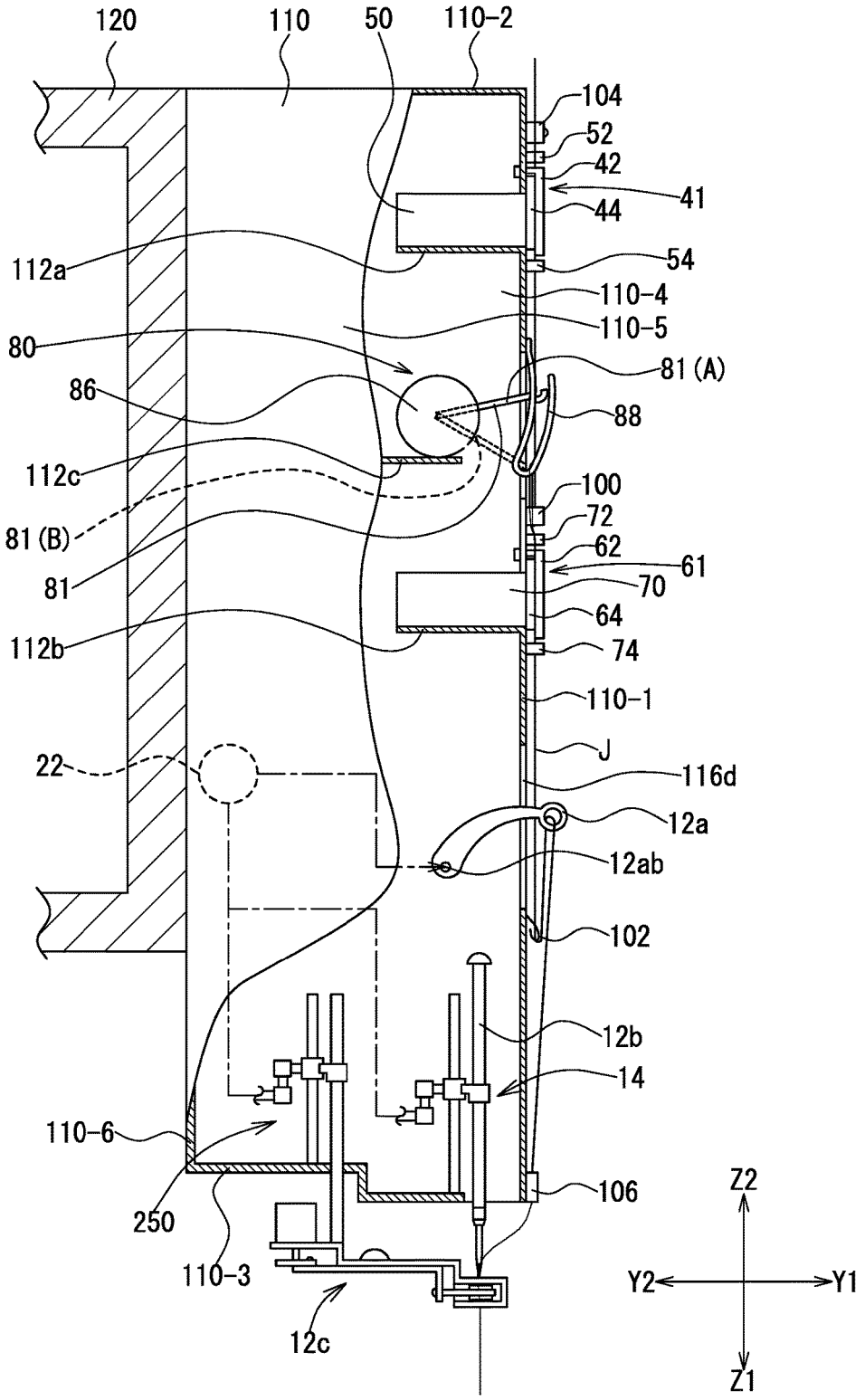

[Fig. 4]
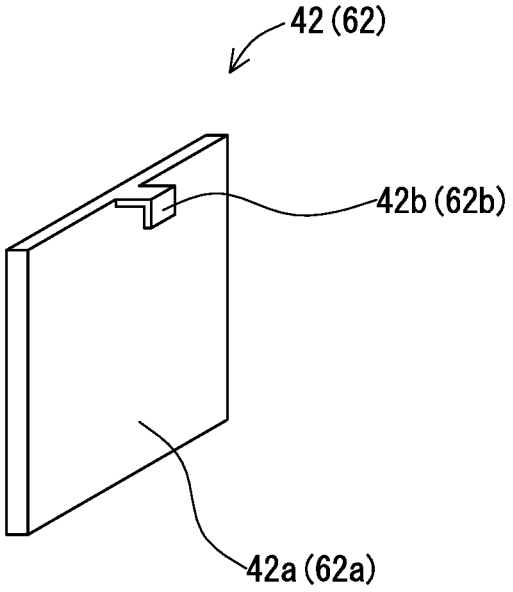

[Fig. 5]
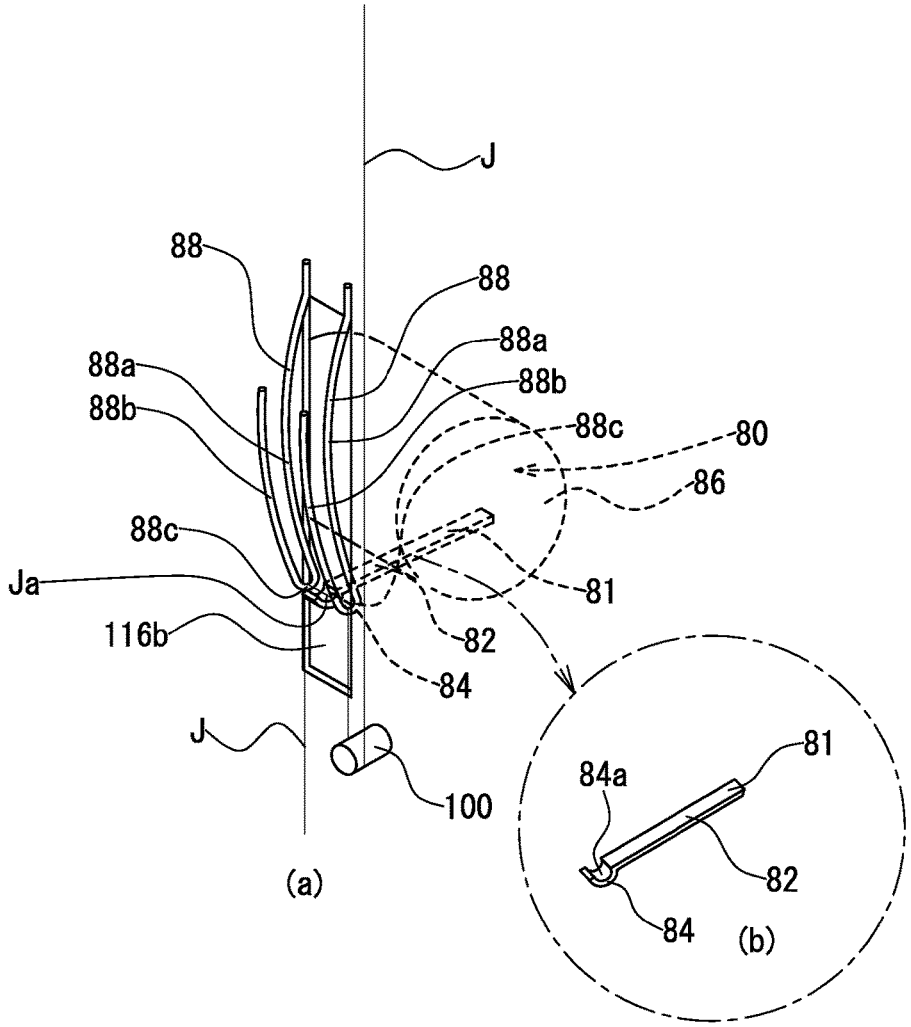

[Fig. 6]
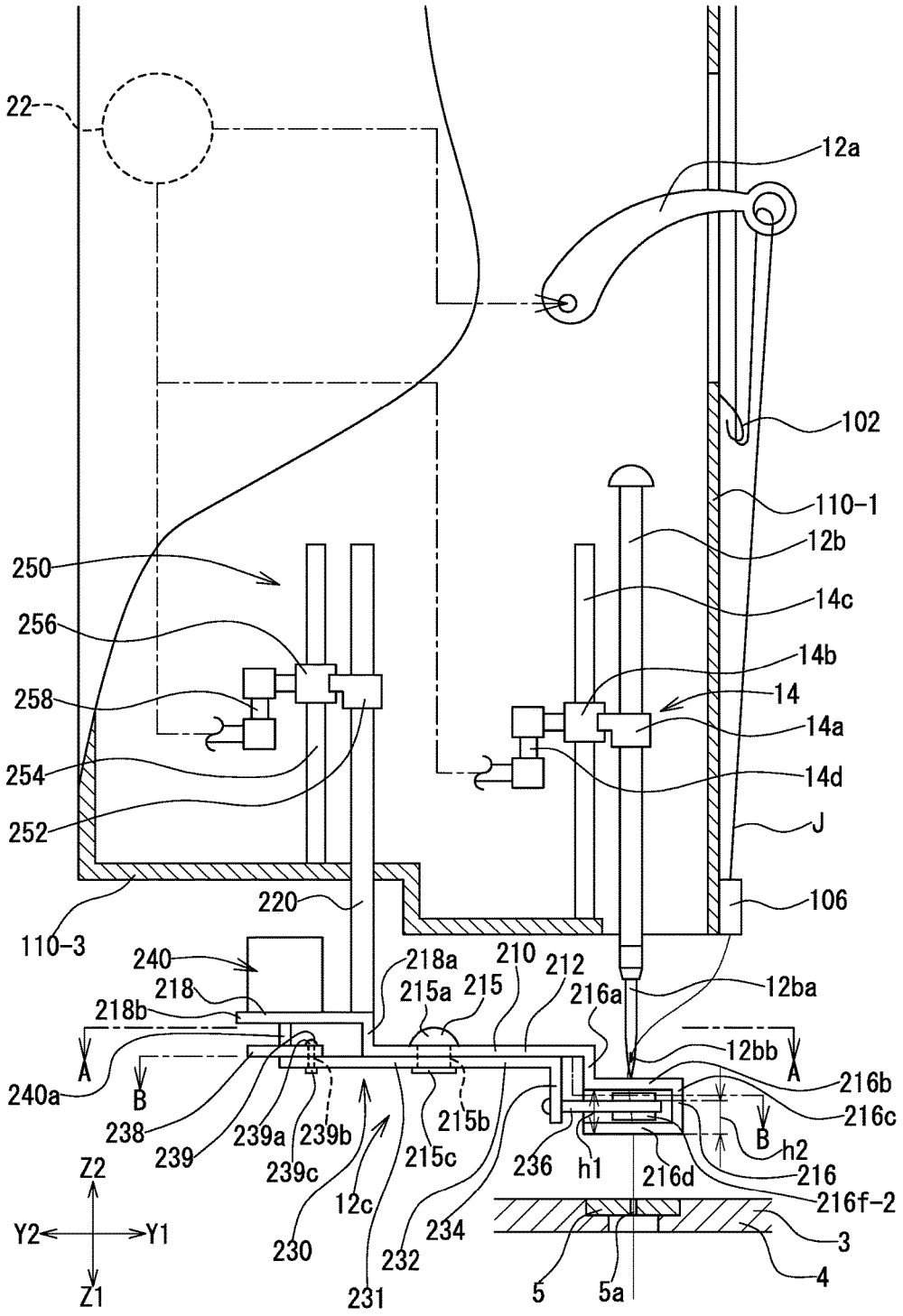

[Fig. 7]
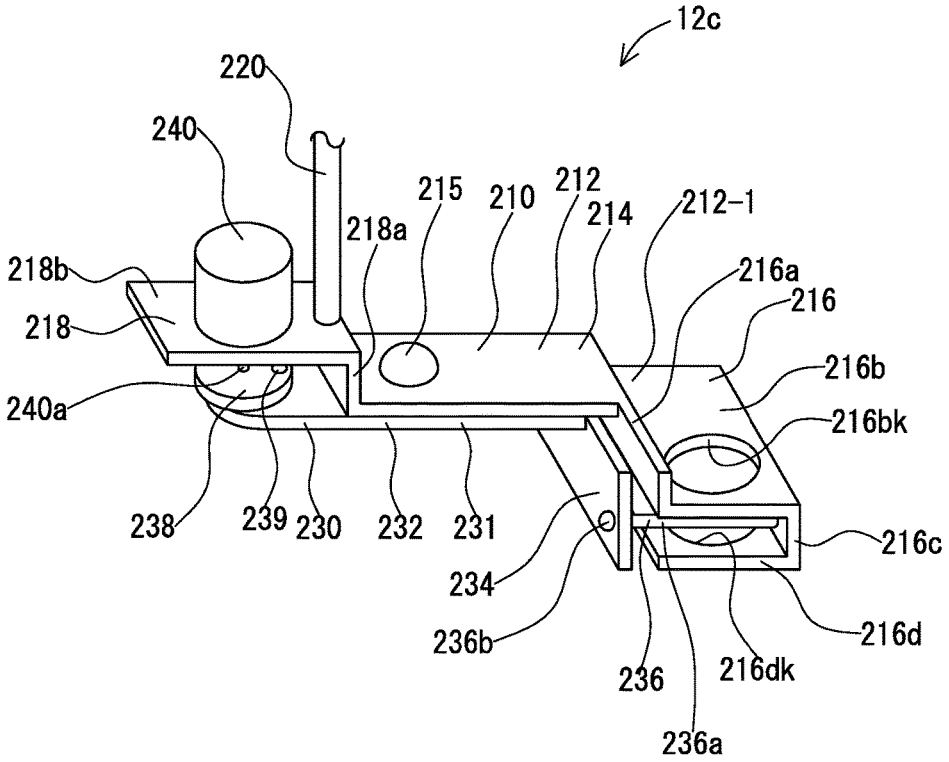
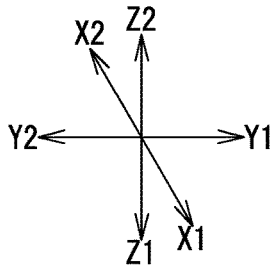

[Fig. 8]
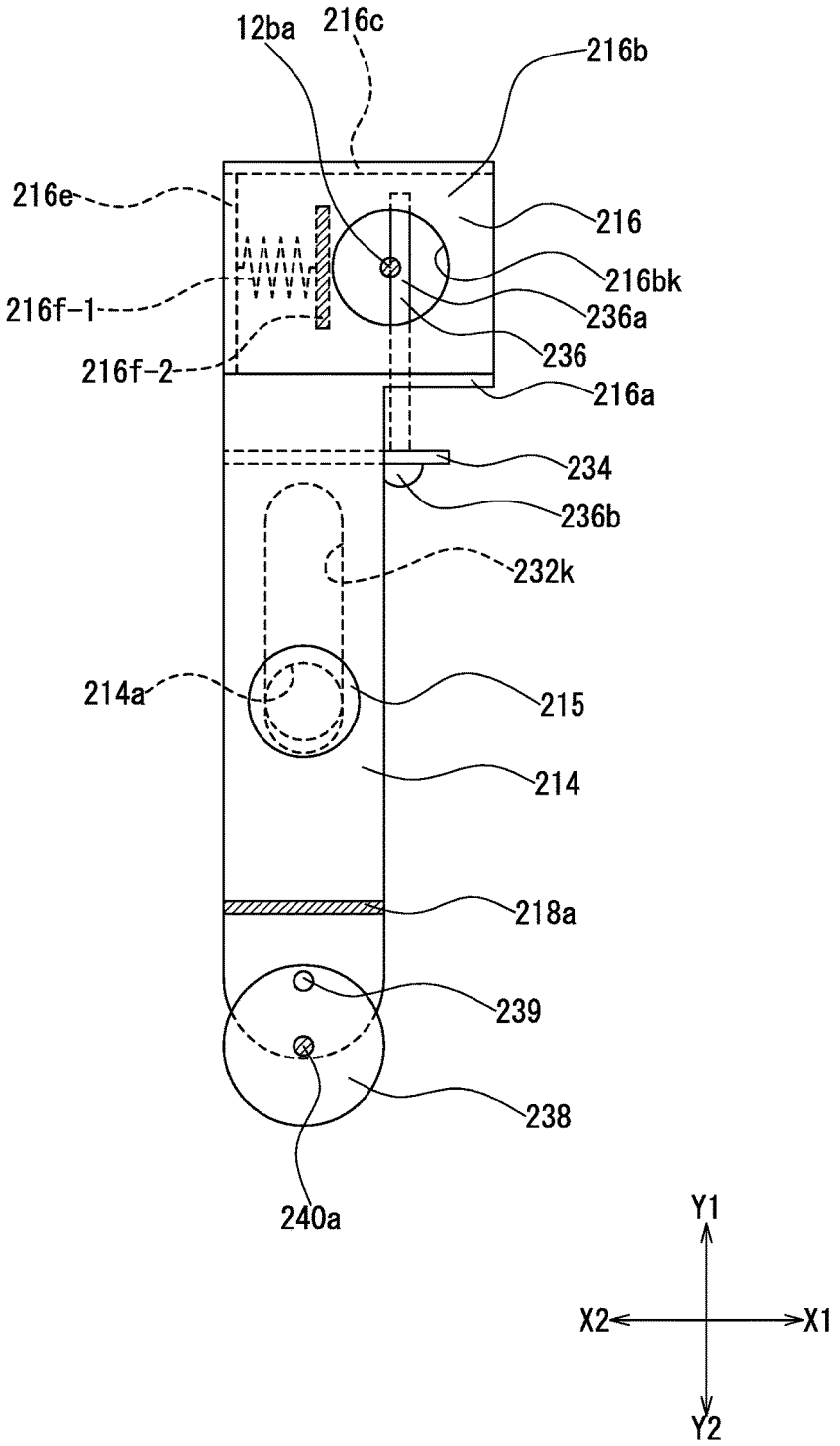

[Fig. 9]
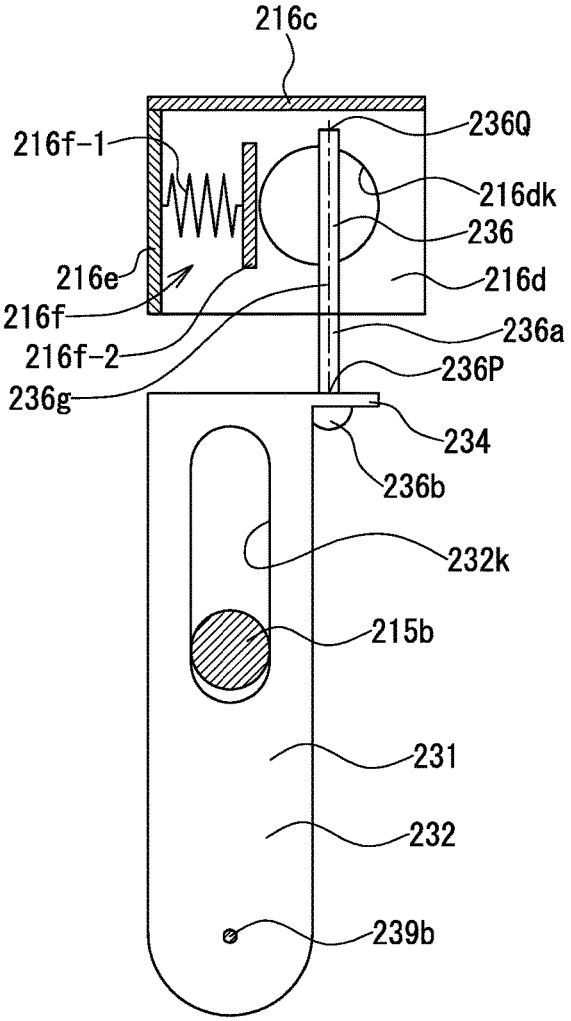
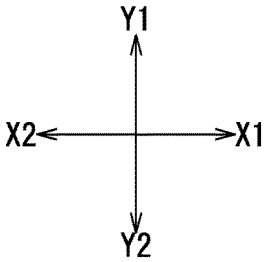

[Fig. 10]
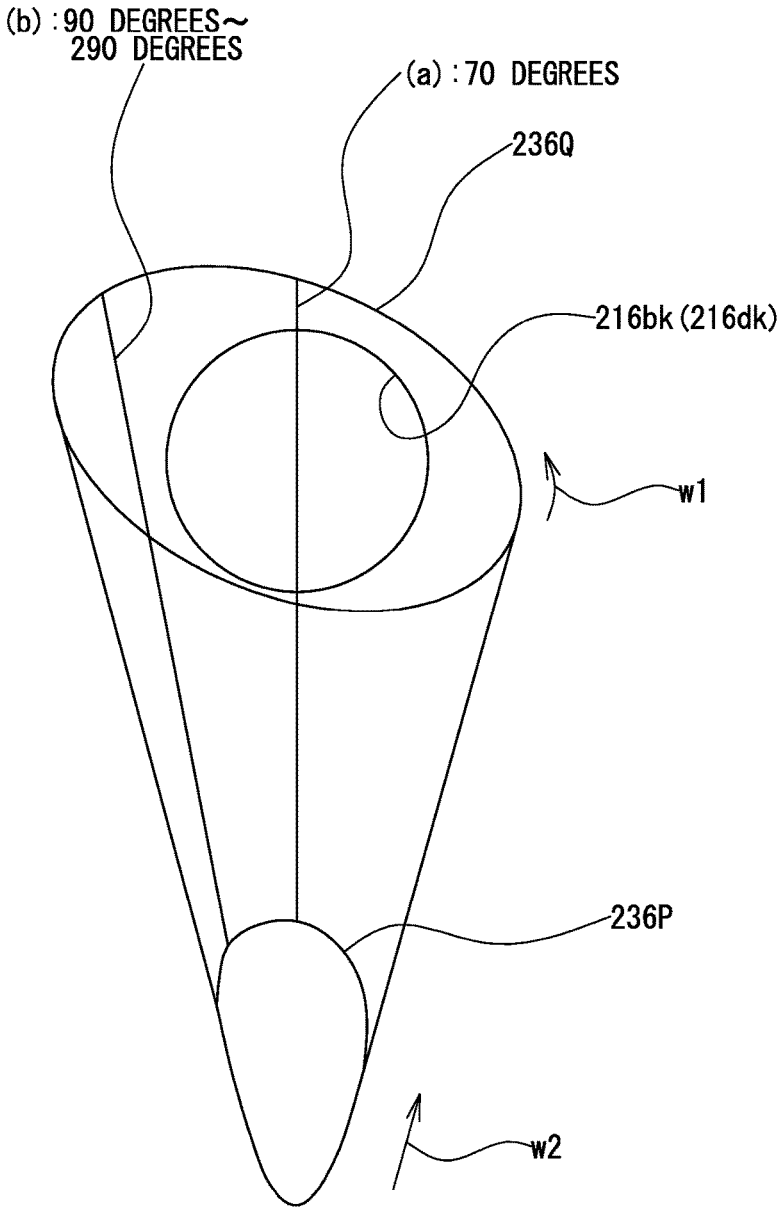

[Fig. 11]
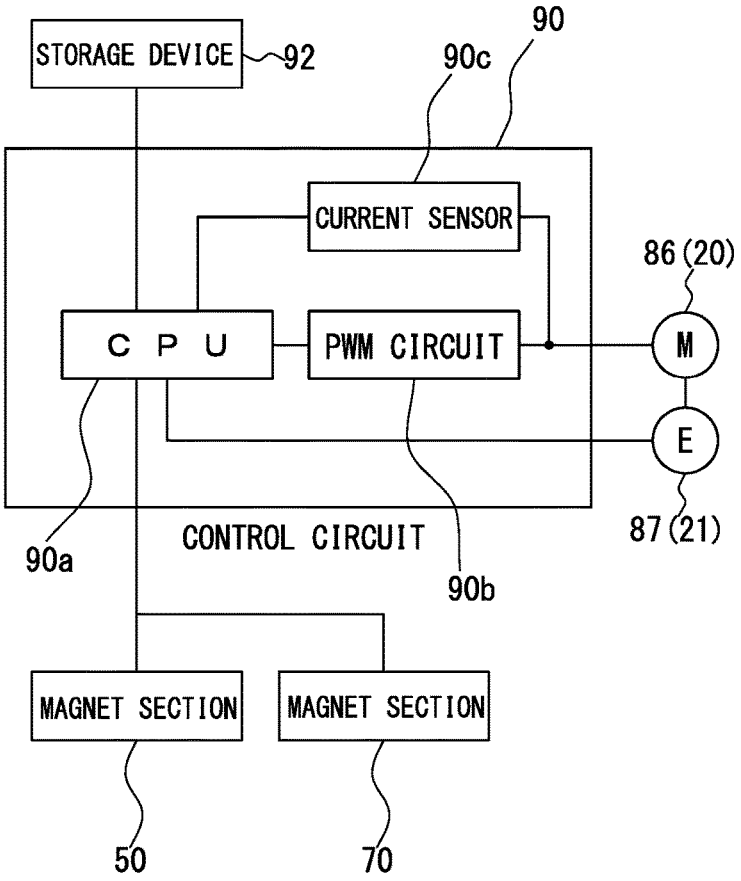

[Fig. 12]
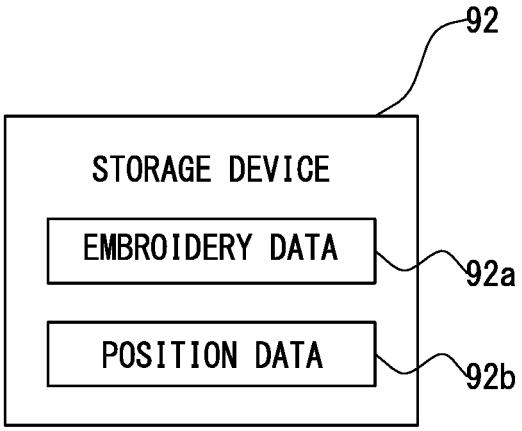

[Fig. 13]

92a

EMBROIDERY DATA

| STITCH | STITCH LENGTH (mm) | STITCHING DIRECTION (DEGREE) | REMAINING LENGTH OF NEEDLE THREAD (mm) |
|---|---|---|---|
| STITCH 1 | ○○ | ○○ | ○○ |
| STITCH 2 | ○○ | ○○ | ○○ |
| STITCH 3 | ○○ | ○○ | ○○ |
| . | . | . | . |
| . | . | . | . |
| . | . | . | . |
| STITCH n | ○○ | ○○ | ○○ |
| . | . | . | . |
| . | . | . | . |

[Fig. 14]

92b

POSITION DATA

| | | | |
|---|---|---|---|
| THREAD HOOKING ROD DRIVE MOTOR | | DRIVE START POSITION<br>DRIVE END POSITION | ○○DEGREES<br>○○DEGREES |
| MAGNET SECTION (MAGNET SECTION 50) | | DRIVE START POSITION<br>DRIVE END POSITION | ○○DEGREES<br>○○DEGREES |
| MAGNET SECTION (MAGNET SECTION 70) | | DRIVE START POSITION<br>DRIVE END POSITION | ○○DEGREES<br>○○DEGREES |
| FRAME ACTUATOR | | DRIVE START POSITION<br>DRIVE END POSITION | ○○DEGREES<br>○○DEGREES |
| CIRCULAR MOVEMENT ARM | DESCENDING SEGMENT | START POSITION<br>END POSITION | ○○DEGREES<br>○○DEGREES |
| | ASCENDING SEGMENT | START POSITION<br>END POSITION | ○○DEGREES<br>○○DEGREES |
| | NEEDLE THREAD WITHDRAWAL SEGMENT | START POSITION<br>END POSITION | ○○DEGREES<br>○○DEGREES |

[Fig. 15]

MAIN SHAFT DATA (POSITION)

| TIME | MAIN SHAFT ANGLE |
|---|---|
| $t_0$ | $a_0$ (=0) |
| $t_1$ | $a_1$ |
| $t_2$ | $a_2$ |
| . | . |
| . | . |
| . | . |
| . | . |
| . | . |
| $t_n$ | $a_n$ |

[Fig. 16]
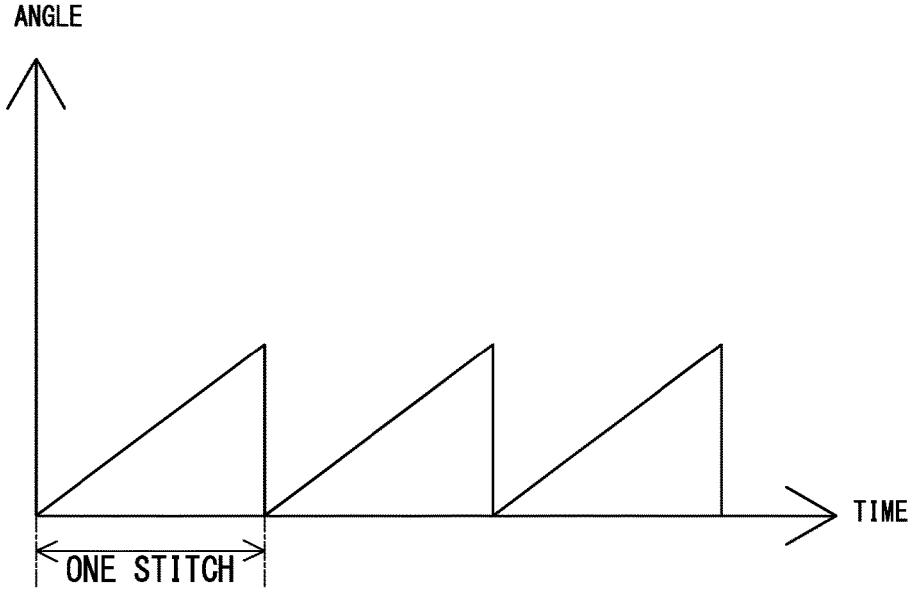

[Fig. 17]

DATA FOR CIRCULAR MOVEMENT ARM

| STITCH | AMOUNT OF DESCENT OF CIRCULAR MOVEMENT ARM | AMOUNT OF ASCENT OF CIRCULAR MOVEMENT ARM |
|---|---|---|
| STITCH 1 | ○○ | ○○ |
| STITCH 2 | ○○ | ○○ |
| STITCH 3 | ○○ | ○○ |
| . | . | . |
| . | . | . |
| . | . | . |
| STITCH n | ○○ | ○○ |
| . | . | . |
| . | . | . |

[Fig. 18]

ANGLE CORRESPONDENCE DATA

STITCH 2

STITCH 1

| MAIN SHAFT ANGLE | ANGLE OF THE NEEDLE THREAD MOTOR |
|---|---|
| $a_x$ | $C_n$ |
| $a_{x+1}$ | $C_{n-1}$ |
| $a_{x+2}$ | $C_{n-2}$ |
| $a_{x+3}$ | $C_{n-3}$ |
| . | . |
| . | . |
| . | . |
| $a_{y-3}$ | $C_3$ |
| $a_{y-2}$ | $C_2$ |
| $a_{y-1}$ | $C_1$ |
| $a_y$ | $C_0$ |

[Fig. 19]
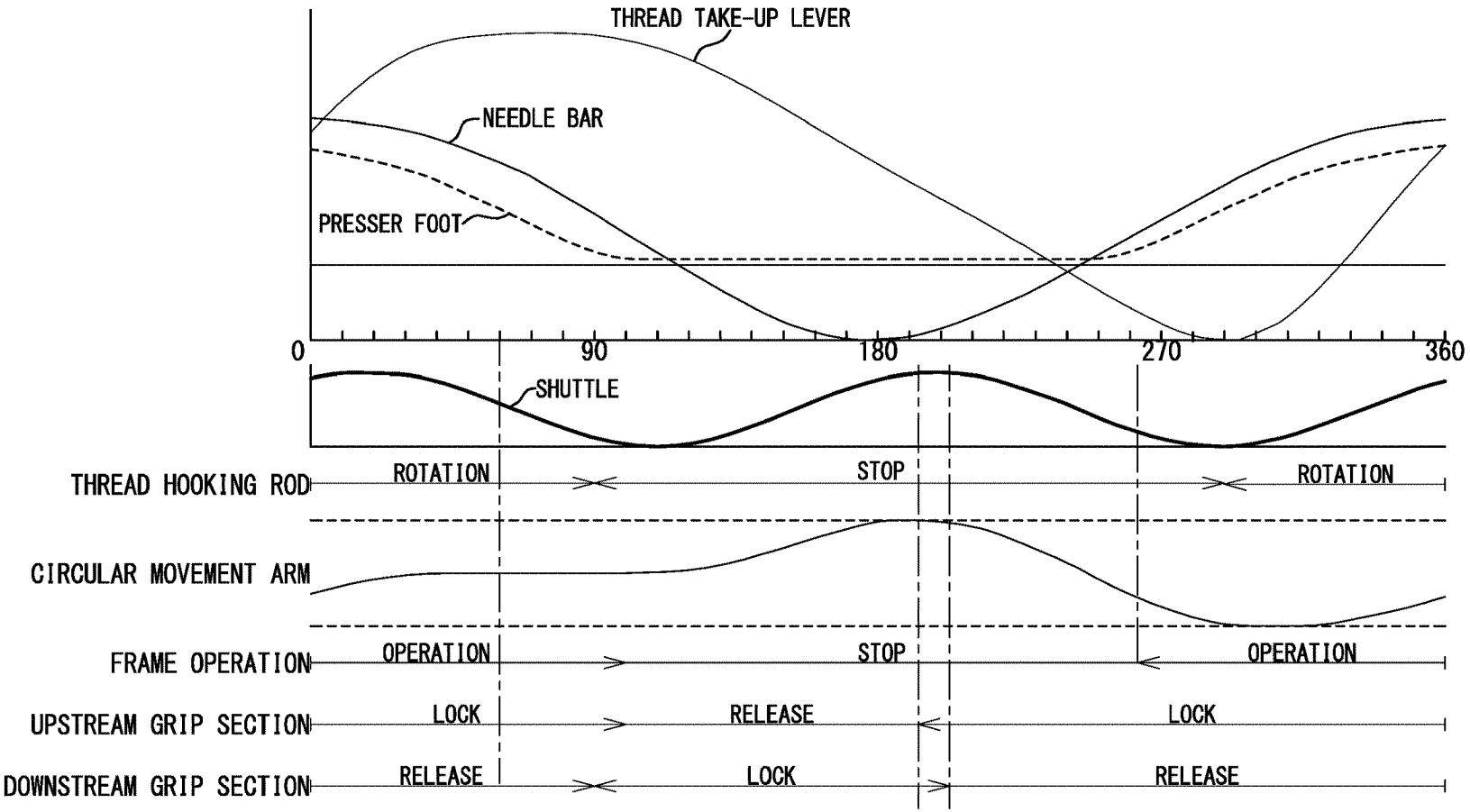

[Fig. 20]
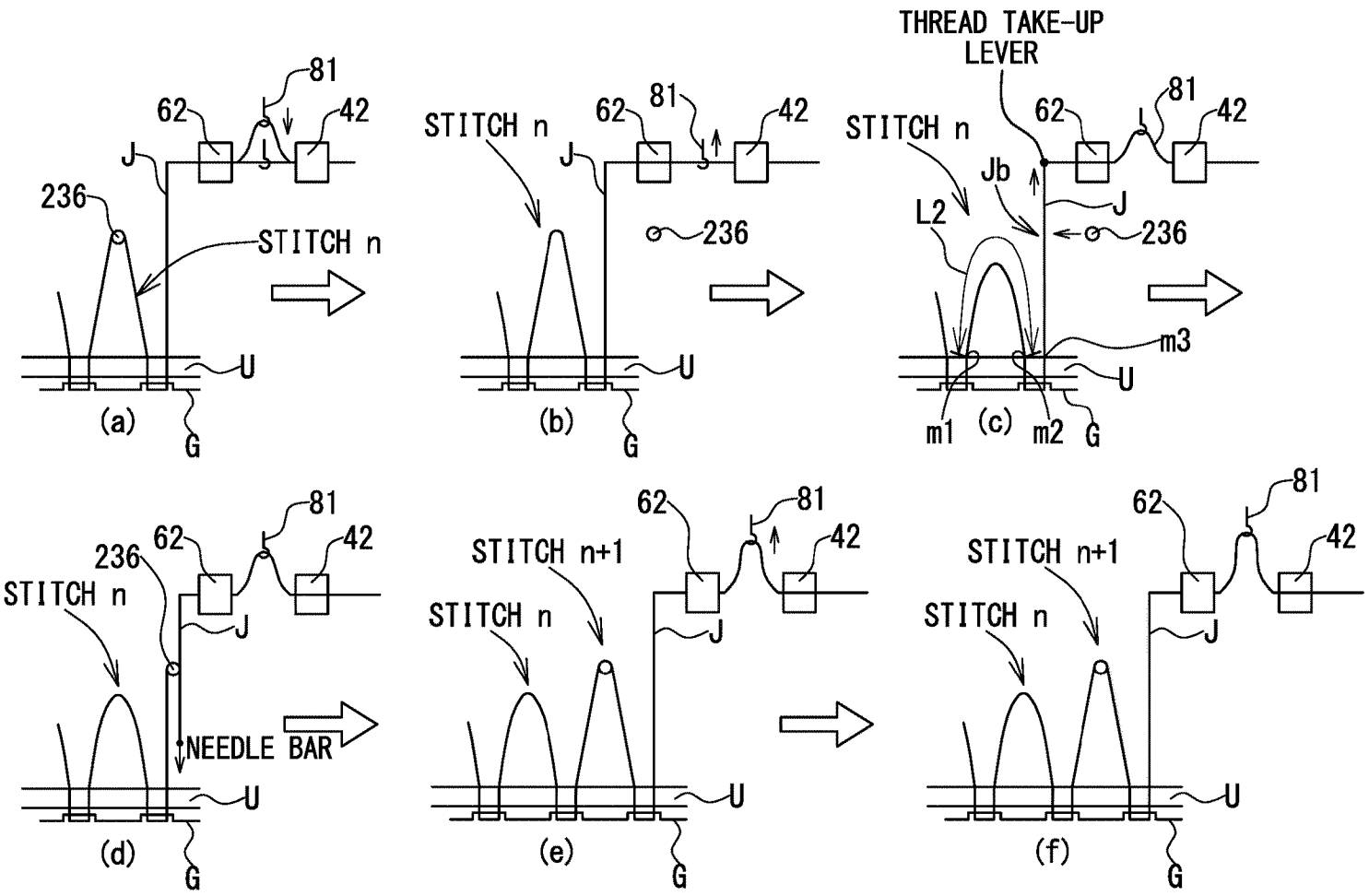

[Fig. 21]
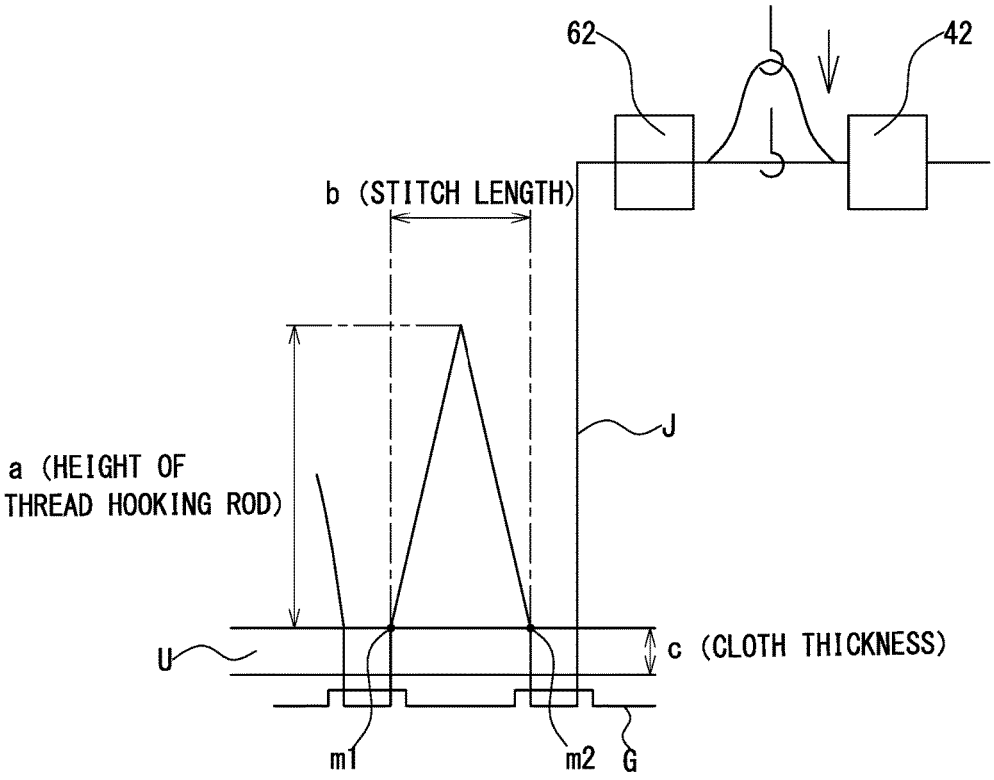

[Fig. 22]
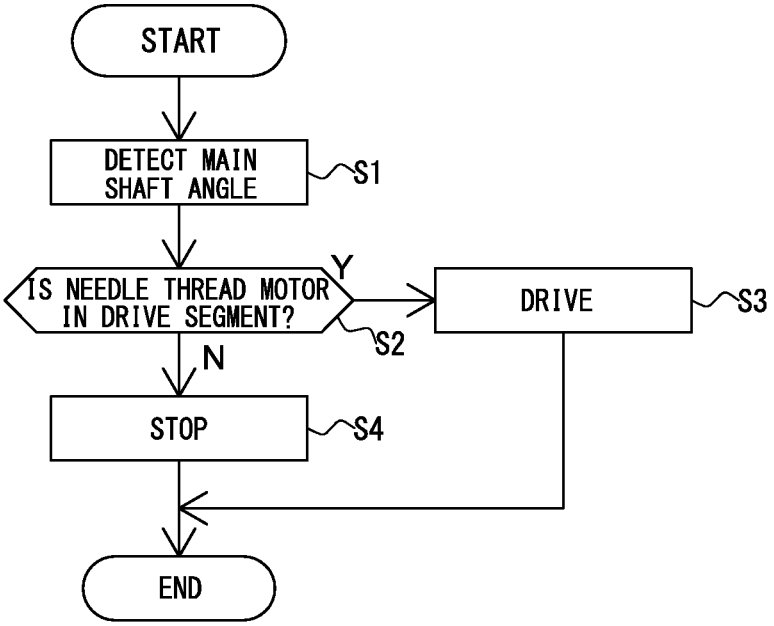

[Fig. 23]
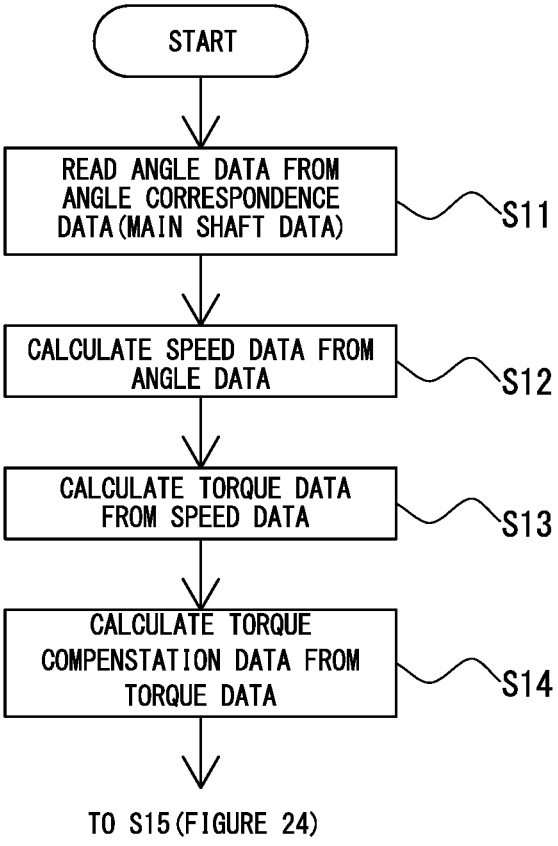

[Fig. 24]
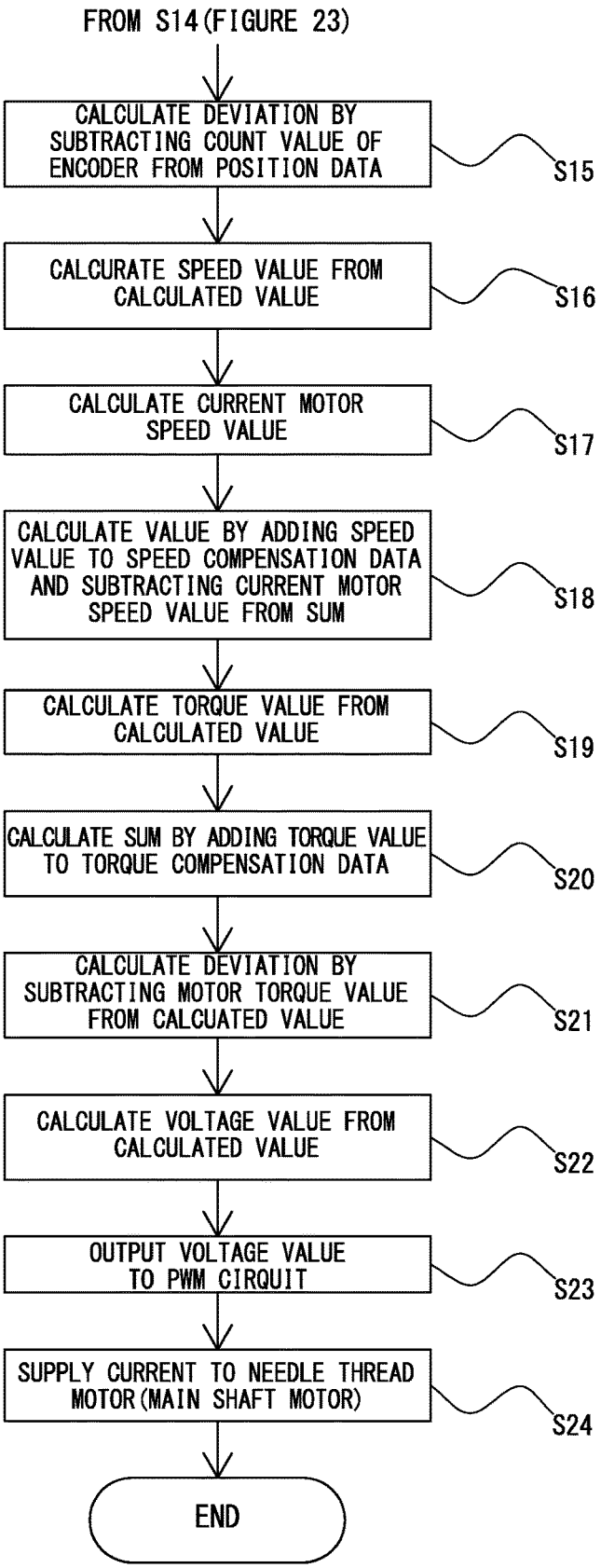

[Fig. 25]
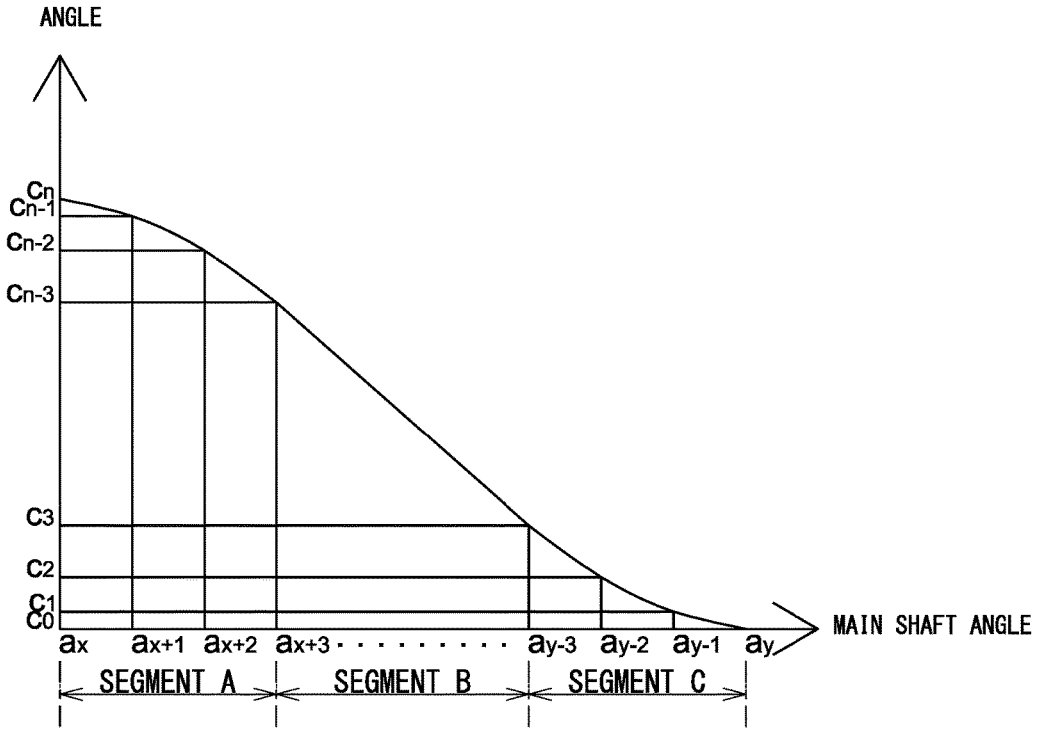

[Fig. 26]
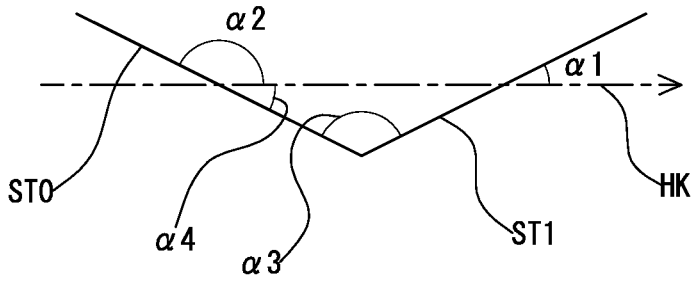

[Fig. 27]
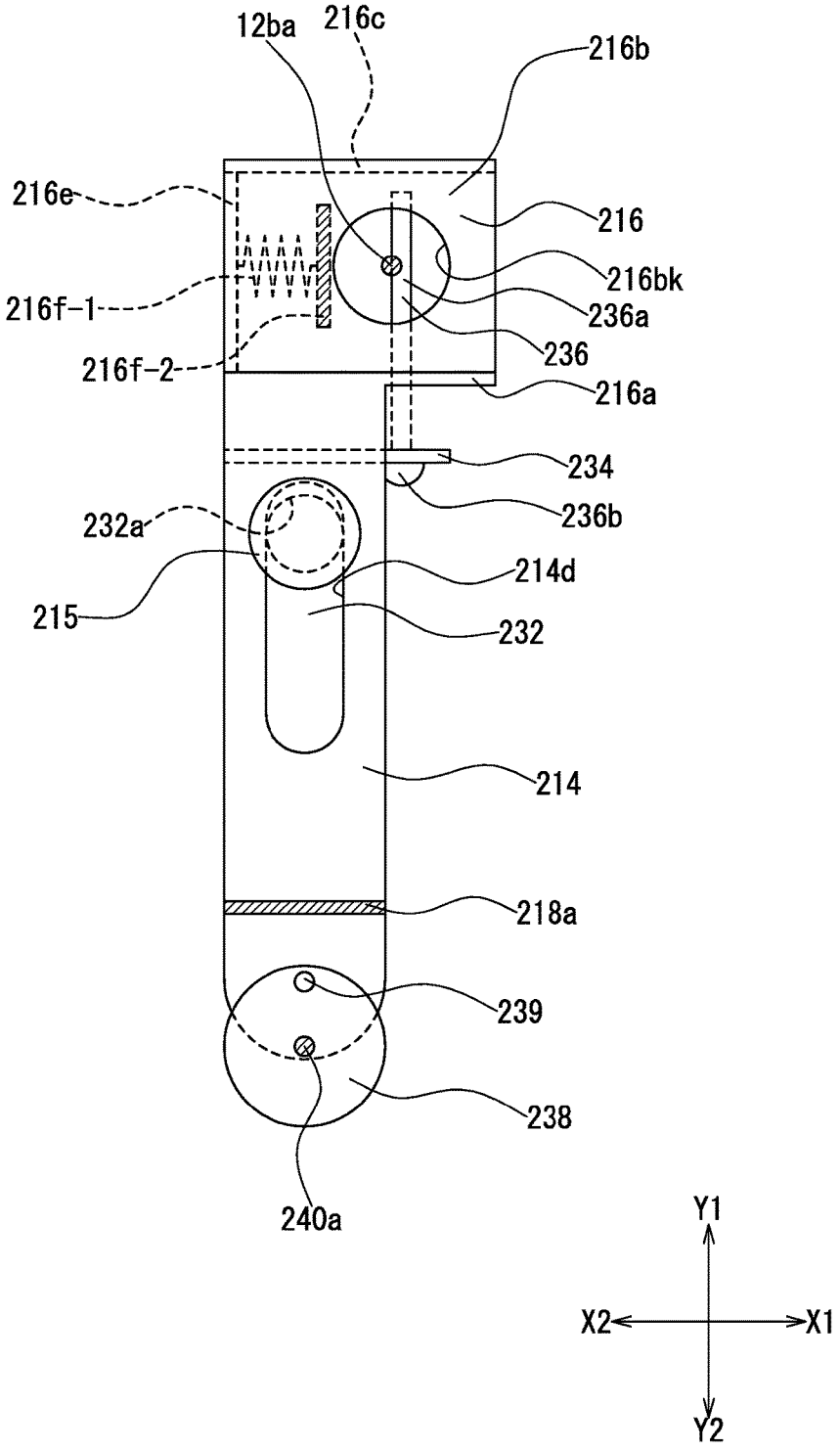

[Fig. 28]
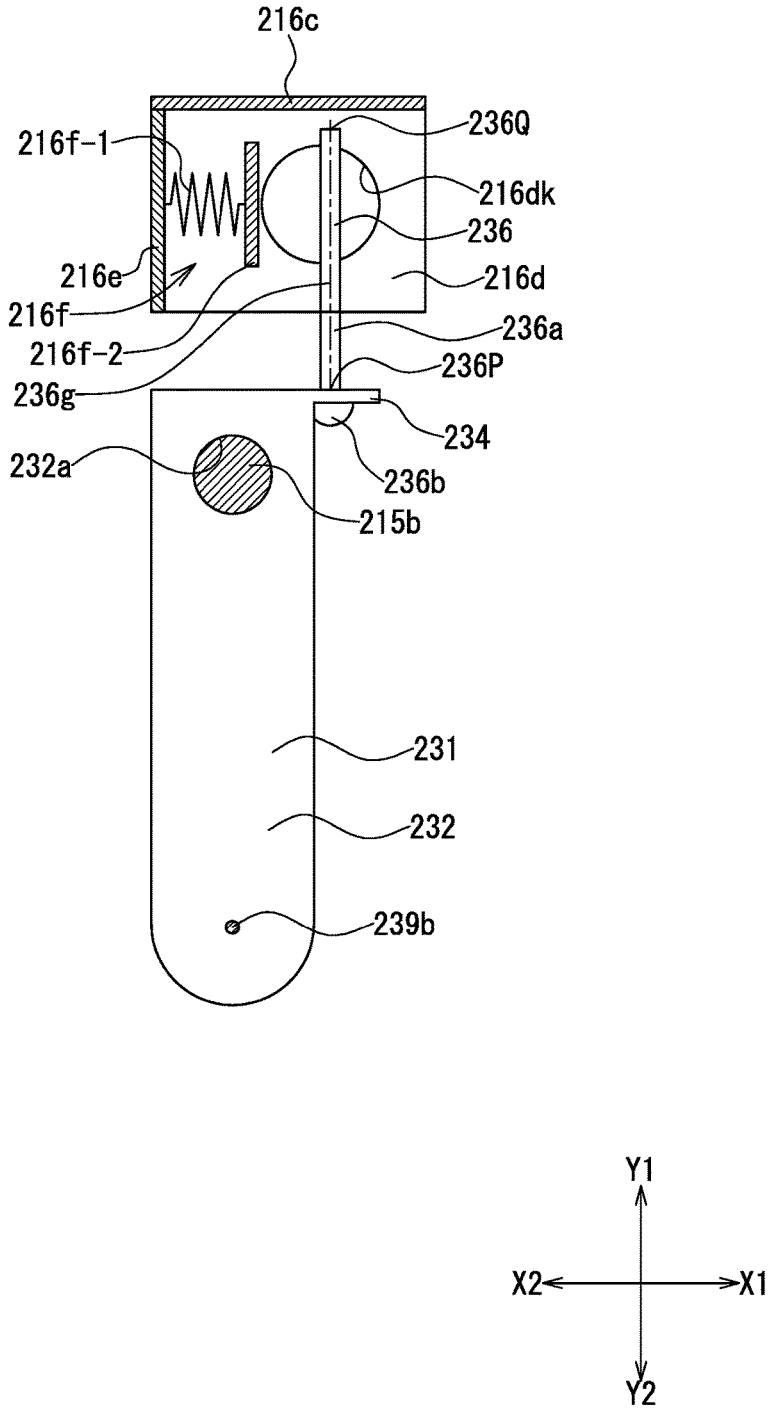

[Fig. 29]
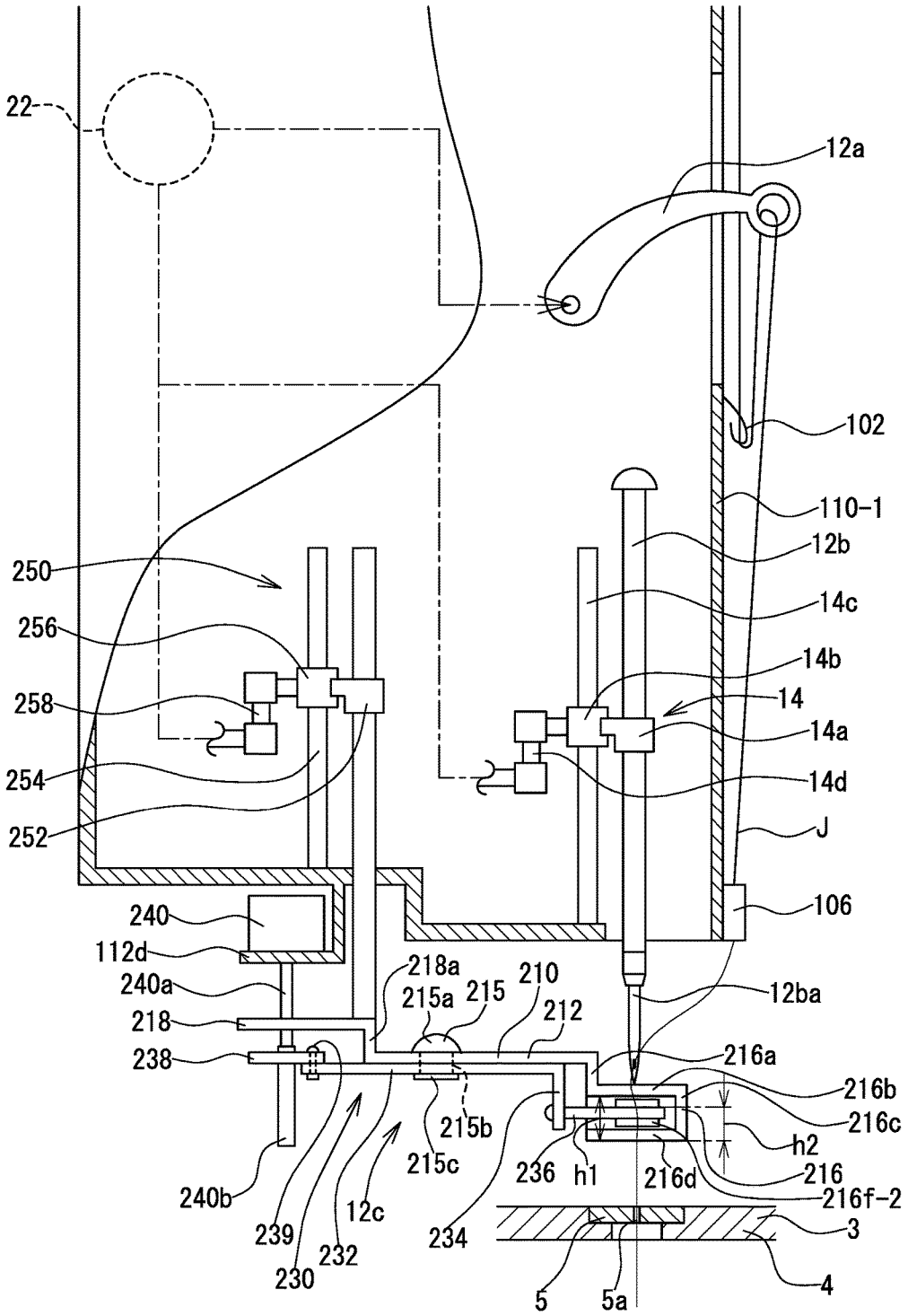

[Fig. 30]
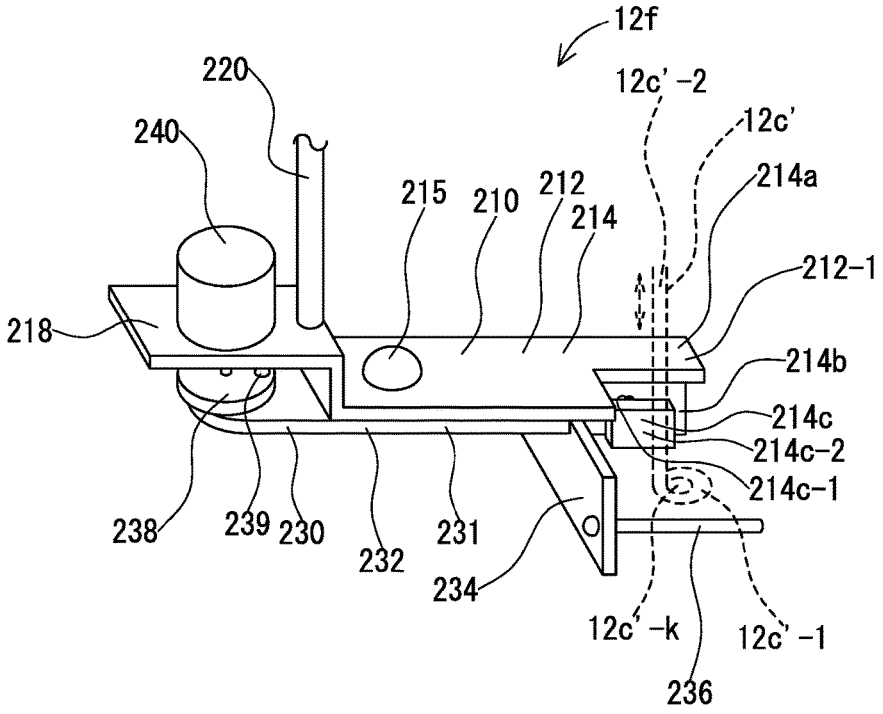
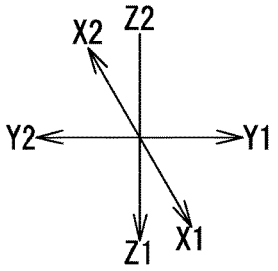

SEWING MACHINE

TECHNICAL FIELD

The present invention relates to a sewing machine and, more particularly, to an embroidery sewing machine.

BACKGROUND ART

Hitherto-known methods for creating hollow embroidery (hollow three-dimensional embroidery) are to make embroidery while placing plate-shaped members on a cloth to be embroidered and, subsequently, to dissolve the plate-shaped member.

For instance, according to a method stated in Patent Document 1 for manufacturing embroidery having hollow three-dimensional patterns, a foundation cloth is embroidered by use of water-insoluble embroidery thread and an embroidery back thread. After the foundation cloth is further embroidered with an overlapping unwoven cloth and/or a woven cloth formed from water-soluble fiber, the water-soluble fiber is dissolved and removed in water whose dissolution temperature is higher than that of the water-soluble fiber by at least 10° C. or more, thereby obtaining hollow embroidery.

According to an embroidery patch and a processing method in Patent Document 2, an embroidery patch internally including an organdy core material in an integrated manner is obtained through: an embroidery step of embroidering organdy with an overlapping synthetic resin plate which dissolves in an organic solvent; a separation step of cutting off unwanted portions of the synthetic resin plate other than the embroidered portion formed in the embroidery step; a plate dissolution step of dissolving and eliminating the synthetic resin plate still left in the embroidery by bringing the embroidered portion cut off in the separation step into contact with the organic solvent along with the organdy and the synthetic resin plate provided inside; and a heat-cutting step of cutting the organdy with heat along an outer brim of the embroidery.

In relation to an auxiliary embroidery member, and an embroidery method, and an embroidery product utilizing the auxiliary embroidery member mentioned in Patent Document 3, an embroidery method utilizing a spacer is to obtain hollow three-dimensional embroidery through the steps of: placing a spacer on a foundation cloth; sewing the foundation cloth with the embroidery thread by way of the spacer; and dissolving the spacer in tetrachloroethylene.

The applicants have already filed the patent applications of Patent Document 4 and Patent Document 5 in connection with a sewing machine including: an upstream grip section having an upstream grip section section main body for gripping a needle thread by pinching; a downstream grip section that is placed at a downstream position on a needle thread path with reference to the upstream grip section and that has a downstream grip section main body which grips the needle thread by pinching; and a circular movement section for circularly moving the needle thread between the upstream grip section main body and the downstream grip section main body.

RELATED ART DOCUMENTS

Patent Documents

Patent Document 1: Japanese Unexamined Patent Application Publication No. 11-21758

Patent Document 2: Japanese Unexamined Patent Application Publication No. 2003-250611

Patent Document 3: WO 98/59101

Patent Document 4: WO 2012/014610

Patent Document 5: WO 2013/047477

SUMMARY OF THE INVENTION

Problems that the Invention is to Solve

However, under the method for manufacturing hollow embroidery mentioned in Patent Documents 1 through 3, a cloth to be embroidered is embroidered while a plate-shaped member is put on the cloth, and the plate-shaped member is dissolved. Hence, in addition to the cloth to be embroidered, the plate-shaped member is necessary, which incurs the cost of the other member. Since additional operation for dissolving the plate-shaped member becomes necessary, it entails consumption of labor and expenses. Moreover, since embroidery is carried out while plate-shaped members are superposed, difficulty is encountered in adjusting the length of the needle thread (the height of hollow embroidery) on a per-stitch basis and obtaining elaborate hollow embroidery.

Accordingly, the objective of the present invention is to provide a sewing machine which does not need the plate-shaped member to be superposed on the cloth to be embroidered; which does not need to dissolve the plate-shaped member; which enables adjustment of the length of the needle thread on a per-stitch basis; and which enables production of elaborate hollow embroidery.

Means for Solving the Problem

The present invention has been created to solve the above-mentioned drawbacks. First, there is provided a sewing machine comprising:

a thread take-up lever (12*a*) formed in a swayable manner;

a sewing needle (12*ba*) that is supported on a vertically-movable needle bar and into which the needle thread is to be inserted;

a shuttle (12*d*) that makes stitches (which can also be mentioned as "making stitches by entwining, in a hooking manner, the needle thread inserted into the sewing needle with a hook bobbin thread") by hooking the needle thread inserted into the sewing needle;

an upstream grip section (40) that has an upstream grip section main body (41) for gripping the needle thread in a pinching manner and an upstream drive section (50) for switching the upstream grip section main body between a closed state where the needle thread is gripped and an open state where the gripped needle thread is released;

a downstream grip section (60)

that is disposed at a downstream position on a needle thread path with respect to the upstream grip section and an upstream position with respect to the thread take-up lever, and that has a downstream grip section main body (61) for gripping the needle thread in a pinching manner and a downstream drive section (70) for switching the downstream grip section main body between the closed state where the needle thread is gripped and the open state where the gripped needle thread is released;

a circular movement section (80)

that bends the needle thread via a first needle thread portion (Ja) of the needle thread located between the upstream grip section main body and the downstream grip section main body by circularly moving the first needle thread portion, and that has a circular movement arm (81) to contact the needle thread, and a needle thread motor (86) which circularly moves the circular movement arm in a first direction in which a degree of bend of the needle thread becomes greater and a second direction opposite to the first direction and which circularly moves the circular movement arm in a range of circular movement between a first end position that is an end in the first direction and a second end position that is an end in the second direction;

a needle thread fixing section (230, 216*f*) that fixes a second needle thread portion (Jb) of the needle thread situated between a cloth and the thread take-up lever at a position apart from a cloth surface and at a position deviating toward the cloth surface from a position where the sewing needle is to be inserted;

a needle thread fixing drive section (240) that performs switching between a fixed state where the needle thread is fixed by the needle thread fixing section and a released state where the needle thread fixed by the needle thread fixing section is released; and a control section (90)

that controls operation of the upstream drive section, operation of the downstream drive section, operation of the needle thread motor, and operation of the needle thread fixing drive section (which can also be referred to as a "needle thread fixing section");

that, in a first segment which is at least a portion of a segment from a top dead center of the shuttle to a bottom dead center of the shuttle, circularly moves the circular movement arm by control of the needle thread motor in the second direction through an angle corresponding to a stitch reference length which is a needle thread length of a stitch achieved while an $n+1^{th}$ stitch next to a proximal $n^{th}$ stitch ("n" is an integer), among stitches already made in the cloth, is fixed to the needle thread fixing section;

that, in a second segment which is at least a portion of a segment from the bottom dead center of the thread take-up lever to the top dead center of the thread take-up lever, circularly moves the circular movement arm, by control of the needle thread motor, in the first direction through an angle corresponding to a length which is obtained by subtracting a remaining length of the needle thread, or the length of the needle thread projecting out of the cloth surface in the $n^{th}$ stitch, from the stitch reference length of the $n^{th}$ stitch;

that, in a third segment which is at least a portion of the segment from an end position of the second segment to a position where the shuttle hooks the needle thread, circularly moves the circular movement arm, by control of the needle thread motor, up to the first end position in the first direction;

that controls the upstream drive section, thereby bringing the upstream grip section into a closed state at any position in a segment from an end position of the third segment section to a position where the shuttle hooks the needle thread, and brings the upstream grip section into an open state at any position in a segment from the end position of the second segment to a start position of the third segment;

that controls the downstream drive section, thereby bringing the downstream grip section into a closed state at any position in a segment from the end position of the second segment section to a position where the upstream grip section is switched from the closed state to the open state, and brings the downstream grip section into an open state at any position in a segment from a position where the upstream grip section is switched from the open state to the closed state to a position where the shuttle hooks the needle thread; and that controls the needle thread fixing drive section, thereby bringing the second needle thread portion into a fixed state by means of the needle thread fixing section at least when the sewing needle is inserted into the cloth and when the shuttle hooks the needle thread.

In relation to the sewing machine having the first configuration, the circular movement arm performs circular movement through an angle corresponding to the stitch reference length, which is a stitch length achieved when the $n+1^{th}$ stitch is fixed by the needle thread fixing section in the first segment. Hence, the needle thread having the length required for the $n+1^{th}$ stitch is prepared between the cloth and the circular movement arm. When the shuttle descends from its top dead center to hook the needle thread, the second needle thread portion is fixed by the needle thread fixing section. Therefore, there is no risk of the shuttle withdrawing the needle thread from the stitch fixed by the needle thread fixing section (i.e., the $n^{th}$ stitch). In addition, the upstream grip section stays closed, and the downstream grip section stays open. Accordingly, there is no fear of the needle thread being withdrawn from an upstream position with respect to the upstream grip section.

Subsequently, the thread take-up lever ascends in the second segment. However, in the course of ascending action of the thread take-up lever, the circular movement arm performs circular movement in the first direction, thus withdrawing the needle thread from the $n^{th}$ stitch. For this reason, the remaining length of the needle thread of the $n^{th}$ stitch correspondingly becomes shorter. By specifying the remaining length of the needle thread for each stitch in advance, the height of hollow embroidery can thereby be controlled on a per-stitch basis.

Thereafter, although the sewing needle is subsequently inserted into the cloth, the needle thread is held fixed by the needle thread fixing section. Therefore, the needle thread becomes folded back at the position of the needle thread fixing section.

Then, circular movement is performed in the first direction in the third segment. However, on this occasion, the upstream grip section stays open, and the downstream grip section stays closed. Therefore, the needle thread is withdrawn from an upstream position with respect to the upstream grip section. Thereby, the needle thread will not become deficient in subsequent stitches.

As above, the sewing machine of the present invention creates hollow embroidery by fixing the needle thread with the thread hooking rod. Therefore, the plate-shaped member to be used for superposing the needle thread on the cloth to be embroidered is unnecessary by the needle thread fixing section, nor is required dissolution of the plate-shaped member. Moreover, the length of the needle thread can be controlled on a per-stitch basis by means of the angle of circular movement of the circular movement arm in the second segment. Therefore, there can be provided a sewing machine capable of creating elaborate hollow embroidery. The length of the needle thread (i.e., the remaining length of the needle thread) is made longer, thereby preventing excessive pulling of the cloth, which would otherwise be caused by making stitches, and the embroidered cloth does not become wavy (or uneven). Further, stitches can be made soft.

In the first configuration, the control section can also be embodied as follows. Specifically, "the control section (90) that controls the operation of the upstream drive section, the operation of the downstream drive section, the operation of the needle thread motor, and the operation of the needle thread fixing drive section (or can also be referred to as a "needle thread fixing section"); that, in the first segment which is at least the portion of a time segment from the top dead center of the shuttle to the bottom dead center of the shuttle, circularly moves the circular movement arm, by control of the needle thread motor, in the second direction through an angle corresponding to a stitch reference length which is the stitch needle thread length achieved while an $n+1^{th}$ stitch next to a proximal $n^{th}$ stitch ("n" is an integer), among stitches already made in the cloth, is fixed to the needle thread fixing section; that, in the second segment which is at least a portion of a time segment from the bottom dead center of the shuttle to the top dead center of the shuttle, circularly moves the circular movement arm, by control of the needle thread motor, in the first direction through the angle corresponding to the length which is the length of the needle thread obtained by subtracting a remaining length of the needle thread, or the length of the needle thread projecting out of the cloth surface in the $n^{th}$ stitch, from the stitch reference length in the $n^{th}$ stitch; that, in the third segment which is at least the portion of the time segment from the end position of the second segment to the position where the shuttle hooks the needle thread, circularly moves the circular movement, by control of the needle thread motor, up to the first end position in the first direction; that controls the upstream drive section, thereby bringing the upstream grip section into the closed state at any position in a time segment from the end position of the third segment section to the position where the shuttle hooks the needle thread, and brings the upstream grip section into an open state at any position (which can also be taken as "any time position in a time segment, and the same also applies to any counterparts throughout the specification) in a time segment from the end position of the second segment to the start position of the third segment; that controls the downstream drive section, thereby bringing the downstream grip section into the closed state at any position in a time segment from the end position of the second segment section to the position where the upstream grip section is switched from the closed state to the open state, and brings the downstream grip section into the open state at any position in a time segment from the position where the upstream grip section is switched from the open state to the closed state to the position where the shuttle hooks the needle thread; and that controls the needle thread fixing drive section, thereby bringing the second needle thread portion into the fixed state by means of the needle thread fixing section at least when the sewing needle is inserted into the cloth and when the shuttle hooks the needle thread."

In the first configuration, the control section can also be embodied as follows. Specifically, "a control section (90) that controls operation of the upstream drive section, operation of the downstream drive section, operation of the needle thread motor, and operation of the needle thread fixing drive section (or can also be called a "needle thread fixing section"); that, in the first segment which is at least a portion of a segment from the top dead center of the shuttle to the bottom dead center of the shuttle, circularly moves the circular movement arm, by control of the needle thread motor, in the second direction through an angle corresponding to a stitch reference length which is a stitch needle thread length achieved while the $n+1^{th}$ stitch next to the proximal $n^{th}$ stitch ("n" is an integer), among the stitches already made in the cloth, is fixed to the needle thread fixing section; that, in the second segment which is at least a portion of the segment from the bottom dead center of the shuttle to the top dead center of the shuttle, circularly moves the circular movement arm, by control of the needle thread motor, in the first direction through an angle corresponding to the length which is the length of the needle thread obtained by subtracting a remaining length of the needle thread, or the length of the needle thread projecting out of the cloth surface in the $n^{th}$ stitch, from the stitch reference length in the $n^{th}$ stitch; that, in the third segment which is at least a portion of the time segment from termination of the second segment to a position where the shuttle hooks the needle thread, circularly moves the circular movement, by control of the needle thread motor in the first direction, up to the first end position; that controls the upstream drive section, thereby bringing the upstream grip section into a closed state at any time in the segment from termination of the third segment section to a position where the shuttle hooks the needle thread, and brings the upstream grip section into an open state at any time in the segment from termination of the second segment to initiation of the third segment; that controls the downstream drive section, thereby bringing the downstream grip section into a closed state at any time in the segment from termination of the second segment section to a time when the upstream grip section is switched from the closed state to the open state, and brings the downstream grip section into an open state at any time in the segment from a time when the upstream grip section is switched from the open state to the closed state to a time when the shuttle hooks the needle thread; and that controls the needle thread fixing drive section, thereby bringing the second needle thread portion into a fixed state by means of the needle thread fixing section at least when the sewing needle is inserted into the cloth and when the shuttle hooks the needle thread."

Second, the first configuration is characterized by comprising a presser foot (12*c*) which moves between a cloth surface contact position where the presser foot contacts the cloth surface and a cloth surface apart position where the presser foot is apart from the cloth surface, and the presser foot is provided with the needle thread fixing section.

Third, the second configuration is characterized in that the presser foot has a presser foot main body (210) having a cloth surface contact section (216) (which can also be referred to as a "leading-end structure section," and the same also applies to any counterparts throughout the specification) which contacts the cloth surface when the presser foot is at the cloth surface contact position;

the needle thread fixing section has a rod-shaped thread hooking rod (236), a thread hooking rod support (which can also be referred to as a "swayingly reciprocating mechanism," and the same also applies to any counterparts throughout the specification) (231) which supports the thread hooking rod, and a needle thread receiving section (216*f*) which is provided at a position on the cloth surface contact section deviating toward the cloth surface with respect to the insertion position where the sewing needle is to be inserted and which fixes the needle thread by pinching the needle thread, hooked by the thread hooking rod, along with the thread hooking rod;

the thread hooking rod support moves with respect to the presser foot main body such that the thread hooking rod swivels as a result of driving of the needle thread fixing drive section; and at a time of swiveling of the thread hooking rod, driving of the needle thread fixing drive section is stopped at least in a segment from when the sewing thread is inserted into the cloth to when the shuttle hooks the needle thread, thereby achieving a fixed state where the thread hooking rod fixes the needle thread by pinching together with the needle thread receiving section. Therefore, the needle thread can be fixedly pinched between the thread hooking rod and the needle thread receiving section.

Incidentally, the third configuration can also be embodied as follows. Specifically, "the presser foot has the presser foot main body (210) having the cloth surface contact section (216) (which can also be referred to as a "leading-end structure section," and the same also applies to any counterparts throughout the specification) that contacts the cloth surface when the presser foot is at the cloth surface contact position. The needle thread fixing section has the thread hooking rod support (231) that reciprocally moves in a second sideway direction orthogonal to the first sideway direction, while swaying in the first sideway direction with respect to the presser foot main body, by means of the crank mechanism to be driven by the needle thread fixing drive section; the rod-shaped thread hooking rod (236) fixed to the thread hooking rod support; and the needle thread receiving section (216*f*) provided at the position on the cloth surface contact section deviating toward the cloth surface with respect to the insertion position where the sewing needle is to be inserted and which fixes the needle thread by pinching the needle thread, hooked by the thread hooking rod, along with the thread hooking rod. As a result of the needle thread fixing drive section being driven, the thread hooking rod support moves to and fro in the second sideway direction while swaying in the first sideway direction, whereby the thread hooking rod swivels. At the time of swiveling of the thread hooking rod, the needle thread fixing drive section stops driving at least in a segment from when the sewing thread is inserted into the cloth to when the shuttle hooks the needle thread, thereby achieving a fixed state where the thread hooking rod fixes the needle thread by pinching together with the needle thread receiving section."

In addition, the third configuration can also be embodied as follows. Specifically, "in relation to the second configuration, the presser foot has the presser foot main body (210) having the cloth surface contact section (216) that contacts the cloth surface when the sewing needle is inserted into the cloth and a main body structure section (214) formed closer to a rear side than the cloth surface contact section when one of the sideway direction is taken as a rear side of the presser foot. The needle thread fixing section has the thread hooking rod support (231) that reciprocally moves in a front-back direction while swaying in a right-left direction with respect to the main body structure section by means of the crank mechanism to be driven by the needle thread fixing drive section; the rod-shaped thread hooking rod (236) fixed to the thread hooking rod support; and the needle thread receiving section (216*f*) provided at the position on the cloth surface contact section deviating toward the cloth surface with respect to the insertion position where the sewing needle is to be inserted and which fixes the needle thread by pinching the needle thread hooked by the thread hooking rod, along with the thread hooking rod. As a result of the needle thread fixing drive section being driven, the thread hooking rod support moves to and fro in the second sideway direction while swaying in the first sideway direction, whereby the thread hooking rod swivels. At the time of swiveling of the thread hooking rod, the needle thread fixing drive section stops driving at least in a segment from when the sewing thread is inserted into the cloth to when the shuttle hooks the needle thread, thereby achieving a fixed state where the thread hooking rod fixes the needle thread by pinching together with the needle thread receiving section."

Fourth, the third configuration is characterized in that the thread hooking rod support reciprocally moves in a second sideway direction orthogonal to a first sideway direction, while swaying in the first sideway direction with respect to the presser foot main body, by means of a crank mechanism to be driven by the needle thread fixing drive section; and the thread hooking rod swivels as a result of the thread hooking rod support reciprocally moving in the second sideway direction while swaying in the first sideway direction.

Fifth, the third or fourth configuration is characterized in that the needle thread receiving section has an elastic section (216*f*-1) provided at a position on the cloth surface contact section deviating toward the cloth surface with respect to the insertion position where the sewing needle is to be inserted, and a needle thread receiving section main body (216*f*-2) that is attached to the elastic section and that fixedly pinches the needle thread together with the thread hooking rod.

Therefore, since the elastic section is attached to the needle thread receiving section, the needle thread can be reliably fixed and pinched between the thread hooking rod and the needle thread receiving main body.

The following configuration can also be adopted. Specifically, "the third, fourth, or fifth configuration can also be embodied as a sewing machine characterized in that the cloth surface contact section has a pair of sideway plates provided in parallel to each other along the sideway direction; that each of the pair of sideway plates has an inserted portion for insertion of the sewing needle; and that the thread hooking rod swivels at a position between the pair of sideway plates in the up-down direction."

Alternatively, the following configuration can also be adopted. Specifically, "the third, fourth, or fifth configuration can also be embodied as a sewing machine, wherein connection section which connects the pair of sideway plates is provided at a position deviating toward the cloth surface (that can also be referred to as an "upper surface of the cloth") with respect to the sewing needle insertion position, and the connection section is provided with the needle thread receiving section."

Sixth, any of the third to fifth configurations is characterized in that the presser foot main body has a main body structure section (214) that is continued from the cloth surface contact section and faces the thread hooking rod support; a shaft (215) is inserted into one of the main body structure section and the thread hooking rod support; that an elongated opening (232*k*) with the shaft inserted is opened in a remaining one of the two; and that the thread hooking rod swivels by rotationally moving an end area of the thread hooking rod support opposite the thread hooking rod.

Seventh, any of the third to sixth configurations is characterized in that the needle thread fixing drive section is a motor fixed to the presser foot main body; and that the thread hooking rod support is reciprocally moved in the second sideway direction, while swaying in the first sideway direction with respect to the presser foot main body, by means of torque of the motor.

Alternatively, the following configuration can also be adopted. Specifically, "the sixth configuration can also be embodied as a sewing machine characterized in that a support which supports the needle thread fixing drive section is provided on a side of the main body structure section of the presser foot main body section opposite to the cloth surface contact section (which can also be a "rear-side of the main body structure section"); that the needle thread fixing drive section is a motor fixed to the support; that a rotary disc is attached to a rotary shaft of the motor; that an end area on the rear-side of the thread hooking rod support is connected at a position deviating from a rotation center of the rotary disc; and that the thread hooking rod support reciprocally moves in the second sideway direction (which can also be taken as a "front-back direction") while swaying in the first sideway direction (which can also be taken as a "right-left direction") with respect to the main body structure section by means of torque of the motor."

Eighth, any of the third to sixth configurations is characterized in that the needle thread fixing drive section is a motor fixed to a case making up a housing of the sewing machine; and the thread hooking rod support is reciprocally moved in the second sideway direction by means of torque of the motor while swaying in the first sideway direction with respect to the presser foot main body.

The following configuration can also be adopted. Specifically, "the sixth configuration can also be embodied as a sewing machine characterized in that the needle thread fixing drive section is a motor fixed to a case making up a housing of the sewing machine; that a rotary disc concentric with the rotation center of the motor is attached to the motor so as to be reciprocally movable; that there is provided a transmission section for transmitting the torque of the motor to the rotary disc; an end area opposite a portion of the thread hooking rod support opposite the thread hooking rod is connected to the rotary disc at the position deviating from the rotation center of the rotary disc; and that the thread hooking rod support is reciprocally moved in the second sideway direction while swaying in the first sideway direction with respect to the main body structure section by means of the torque of the motor."

Ninth, in relation to the first configuration, the needle thread fixing section has a rod-shaped thread hooking rod (236), a thread hooking rod support (231) that supports the thread hooking rod, a needle thread receiving section (216*f*, 214*c*) that fixedly pinches the needle thread hooked by the thread hooking rod by pinching together with the thread hooking rod, and the sewing machine has a needle thread fixing main body (212-1) that supports the needle thread receiving section, wherein the thread hooking rod support moves with respect to the needle thread fixing main body such that the thread hooking rod swivels by means of driving of the needle thread fixing drive section. Therefore, the needle thread can be pinched and fixed by the thread hooking rod and the needle thread receiving section.

Alternatively, the following configuration can also be adopted. Specifically, "in relation to the ninth configuration, the thread hooking rod support moves to and fro in the second sideway direction orthogonal to the first sideway direction while swaying in the first sideway direction with respect to the needle thread fixing section main body by means of the crank mechanism to be driven by the needle thread fixing drive section, and the thread hooking rod swivels as a result of the thread hooking rod support moving to and fro in the second sideway direction while swaying in the first sideway direction."

Tenth, in relation to the ninth configuration, the needle thread receiving section has an elastic section (216*f*-1, 214*c*-1) provided on the needle thread fixing main body and the needle thread receiving section main body (216*f*-2, 214*c*-2) that is attached to the elastic section and fixedly pinches the needle thread together with the thread hooking rod.

Accordingly, since the elastic section is attached to the needle thread receiving main body, the needle thread can be reliably pinched and fixed by the thread hooking rod and the needle thread receiving main body.

Further, the following configuration can also be adopted. Specifically, "the ninth or tenth configuration can also be embodied as a sewing machine characterized in that the needle thread fixing main body has the main body structure section (214) opposite the thread hooking rod support; that the shaft (215) is inserted into one of the main body structure section and the thread hooking rod support; that the elongated opening (232*k*) with the shaft inserted is opened in a remaining one of the two; and that the thread hooking rod swivels by rotationally moving an end area of the thread hooking rod support opposite the thread hooking rod."

Alternatively, the following configuration can also be adopted. Specifically, "the ninth or tenth configuration can also be embodied as a sewing machine characterized in that the needle thread fixing drive section is the motor fixed to the needle thread fixing main body; and that the thread hooking rod support is reciprocally moved in the second sideway direction while swaying in the first sideway direction with respect to the needle thread fixing main body by means of the torque of the motor."

Alternatively, the following configuration can also be adopted. Specifically, "the ninth or tenth configuration can also be embodied as a sewing machine characterized in that the needle thread fixing drive section is a motor fixed to the case making up the housing of the sewing machine; and the thread hooking rod support is reciprocally moved in the second sideway direction while swaying in the first sideway direction with respect to the main body structure section by means of torque of the motor."

Eleventh, any of the first through tenth configurations is characterized in that the sewing machine further comprises a storage section (92) that stores embroidery data including data pertaining to a stitch length and a remaining length of the needle thread for each stitch, wherein the control section generates from the embroidery data, on a per-stitch basis, angle correspondence data which specify an angle of the needle thread motor representing a rotational position of the needle thread motor, for each angle of a main shaft motor representing a rotational position of the main shaft motor which rotates the main shaft for transmitting torque to the thread take-up lever; and the control section also controls, on the basis of the angle correspondence data, a position of the needle thread motor to an angle of the needle thread motor corresponding to the angle of the main shaft motor, as the angle of the main shaft motor changes as a result of rotation of the main shaft motor."

Twelfth, any one of the first through tenth configurations is characterized in that the sewing machine further comprises a storage section (92) that stores embroidery data including data pertaining to a stitch length and a remaining length of the needle thread for each stitch, wherein the control section generates data for circular movement arm for storing, on a per-stitch basis, data pertaining to an angle corresponding to a stitch reference length used in the first segment and also storing, on a per-stitch basis, data pertaining to angle data corresponding to a length determined by subtracting a remaining length of the needle thread from the stitch reference length used in the second segment; and the control section generates from the embroidery data and the data for circular movement arm, on a per-stitch basis, angle correspondence data which specify an angle of the needle thread motor representing a rotational position of the needle thread motor, for each angle of a main shaft motor representing a rotational position of the main shaft motor which rotates the main shaft for transmitting torque to the thread take-up lever; and the control section also controls, on the basis of the angle correspondence data, a position of the needle thread motor to an angle of the needle thread motor corresponding to the angle of the main shaft motor, as the angle of the main shaft motor changes as a result of rotation of the main shaft motor."

Thirteenth, any one of the first through twelfth configurations is characterized in that the sewing machine further comprise a needle thread support member (88) that supports in a sideway direction a range on both sides of the first needle thread portion of the needle thread including the first needle thread, wherein a direction of a circulatory movement axis of the circular movement arm is a sideway direction; a first direction in the direction of circular movement of the circular movement arm is an upward direction of circular movement; and a second direction is a downward direction of circular movement.

Fourteenth, a sewing machine comprises:

a thread take-up lever (12*a*) that is formed in a swayable manner and that includes a swaying axis provided in a right-left direction and a needle thread hooking section for hooking a needle thread provided closer to a front side than the swaying axis;

a sewing needle (12*ba*) that is supported by a vertically-movable needle bar and into which the needle thread is to be inserted;

a shuttle (12*d*) that makes stitches (which can also be referred to as "making stitches by entwining, in a hooking manner, the needle thread inserted into the sewing needle with a hook bobbin thread") by hooking the needle thread inserted into the sewing needle;

an upstream grip section (40) that has an upstream grip section main body (41) which grips the needle thread in a pinching manner and an upstream drive section (50) which switches the upstream grip section main body between a closed state where the needle thread is gripped and an open state where the gripped needle thread is released;

a downstream grip section (60)

that is disposed at a downstream position on a needle thread path with respect to the upstream grip section and an upstream position with respect to the thread take-up lever, and that has a downstream grip section main body (61) which grips the needle thread in a pinching manner and a downstream drive section (70) which switches the downstream grip section main body between the closed state where the needle thread is gripped and the open state where the needle thread is released from the gripped state;

a circular movement section (80)

that bends the needle thread via a first needle thread portion (Ja) of the needle thread located between the upstream grip section main body and the downstream grip section main body by circularly moving the first needle thread portion, and that has a circular movement arm (81) which contacts the needle thread and whose circular movement axis is oriented in a right-left direction, and a needle thread motor (86) which circularly moves the circular movement arm in a first direction in which a degree of bend of the needle thread becomes greater and a second direction opposite to the first direction and which circularly moves the circular movement arm in a range of circular movement between a first end position corresponding to an end in the first direction and a second end position corresponding to an end in the second direction;

a needle thread support member (88) that supports, in a right-left direction, a range on both sides of the first needle thread portion of the needle thread including the first needle thread;

a presser foot (12*c*) that moves between a cloth surface contact position where the presser foot contacts the cloth surface and a cloth surface apart position where the presser foot is apart from the cloth surface;

that has a presser foot main body (210) and a needle thread fixing section (230, 216*f*) which fixes a second needle thread portion (Jb) of the needle thread situated between a cloth and the thread take-up lever, at a position apart from upper surface of the cloth and at a position deviating toward the upper surface of the cloth surface from an insertion position where the sewing needle is to be inserted, wherein the presser foot main body has a cloth surface contact section (216) that contacts the cloth surface when the presser foot is at the cloth surface contact position and a main body structure section (214) formed closer to a rear side than the cloth surface contact section, and wherein the needle thread fixing section has a rod-shaped thread hooking rod (236), a thread hooking rod support (231) which supports the thread hooking rod and reciprocally moves in a front-back direction by means of a crank mechanism with respect to the main body structure section while swaying in a right-left direction, and a needle thread receiving section (216*f*) which fixes the needle thread together with the thread hooking rod and which has an elastic section (216*f*-1) provided at a position on the cloth surface contact section deviating toward the upper surface of the cloth with respect to the insertion position where the sewing needle is to be inserted, and a needle thread receiving section main body (216*f*-2) which is attached to the elastic section and which fixedly pinches the needle thread together with the thread hooking rod, and the thread hooking rod swivels when the thread hooking rod support reciprocally moves in the front-back direction while saying in the right-left direction;

that moves between a cloth surface contact position where the presser foot contacts the cloth surface and a cloth surface apart position where the presser foot is apart from the cloth surface;

a needle thread fixing drive section (240) that actuates the crank section and performs switching between a fixed state where the needle thread fixing section fixes the needle thread and a released state where the needle thread fixed by the needle thread fixing section is released;

a storage section (92) that stores embroidery data including data pertaining to a stitch length and a remaining length of the needle thread for each stitch; and a control section (90)

that controls operation of the upstream drive section, operation of the downstream drive section, operation of the needle thread motor, and operation of the needle thread fixing drive section (which can also be taken as a "needle thread fixing section");

that, in a first segment which is at least a portion of a segment from a top dead center of the shuttle to a bottom dead center of the shuttle, circularly moves the circular movement arm, by control of the needle thread motor, in the second direction through an angle corresponding to a stitch reference length which is a needle thread length of a stitch achieved while an $n+1^{th}$ stitch next to a proximal $n^{th}$ stitch ("n" is an integer), among stitches already made in the cloth, is fixed to the needle thread fixing section;

that, in a second segment which is at least a portion of a segment from the bottom dead center of the thread take-up lever to the top dead center of the thread take-up lever, circularly moves the circular movement arm, by control of the needle thread motor, in the first direction through an angle corresponding to a length which is obtained by subtracting a needle thread remaining length, or a length of the needle thread obtained by subtracting a length of the needle thread projecting out of the cloth surface in the $n^{th}$ stitch from the stitch reference length achieved at the $n^{th}$ stitch;

that, in a third segment which is at least a portion of the segment from an end position of the second segment to a position where the shuttle hooks the needle thread, circularly moves the circular movement arm, by control of the needle thread motor, up to the first end position in the first direction;

that, on occasion of control of the needle thread motor, generates from the embroidery data, on a per-stitch basis, angle correspondence data which specify an angle of the needle thread motor representing a rotational position of the needle thread motor, for each angle of a main shaft motor representing a rotational position of the main shaft motor that rotates the main shaft for transmitting torque to the thread take-up lever, and that also controls, on the basis of the angle correspondence data, a position of the needle thread motor to an angle of the needle thread motor corresponding to the angle of the main shaft motor, as the angle of the main shaft motor changes as a result of rotation of the main shaft motor;

that controls the upstream drive section, thereby bringing the upstream grip section into a closed state at any position in a segment from an end position of the third segment section to a position where the shuttle hooks the needle thread, and brings the upstream grip section into an open state at any position in a segment from the end position of the second segment to a start position of the third segment;

that controls the downstream drive section, thereby bringing the downstream grip section into a closed state at any position in a segment from the end position of the second segment section to a position where the upstream grip section is switched from the closed state to the open state, and brings the downstream grip section into an open state at any position in a segment from a position where the upstream grip section is switched from the open state to the closed state to a position where the shuttle hooks the needle thread; and that controls the needle thread fixing drive section, whereby the needle thread fixing drive section stops driving, and the thread hooking rod fixedly pinches the needle thread together with the needle thread receiving section, in at least a segment from when the sewing needle is inserted into the cloth to when the shuttle hooks the needle thread.

In relation to the sewing machine having the fourteenth configuration, the circular movement arm performs circular movement through an angle corresponding to the stitch reference length, which is a stitch length achieved when the $n+1^{th}$ stitch is fixed by the needle thread fixing section in the first segment. Hence, the needle thread having the length required for the $n+1^{th}$ stitch is prepared between the cloth and the circular movement arm. When the shuttle descends from its top dead center to hook the needle thread, the second needle thread portion is fixed by the needle thread fixing section. Therefore, there is no risk of the shuttle withdrawing the needle thread from the stitch fixed by the needle thread fixing section (i.e., the $n^{th}$ stitch). In addition, the upstream grip section stays closed, and the downstream grip section stays open. Accordingly, there is no fear of the needle thread being withdrawn from an upstream position with respect to the upstream grip section.

Subsequently, the thread take-up lever ascends in the second segment. However, in the course of ascending action of the thread take-up lever, the circular movement arm performs circular movement in the first direction, thus withdrawing the needle thread from the $n^{th}$ stitch. For this reason, the remaining length of the needle thread of the $n^{th}$ stitch correspondingly becomes shorter. By specifying the remaining length of the needle thread for each stitch in advance, the height of hollow embroidery can thereby be controlled on a per-stitch basis.

Thereafter, although the sewing needle is subsequently inserted into the cloth, the needle thread is held fixed by the needle thread fixing section. Therefore, the needle thread becomes folded back at the position of the needle thread fixing section.

Then, circular movement is performed in the first direction in the third segment. However, on this occasion, the upstream grip section stays open, and the downstream grip section stays closed. Therefore, the needle thread is withdrawn from an upstream position with respect to the upstream grip section. Thereby, the needle thread will not become deficient in subsequent stitches.

As above, the sewing machine of the present invention creates hollow embroidery by fixing needle thread with the thread hooking rod. Therefore, the plate-shaped member to be used for superposing the needle thread on the cloth to be embroidered is unnecessary with the needle thread fixing section, nor is required dissolution of the plate-shaped member. Moreover, the length of the needle thread can be controlled on a per-stitch basis by means of the angle of circular movement of the circular movement arm in the second segment. Therefore, there can be provided a sewing machine capable of creating elaborate hollow embroidery. The length of the needle thread (i.e., the remaining length of the needle thread) is made longer, thereby preventing excessive pulling of the cloth, which would otherwise be caused by making stitches, and the embroidered cloth does not become wavy (or uneven). Further, stitches can be made soft.

In the fourteenth configuration, the control section can also be embodied as follows. Specifically, "the control section (90) that controls the operation of the upstream drive section, the operation of the downstream drive section, the operation of the needle thread motor, and the operation of the needle thread fixing drive section (or can also be referred to as a "needle thread fixing section"); that, in the first segment which is at least the portion of a time segment from the top dead center of the shuttle to the bottom dead center of the shuttle, circularly moves the circular movement arm, by control of the needle thread motor, in the second direction through an angle corresponding to a stitch reference length which is a needle thread length of a stitch achieved while an $n+1^{th}$ stitch next to a proximal $n^{th}$ stitch ("n" is an integer), among stitches already made in the cloth, is fixed to the needle thread fixing section; that, in the second segment which is at least a portion of a time segment from the bottom dead center of the shuttle to the top dead center of the shuttle, circularly moves the circular movement arm, by control of the needle thread motor, in the first direction through the angle corresponding to the length which is obtained by subtracting a needle thread remaining length, or the length of the needle thread obtained by subtracting the length of the needle thread projecting out of the cloth surface in the $n^{th}$ stitch, from the stitch reference length in the $n^{th}$ stitch; that, in the third segment which is at least the portion of the time segment from the end position of the second segment to the position where the shuttle hooks the needle thread, circularly moves the circular movement arm, by control of the needle thread motor, up to the first end position in the first direction; that, on occasion of control of the needle thread motor, generates from the embroidery data, on a per-stitch basis, angle correspondence data that specify an angle of the needle thread motor representing a rotational position of the needle thread motor, for each angle of a main shaft motor representing a rotational position of the main shaft motor that rotates the main shaft for transmitting torque to the thread take-up lever, and also controls, on the basis of the angle correspondence data, a position of the needle thread motor to an angle of the needle thread motor corresponding to the angle of the main shaft motor, as the angle of the main shaft motor changes as a result of rotation of the main shaft motor; that controls the upstream drive section, thereby bringing the upstream grip section into the closed state at any position in a time segment from the end position of the third segment section to the position where the shuttle hooks the needle thread, and brings the upstream grip section into an open state at any position (which can also be taken as "any time position in a time segment, and the same also applies to any counterparts throughout the descriptions) in a time segment from the end position of the second segment to the start position of the third segment; that controls the downstream drive section, thereby bringing the downstream grip section into the closed state at any position in a time segment from the end position of the second segment section to the position where the upstream grip section is switched from the closed state to the open state, and brings the downstream grip section into the open state at any position in a time segment from the position where the upstream grip section is switched from the open state to the closed state to the position where the shuttle hooks the needle thread; and that controls the needle thread fixing drive section, whereby the needle thread fixing drive section stops driving, and the thread hooking rod fixedly pinches the needle thread together with the needle thread receiving section, in at least a time segment from when the sewing needle is inserted into the cloth to when the shuttle hooks the needle thread."

In the fourteenth configuration, the control section can also be embodied as follows. Specifically, "a control section (90) that controls operation of the upstream drive section, operation of the downstream drive section, operation of the needle thread motor, and operation of the needle thread fixing drive section (or can also be called a "needle thread fixing section"); that, in the first segment which is at least a portion of a segment from the top dead center of the shuttle to the bottom dead center of the shuttle, circularly moves the circular movement arm, by control of the needle thread motor, in the second direction through an angle corresponding to a stitch reference length which is a needle thread length of a stitch achieved while the $n+1^{th}$ stitch next to the proximal $n^{th}$ stitch ("n" is an integer), among the stitches already made in the cloth, is fixed to the needle thread fixing section; that, in the second segment which is at least a portion of the segment from the bottom dead center of the shuttle to the top dead center of the shuttle, circularly moves the circular movement arm, by control of the needle thread motor, in the first direction through an angle corresponding to the length which is obtained by subtracting a needle thread remaining length, or the length of the needle thread obtained by subtracting the length of the needle thread projecting out of the cloth surface in the $n^{th}$ stitch, from the stitch reference length in the $n^{th}$ stitch; that, in the third segment which is at least a portion of the time segment from termination of the second segment to a position where the shuttle hooks the needle thread, circularly moves the circular movement arm, by control of the needle thread motor, up to the first end position in the first direction; that, on occasion of control of the needle thread motor, generates from the embroidery data, on a per-stitch basis, angle correspondence data which specify an angle of the needle thread motor representing a rotational position of the needle thread motor, for each angle of a main shaft motor representing a rotational position of the main shaft motor that rotates the main shaft for transmitting torque to the thread take-up lever, and also controls, on the basis of the angle correspondence data, a position of the needle thread motor to an angle of the needle thread motor corresponding to the angle of the main shaft motor, as the angle of the main shaft motor changes as a result of rotation of the main shaft motor; that controls the upstream drive section, thereby bringing the upstream grip section into a closed state at any time in the segment from termination of the third segment section to a position where the shuttle hooks the needle thread, and brings the upstream grip section into an open state at any time in the segment from termination of the second segment to initiation of the third segment; that controls the downstream drive section, thereby bringing the downstream grip section into a closed state at any time in the segment from termination of the second segment section to a time when the upstream grip section is switched from the closed state to the open state, and brings the downstream grip section into an open state at any time in the segment from a time when the upstream grip section is switched from the open state to the closed state to a time when the shuttle hooks the needle thread; and that controls the needle thread fixing drive section, whereby the needle thread fixing drive section stops driving, and the thread hooking rod fixedly pinches the needle thread together with the needle thread receiving section, in at least a segment from when the sewing needle is inserted into the cloth to when the shuttle hooks the needle thread."

Fifteenth, in relation to the fourteenth configuration, the control section generates data for circular movement arm for storing, on a per-stitch basis, data pertaining to an angle corresponding to a stitch reference length used in the first segment and also storing, on a per-stitch basis, data pertaining to angle data corresponding to a length determined by subtracting a remaining length of the needle thread from the stitch reference length used in the second segment; and generates angle correspondence data from the embroidery data and the data for circular movement arm.

Sixteenth, in relation to any of the first to fifteenth configurations, in the second segment, the control section circularly moves the circular movement arm in the first direction through an angle that is obtained by subtracting the angle corresponding to the remaining length of the needle thread which is a length of the needle thread projecting out of the cloth surface in the $n^{th}$ stitch, from an angle corresponding to the stitch reference length in the $n^{th}$ stitch, instead of circularly moving the circular movement arm in the first direction through an angle corresponding to a length which is obtained by subtracting the remaining length of the needle thread, which is the length of the needle thread projecting out of the cloth surface in the $n^{th}$ stitch, from the stitch reference length in the $n^{th}$ stitch.

Advantages of the Invention

A sewing machine based on the present invention creates hollow embroidery by fixing a needle thread with the needle thread fixing section. Therefore, the plate-shaped member to be used for superposing the needle thread on the cloth to be embroidered is unnecessary, nor is required dissolution of the plate-shaped member. Moreover, the length of the needle thread (in other words, a remaining length of the needle thread) can be controlled on a per-stitch basis by means of the angle of circular movement of the circular movement arm in the second segment. Therefore, there can be provided a sewing machine capable of creating elaborate hollow embroidery. Further, the length of the needle thread (i.e., the remaining length of the needle thread) is made longer, thereby preventing excessive pulling of the cloth, which would otherwise be caused by making stitches, and the embroidered cloth does not become wavy (or uneven). Further, stitches can be made soft.

BRIEF DESCRIPTION OF THE DRAWINGS

FIG. 1 It is an explanatory view showing a structure of a sewing machine.

FIG. 2 It is a front view showing the sewing machine.

FIG. 3 It is a fragmentary cross-sectional left side view showing the sewing machine.

FIG. 4 It is a rear perspective view showing a first plate-shaped section unit.

FIG. 5 It is a main part perspective view of the sewing machine.

FIG. 6 It is an enlarged view of the principal section shown in FIG. 3.

FIG. 7 It is a main part perspective view of a presser foot.

FIG. 8 It is a cross-sectional view taken along line A-A shown in FIG. 6.

FIG. 9 It is a cross-sectional view taken along line B-B shown in FIG. 6.

FIG. 10 It is an explanatory view for explaining operation of a thread hooking rod.

FIG. 11 It is an explanatory view showing a principal section of the sewing machine.

FIG. 12 It is an explanatory view showing a structure of a storage device.

FIG. 13 It is an explanatory view showing a structure of embroidery data.

FIG. 14 It is an explanatory view showing a structure of position data.

FIG. 15 It is an explanatory view showing main shaft data.

FIG. 16 It is an explanatory view showing an example of main shaft data.

FIG. 17 It is an explanatory view showing data for circular movement arm.

FIG. 18 It is an explanatory view showing angle correspondence data.

FIG. 19 It is an explanatory view showing operation of the sewing machine.

FIG. 20 It is an explanatory view showing operation of the sewing machine.

FIG. 21 It is an explanatory view for explaining a standard stitch length.

FIG. 22 It is a flowchart for explaining operation of the sewing machine.

FIG. 23 It is a flowchart showing a method for controlling a needle thread motor.

FIG. 24 It is a flowchart showing the method for controlling the needle thread motor.

FIG. 25 It is an explanatory view for explaining a method for controlling a position of the needle thread motor.

FIG. 26 It is an explanatory view for explaining a stitching direction of the embroidery data.

FIG. 27 It is a transverse cross-sectional view showing another example of a presser foot.

FIG. 28 It is a transverse cross-sectional view showing yet another example of the presser foot.

FIG. 29 It is a main-part fragmentary cross-sectional left-side view showing the sewing machine.

FIG. 30 It is a main-part perspective view of a needle thread fixing unit.

MODE FOR IMPLEMENTING THE INVENTION

In the present invention, an object of providing a sewing machine, which needs neither a plate-shaped member to be superposed on a cloth to be embroidered nor dissolution of the plate-shaped member and which is also capable of adjusting the length of a needle thread on a per-stitch basis and obtaining elaborate hollow embroidery, is accomplished as will be stated below.

A sewing machine 5 of an embodiment is an embroidery sewing machine and configured as illustrated in FIG. 1 to FIG. 14. The sewing machine has a head (an embroidery head) 7, a shuttle 12*d*, a sewing frame 12*e*, a frame actuator 24, a storage device 92.

The head 7 is positioned above an approximately-flat-plate-shaped sewing machine table 3. A frame 120 (see FIG. 2 and FIG. 3) stands upright on an upper surface of the sewing machine table. The head 7 is disposed on a front side of the frame 120. The sewing machine table 3 also assumes the shape of an approximately-flat plate and, as illustrated in FIG. 6, has a plate-shaped table body 4 and a throat plate 5 placed in an opening formed in the table body 4. A pinhole 5*a* is formed in the throat plate 5.

The head 7 is configured as illustrated in FIG. 1 through FIG. 11 and has a mechanical element group 10, a main shaft motor 20, a main shaft 22, an upstream grip section 40, a downstream grip section 60, a circular movement section 80, a needle thread support member 88, a control circuit 90, needle thread guides 104 and 106, and a case 110. A needle thread control section is made up of the upstream grip section 40 and the downstream grip section 60.

The machine element group 10 includes respective machine elements to be actuated in the head 7, and the machine elements include a thread take-up lever 12*a*, a needle bar 12*b*, and a presser foot 12*c*. As in the case of an existing sewing machine, the thread take-up lever 12*a* and the needle bar 12*b* are actuated by transmitting torque of the main shaft 22 by way of power transmission means, such as a cam mechanism and a belt mechanism.

The thread take-up lever 12*a* is disposed in the case 110 and formed so as to be swayable around an axis (a rotation center) extending in a horizontal direction (an X1-X2 direction), thus circularly moving between the bottom dead center (one dead center) and the top dead center (the other dead center). Specifically, the thread take-up lever 12*a* is pivotally supported by the case 110 so as to be swayable around a rotation center (which can also be taken as a pivot) 12*ab*. A needle thread inserted into a sewing needle 12*ba* is inserted into the thread take-up lever 12*a*. A leading end of the thread take-up lever 12*a* projects to the front (Y1 side) out of an opening 116*d* formed in a front section 110-1 of the case 110, thus being exposed. A tension spring 102 [that can also be referred to as a "thread take-up spring" (generally called a "high tension spring")] that guides a needle thread J sent from an upstream position (i.e., from the downstream grip section 60) while eliminating flexure or a slack in the needle thread J is fixedly mounted at a position on the front section 110-1 of the case 110 in a neighborhood of a lower portion of the opening 116*d*. The tension spring 102 inverts the needle thread J guided from the upper position and subsequently guides the needle thread to the thread take-up lever, and tension is exerted on the needle thread J by the tension spring 102. As in the case of the guide member 100, a rod-shaped guide member can also be used in place of the tension spring 102.

The needle bar 12*b* is provided so as to be movable in the vertical direction with reference to the case 110. The sewing needle 12*ba* (the needle thread is inserted into a pin hole 12*bb* of the sewing needle 12*ba*) is fixedly provided at a lower end of the needle bar 12*b*. A needle bar connecting stud 14*a* is fixedly provided at an approximately intermediate position on the needle bar 12*b* in the vertical direction.

Further, a base needle bar 14*c* is disposed in the vertical direction in the case 110. The base needle bar 14*c* is equipped with a needle bar up-down member 14*b* (or can also be referred to as a "needle bar up-down actuation component" or a "needle bar elevation element") which is to engage with a needle bar connecting stud 14*a*, so as to be vertically movable along the base needle bar 14*c*. The needle bar up-down member 14*b* is vertically moved by use of a mechanism for vertically moving the needle bar up-down member 14*b*, whereby the needle bar connecting stud 14*a* is vertically actuated, and the needle bar 12*b* is also vertically moved.

An up-down actuation mechanism 14 serving as a mechanism for actuating the needle bar 12*b* up and down has the needle bar connecting stud 14*a*, the needle bar up-down member 14*b*, and a crank rod 14*d* for actuating the needle bar up-down member 14*b* up and down. A transmission mechanism (not shown) for transmitting torque of the main shaft 22 is joined to the crank rod 14*d*. As a result of the main shaft 22 being rotated, the crank rod 14*d* also rotates, and the needle bar up-down member 14*b* thereby moves up and down along the base needle bar 14*c*. Thus, the needle bar 12*b* reciprocally moves in the vertical direction.

The presser foot 12*c* is provided at a bottom side of the case 110 so as to be movable up and down with respect to the case 110, and also has a thread hooking rod 236 (which can also be a "rod-shaped member") for hooking the needle thread in a sideway direction.

Specifically, as shown in FIG. 2 and FIGS. 6 through 9, the presser foot 12*c* has a main body 210, a swayingly reciprocating mechanism section (which can also be taken as a "rotating mechanism section" or a "swiveling mechanism section") 230 which swayingly performs reciprocation with respect to the main body 210, a thread hooking rod drive motor (an actuation section for fixing a needle thread) 240 for actuating the swayingly reciprocating mechanism section 230. FIG. 8 is a cross-sectional view taken along line A-A shown in FIG. 6, and FIG. 9 is a cross-sectional view taken along line B-B shown in FIG. 6. FIG. 9 shows a cutting position as being shifted on its way.

The main body (a presser foot main body) 210 has a base 212 and a shaft 220 fixed to the base 212.

The base 212 has a main body structure section (which can also be taken as a "central configuration section") 214 assuming the shape of a quadrate (specifically, a "rectangular shape") plate; a leading-end structure section (which can also be taken as a "leading end section") (a "cloth surface contact section") 216 continued from a front-side end (one of a pair of short sides) of the main body structure section 214, a needle thread receiving section 216*f* attached to an interior surface of a vertical plate 216*e* of the leading-end structure section 216, and a base end 218 continued from a rear-side end (a remaining one of the pair of the short sides). The entirety of the base 212 except for a shaft 215 (which will be described later) and the needle thread receiving section 216*f* is integrally formed. The leading-end structure section 216 is equivalent to "the cloth surface contact section which contacts a cloth surface when the presser foot is situated at a cloth surface contact position."

As shown in FIG. 8, the main body structure section 214 is provided with a through hole 214*a*, and the shaft 215 is provided in the through hole 214*a*. Specifically, the shaft 215 has a head 215*a* whose diameter is larger than that of the through hole 214*a*, a shaft main body 215*b* continued from the head 215*a* and inserted into the through hole 214*a*, and a retaining section 215*c* fixed to an end of the shaft main body 215*b* opposite the head 215*a*. Specifically, the shaft 215 is fixed to the main body structure section 214 and inserted into the main body structure section 214 so as not to be able to move with respect to the main body structure section 214 in a direction perpendicular to an axis of the shaft 215. The main body structure section 214 opposes a thread hooking rod support 231 (particularly a sideway plate 232). Although the shaft 215 is configured so as to rotate around the axis of the shaft 215 with respect to the main body structure section 214, the head 215*a* of the shaft 215 can also be configured so as to become fixed to the main configuration 214.

Moreover, the leading-end structure section 216 has a sidewise-elongated quadrate vertical plate 216*a* continued downwardly from a front-side end of the main body structure section 214, a sideway plate 216*b* continued from a front-side end to a front side of the vertical plate 216*a*, a vertical plate 216*c* continued downward from a front-side end of the sideway plate 216*b*, a sidewise-elongated rectangular sideway plate 216*d* continued from a lower end of the vertical plate 216*c* to the rear side, and a vertical plate 216*e* (see FIG. 8 and FIG. 9) formed at right angles to the sideway plate 216*b* and the sideway plate 216*d* between a right-side end of the sideway plate 216*b* and a right-side end of the sideway plate 216*d*. The vertical plate 216*a* forms a right angle with respect to the main body structure section 214 and the sideway plate 216*b*, and the vertical plate 216*c* forms aright angle with respect to the sideway plate 216*b* and the sideway plate 216*d*.

The sideway plate 216*b* and the sideway plate 216*d* assume the shape of a quadrate (specifically a "rectangular shape") plate and are formed parallel to each other. A circular opening 216*bk* is formed in the sideway plate 216*b*, and a circular opening 216*dk* is formed in the sideway plate 216*d*. The opening 216*bk* and the opening 216*dk* are holes for insertion of the needle thread and the sewing needle 12*ba*. The opening 216*bk* and the opening 216*dk* are formed so as to have the same diameter (which can also be said to be substantially the same), and the opening 216*bk* and the opening 216*dk* are placed at the same position in the horizontal direction (in other words, a direction other than the vertical direction). In other words, the openings 216*bk* and 216*dk* are inserted portions for insertion of the sewing needle. As above, the sideway plate 216*b* and the sideway plate 216*d* are formed to have the same size and the same shape. When the sewing needle 12*ba* is inserted into a cloth, the presser foot 12*c* stays descended, and the leading-end structure section 216 remains in contact with the cloth surface. While the leading-end structure section 216 remains in contact with the cloth surface, the lower surface of the sideway plate 216*d* comes into contact with the cloth surface.

A spacing h1 (see FIG. 6) between the sideway plate 216*b* and the sideway plate 216*d* is made larger than a diameter of the thread hooking rod 236 so as to enable the thread hooking rod 236 to be able to swivel at a position between the sideway plate 216*b* and the sideway plate 216*d*. On the occasion of actual sewing operation, the thread hooking rod 236 presses the needle thread while a lower surface of the sideway plate 216*d* of the leading-end structure section 216 remains in contact with the cloth. Accordingly, spacing exists between height of an upper surface of the cloth and height of the thread hooking rod 236. For instance, a spacing h2 (see FIG. 6) exists between a lower surface of the sideway plate 216*d* and an upper end of the thread hooking rod 236. The thread hooking rod 236 thereby fixes the needle thread at a position apart from the surface of the cloth. The spacing h2 is a height of the thread hooking rod in Equation 1 provided below.

A length of the sideway plate 216*b* and a length of the sideway plate 216*d* achieved in a right-left direction (the X1-X2 direction) are made longer than a length of the main body structure section 214 achieved in the right-left direction. Positions of sides on right-side surfaces of the sideway plates 216*b* and 216*d* achieved in the right-left direction coincide with position of side on the right-side surface of the main body structure section 214 achieved in the right-left direction (side of the right-side surface of the sideway plate 216*b* and side of the right-side surface of the main body structure section 214 are in line when viewed from the above). Hence, the sideway plates 216*b* and 216*d* are formed so as to project to the left-side direction with respect to the left-side surface of the main body structure section 214.

The needle thread receiving section 216*f* has an elastic section 216*f*-1 provided on an interior surface of the vertical plate 216*e* and a plate-shaped section (a needle thread receiving main body) 216*f*-2 fixed to an end of the elastic section 216*f*-1 opposite to the vertical plate 216*e*. The elastic section 216*f*-1 is a coil spring that is fixed at one end thereof to the vertical plate 216*e* and at the other end to the plate-shaped section 216*f*-2. The plate-shaped section 216*f*-2 is formed from; for instance, metal or a synthetic resin. The needle thread receiving section 216*f* is for fixedly pinching the needle thread together with the thread hooking rod 236. When the needle thread pushed toward the needle thread receiving section 216*f* by the thread hooking rod 236 comes into contact with the plate-shaped section 216*f*-2, the needle thread is pinched by the thread hooking rod 236 and the plate-shaped section 216*f*-2. In short, an axis line (a center line) of the coil spring making up the elastic section 216*f*-1 is formed in the right-left direction (the X1-X2 direction). An extension of the axis of the coil spring is formed so as to pass through a center (or its neighborhood) of the opening 216*bk* and the opening 216*dk*. Specifically, the elastic section 216*f*-1 is for forcing the thread hooking rod 236 having swiveled, substantially toward the left-side surface (in X1 direction), and at least the elastic section 216*f*-1 forces the thread hooking rod 236 having swiveled, in the sideway direction. Incidentally, since the elastic section 216*f*-1 is provided, the orientation of the plate-shaped section 216*f*-2 becomes variable. Even when the orientation of the thread hooking rod 236 has changed as a result of the thread hooking rod 236 being swiveled, the needle thread (i.e., a second needle thread portion Jb (see FIG. 20)) of the needle thread existing between the cloth and the thread take-up lever 12*a*) can be pinched by means of the thread hooking rod 236 and the plate-shaped section 216*f*-2. The needle thread receiving section 216*f* has the same structure as the needle thread receiving section 214*c* of the needle thread fixing unit 12*f* shown in FIG. 30, and the plate-shaped section 216*f*-2 has the same structure as the plate-shaped section 214*c*-2 of the plate-shaped section 214*c*-2 shown in FIG. 30.

The needle thread receiving section 216*f* is placed at a position deviating toward the cloth surface with respect to the position of insertion of the sewing thread 12*ba* (i.e., a position deviating toward X2). The thread hooking rod 236 fixes the needle thread at a position apart from the cloth surface (i.e., the upper surface of the cloth). Hence, the swayingly reciprocating mechanism section 230 (particularly, the thread hooking rod 236) and the needle thread receiving section 216*f* in the main body 210 fix a second needle thread portion, which is a portion of the needle thread located between the cloth and the thread take-up lever, at a position deviating from the position of insertion of the sewing needle toward the upper surface of the cloth as well as at a position higher than the upper surface of the cloth. More specifically, the swayingly reciprocating mechanism section 230 (particularly, the thread hooking rod support 231 and the thread hooking rod 236) and the needle thread receiving section 216*f* of the main body 210 make up "a needle thread fixing section that fixes a second needle thread portion of the needle thread situated between a cloth and the thread take-up lever at a position apart from a cloth surface and at a position deviating toward the cloth surface from a position where the sewing needle is to be inserted."

Since the needle thread receiving section 216*f* is placed at the position deviating from the position of insertion of the sewing needle 12*ba* toward the cloth surface, the needle thread comes to straddle the thread hooking rod 236 (i.e., the needle thread is folded back at the position of the thread hooking rod 236) when the sewing needle 12*ba* is inserted into the cloth while the needle thread is pressed by the thread hooking rod 236 and the needle thread receiving section 216*f*.

The opening 216*bk* and the opening 216*dk* are not limited to the circular shape, and cutouts can also be used in lieu of the opening 216*bk* and the opening 216*dk*. In short, when the cutouts are used, the opening 216*bk* is formed to the leading end of the sideway plate 216*b*, and the opening 216*dk* is formed to the leading end of the sideway plate 216*d*. Moreover, an opening is formed in the vertical plate 216*c* so as to interconnect the opening 216*bk* and the opening 216*dk*. As a consequence, a cutout extending from the sideway plate 216*bk* up to the sideway plate 216*dk* via the vertical plate 216*c* is thus formed.

The base end 218 has a sidewise-elongated rectangular vertical plate 218*a* continued upwardly from a rear-side end of the main body structure section 214 and a sideway plate 218*b* continued from an upper end of the vertical plate 218*a* to the rear side. The vertical plate 218*a* forms a right angle with respect to the main body structure section 214, and the sideway plate 218*b* forms a right angle with respect to the vertical plate 218*a*. A right-left length of the vertical plate 218*a* and a right-left length of the sideway plate 218*b* are made substantially the same, and the right-left length of the vertical plate 218*a* and the right-left length of the sideway plate 218*b* are made substantially identical with a right-left length of the main body structure section 214.

A shaft 220 is fixed at an end position on a front-side upper surface of the sideway plate 218*b* of the base end 218, and stands upright with respect to the upper surface of the sideway plate 218*b*.

The structure of the base 212 exclusive of the needle thread receiving section 216*f* makes up a needle thread fixing section main body 212-1 that supports the needle thread receiving section 216*f*.

The swayingly reciprocating mechanism section 230 has the sideway plate 232 supported by the shaft 215, a vertical plate 234 continued downward from a front-side end of the sideway plate 232, the thread hooking rod 236 fixed to the vertical plate 234, and a rotary disc 238 rotatably attached to the sideway plate 232.

The sideway plate 232 assumes a strip shape, or the shape of a strip whose upper surface assumes the shape of a combination of one short side of a rectangular shape with a semicircular shape. A width of the sideway plate 232 in the direction of its shortness is substantially identical with a shorter width of the main body structure section 214. In addition, an opening 232*k* elongated in the front-back direction is formed in the sideway plate 232. The shaft man body 215*b* of the shaft 215 is inserted into the opening 232*k*. The shaft main body 215*b* becomes slidable relatively with respect to the sideway plate 232 in a lengthwise direction of the opening 232K.

The vertical plate 234 is a rectangular plate and forms a right angle with respect to the sideway plate 232. A right-side end of the vertical plate 234 and a right-side end of the sideway plate 232 coincide with each other in the right-left direction. However, the vertical plate 234 projects in excess of the sideway plate 232 in the left-side direction, so that an left-side end of the vertical plate 234 is situated further leftward in excess of a left-side end of the sideway plate 232. A hole for insertion of the thread hooking rod 236 is formed in the vertical plate 234. The sideway plate 232 and the vertical plate 234 make up the thread hooking rod support (which can also be taken as the "swayingly reciprocating mechanism section") 231.

The thread hooking rod 236 has a columnar thread hooking rod main body 236*a* and a head 236*b* which is provided at an end of the thread hooking rod main body 236*a* and larger in diameter than the thread hooking rod main body 236*a*. The thread hooking rod 236 is fixed to the vertical plate 234 by inserting the thread hooking rod main body 236*a* into the hole of the vertical plate 234. The thread hooking rod 236 is made of; for instance, metal. A conceivable method for fixing the thread hooking rod 236 to the vertical plate 234; for instance, is to cut a screw thread in a portion of the thread hooking rod main body 236*a* facing a head 236*b*, to cut a screw thread in the hole of the vertical plate 234, and to screw-engage the thread hooking rod main body 236*a* in the vertical plate 234.

The rotary disc 238 assumes the shape of a circular plate, and an output shaft 242*a* is fixed to a center position of the rotary disc 238. The rotary disc 238 and the sideway plate 232 are connected to each other at a position apart from the output shaft 242*a* of a thread hooking rod drive motor 240 (i.e., a position eccentric from the rotation center of the rotary disc 238). Specifically, a through hole for insertion of a shaft 239 is made at a position eccentric from the rotation center of the rotary disc 238. A through hole for insertion of the shaft 239 is formed at a center of an end region in the right-left direction on the rear-side of the sideway plate 232. The rotary disc 238 and the sideway plate 232 are connected by inserting the shaft 239 into the respective through holes. Specifically, the shaft 239 has a head 239*a* which is larger in diameter than the through hole of the rotary disc 238, a shaft main body 239*b* which continually extends from the head 239*a* and is inserted into each of the through holes, and a retaining section 239*c* fixed to an end of the shaft main body 239*b* opposite to the head 239*a*.

The thread hooking rod drive motor 240 is fixed to the base 212 (specifically a sideway plate 218*b* of the base end 18). An output shaft 240*a* of the thread hooking rod drive motor 240 is perpendicular to an upper surface of the sideway plate 232, and the output shaft 240*a* is perpendicular to a pair of upper and lower planes of the rotary disc 238, so that the rotary disc 238 and the sideway plate 232 are formed in parallel with each other.

Since the presser foot 12*c* is configured as mentioned above, the rotary disc 238 rotates when the thread hooking rod drive motor 240 is driven. The rear side of the sideway plate 232 rotates as a result of rotation of the rotary disc 238. When the rear side of the sideway plate 232 rotates, the sideway plate 232 moves to and fro in a front-back direction (a second horizontal direction) while swaying in the right-left direction (a first horizontal direction) because the shaft main body 215*b* is inserted into the opening 232*k*. As a result of the sideway plate 232 moving to and fro while swaying in the right-left direction, the thread hooking rod 236 also moves to and fro in the same manner while swaying in the right-left direction, whereupon the thread hooking rod 236 swivels along a sideway surface (plane) (which can also be taken as a horizontal (or substantially horizontal) surface (plane)) (in other words, the thread hooking rod 236 swivels along a plane parallel (substantially parallel) to the cloth surface). Incidentally, the thread hooking rod 236 can also be said to swivel along a surface (plane) that is at a right angle (which can also be substantially right angels) to the direction of the second needle thread portion (which can also be a direction of ranges on both sides of the second needle thread) (the vertical direction). Thereby, a leading end 236Q of the thread hooking rod 236 swivels along a sideway direction (which can also be a "horizontal direction"), thereby forming a substantially elliptical locus when viewed from above as shown in FIG. 10. When the presser foot 12*c* is viewed from above, a locus of a point of intersection 236P between the thread hooking rod main body 236*a* and an axis 236*g* (a widthwise center line) on a front-side side portion of the vertical plate 234 forms a pattern, such as that illustrated in FIG. 10.

The swayingly reciprocating mechanism section 230 reciprocally moves in the front-back direction by the crank mechanism while swaying in the right-left direction with respect to the main body structure section 214 of the base 212. The crank mechanism can be said to be made up of the rotary disc 238, the sideway plate 232 connected to the rotary disc 238 at a position eccentric from its rotation center, and the shaft 215.

As shown in FIG. 10, the locus of the leading end 236Q of the thread hooking rod 236 is situated outside a brim of the opening 216*bk* and a brim of the opening 216*dk* when viewed from above. Specifically, the structure of the swayingly reciprocating mechanism section 230 (e.g., the length of the swayingly reciprocating mechanism section 230 in its lengthwise direction, the length of the thread hooking rod 236, a position of attachment of the thread hooking rod 236, and a length of deviation of the rotary disc 238 (a length between the center of the output shaft 240*a* and the center of the axis 239)) is set such that the locus of the leading end 236Q of the thread hooking rod 236 is situated outside of the brim of the opening 216*bk* and the brim of the opening 216*dk*. In FIG. 10, when returning from a position of 290 degree to its opposite side, the thread hooking rod 236 may not hook the needle thread.

The presser foot 12*c* is actuated up and down by an up-down actuation mechanism 250. Specifically, the up-down actuation mechanism 250 has a fixed component 252 fixed to the shaft 220, a shaft 254 fixed to the case 110, a presser foot up-down component 256 formed so as to be movable up and down along the shaft 254, and a crank rod 258. The fixed component 252 is formed similarly to the needle bar connecting stud 14*a*, and the shaft 254 is placed at a right angle to a bottom section 110-3 of the case 110 and formed in a perpendicular direction. The presser foot up-down component 256 is in engagement with the fixed component 252. A transmission mechanism (not shown) for transmitting torque of the main shaft 22 is joined to the crank rod 258. When the main shaft 22 rotates, the crank rod 258 also rotates, whereby the presser foot component 256 moves up and down along the shaft 254. Thus, the presser foot 12*c* reciprocally moves in the vertical direction.

The presser foot 12*c* moves (or can also move to and fro) between the bottom dead center (a cloth surface contact position) where a contact with the cloth surface is achieved and the top dead center (a position apart from the cloth surface) apart from the cloth surface. The presser foot 12*c* is situated at the bottom dead center in a segment of a predetermined range. A start position of a bottom dead center segment is located at an arbitrary position between a position where the frame actuator 24 has stopped and a position where the sewing needle 12*ba* is inserted into the cloth (a position of about 100 degrees in FIG. 19). An end position of the bottom dead center segment is located at an arbitrary position between a position where the sewing needle 12*ba* comes out of the cloth as a result of elevation of the sewing needle 12*ba* (a position where the sewing needle 12*ba* is released from its inserted state) and a position where the frame actuator 24 operates (a position of about 250 degrees in FIG. 19). In short, when the frame actuator 24 is in the middle of operating, the cloth cannot be pressed. Further, when the sewing needle 12*ba* is inserted into the cloth, the cloth must be pressed. Hence, the starting position of the bottom dead center segment is set as mentioned above. In addition, when the sewing needle 12*ba* is in the middle of being inserted in the cloth, the cloth must be pressed. Further, when the frame actuator 24 operates, the cloth cannot be pressed. Accordingly, the end position of the bottom dead center segment becomes as mentioned above. Incidentally, the presser foot 12*c* ascends from the end position of the bottom dead center segment, comes to the top dead center at a position of about 340 degrees, subsequently maintains the top dead center up to the position of about 10 degrees, and subsequently starts descending.

The shuttle 12*d* is placed at a position that is beneath the head 7 and lower than an upper surface of the sewing machine table. Specifically, the shuttle 12*d* is supported, below the pinhole 5*a* of the throat plate 5, by a shuttle base (not shown) disposed below the sewing machine table. A bobbin is accommodated in the shuttle 12*d*, and a bobbin thread is wound around the bobbin. The shuttle 12*d* rotates when receiving the torque of the main shaft 22 being transmitted, and a point 12*d*-1 (see FIG. 1) provided on the shuttle 12*d* hooks the needle thread. The shuttle 12*d* thereby captures and draws the needle thread, entwines the needle thread with the bobbin thread, thereby making stitches. As in the case of the existing sewing machine, the shuttle 12*d* is actuated by transmitting the torque of the main shaft 22 by way of the power transmission means, such as a cam mechanism and a belt mechanism.

The sewing frame 12*e* is a member for holding a cloth (specifically, a cloth to be embroidered) under tension and placed at an elevated position above (or an upper surface of) the sewing machine table.

The main shaft 22 is rotated by the main shaft motor 20, and torque of the main shaft 22 is transmitted by a predetermined power transmission mechanism, whereby respective machine elements, such as the thread take-up lever 12*a*, the needle bar 12*b*, and the presser foot 12*c*, and the shuttle 12*d* are actuated. The main shaft motor 20 is configured so as to rotate in one direction.

The frame actuator 24 is for moving the sewing frame 12*e* in an X-axis direction (the direction X1-X2) and a Y-axis direction (the direction Y1-Y2) in response to a command from the control circuit 90. The sewing frame 12*e* is moved in synchronization with up-down movements of the needle bar 12*b*. The frame actuator 24 is specifically made up of a servo motor for moving the sewing frame 12*e* in the X-axis direction, a servo motor for moving the sewing frame 12*e* in the Y-axis motor, and others.

The upstream grip section 40 is placed at an upstream position in the head 7; in other words, above the circular movement section 80, and has a grip section main body (upstream grip section main body) 41 and a magnet section (an upstream drive section, or an upstream magnet section) 50 provided on a rear side of the grip section main body 41.

The grip section main body 41 has a first plate-shaped section unit 42 and a second plate-shaped section (an upstream second plate-shaped section) 44 provided at the rear side of the first plate-shaped section 42*a* of the first plate-shaped section 42 and on the front side of the front section 110-1 of the case 110.

As shown in FIG. 4, the first plate-shaped section unit 42 has a first plate-shaped section (an upstream first plate-shaped section) 42*a* assuming the shape of a quadrate plate and a hooking section (attachment member) 42*b* formed so as to protrude from an upper end of the first plate-shaped section 42*a* toward the rear. The hooking section 42*b* assumes the shape of an approximately-L-shaped plate (a shape defined by bending a rectangular plate into an approximately-L-shaped fold). The first plate-shaped section unit 42 is integrally formed from a magnet-attractive material (a material to which a magnet adheres); namely, a magnetic substance (which can also be a ferromagnetic substance). Specifically, the first plate-shaped section unit 42 is made up of; for instance, metal attracted by a magnet, such as iron. In the first plate-shaped section unit 42, the first plate-shaped section 42*a* hangs (or can also dangle) from the front section 110-1 as a result of the hooking section 42*b* being hooked by a hooking hole 110*a* formed in the front section 110-1 of the case 110. The first plate-shaped section 42*a* thereby performs sliding movement in the vertical direction with respect to the front-side surface of the second plate-shaped section 44, whereby a spacing between the first plate-shaped section 42*a* and the second plate-shaped section 44 becomes variable.

The second plate-shaped section 44 is one plate-shaped member provided on the rear side of the first plate-shaped section 42*a* in the first plate-shaped section unit 42, and assumes the shape of an elongated rectangular shape. Specifically, the second plate-shaped section 44 is formed so as to become longer than the length of the first plate-shaped section 42*a* in the right-left direction and become approximately identical in length with (in a rigorous sense, slightly shorter than) the first plate-shaped section 42*a* in the up-down direction. A left end of the second plate-shaped section 44 when viewed from front is situated further leftward than a side of the left side surface of the first plate-shaped section 42*a*, and fixed to the front section 110-1 by a presser plate 46. Moreover, a right end of the second plate-shaped section 44 when viewed from front is situated further rightward than a side of the right side surface of the first plate-shaped section 42*a*, and fixed to the front section 110-1 by the presser plate 46. Namely, the second plate-shaped section 44 is present in parallel to the first plate-shaped section 42*a* at the rear of the first plate-shaped section unit 42*a*. The second plate-shaped section 44 is formed from a magnet-unattractive material (a material to which a magnet does not adhere); in other words, a non-magnetic substance; for instance, a synthetic resin film. The second plate-shaped section 44 can also be formed from aluminum or stainless steel.

An sidewise-elongated rectangular opening (a second opening) 116*a* is formed in an upper portion of the front section 110-1 of the case 110, and the second plate-shaped section 44 is provided so as to cover the opening 116*a* from the front. Specifically, the opening 116*a* is formed smaller than the second plate-shaped section 44, and the vertical height of the second plate-shaped section 44 is made larger than a leading end of the magnet section 50 in such a way that the leading end of the magnet section 50 can pass through the opening 116*a*.

The hooking hole 110*a* for hooking the hooking section 42*b* of the first plate-shaped section unit 42 is formed at a position above the opening 116*a* on the front section 110-1. The hooking hole 110*a* is formed so as to penetrate through the front section 110-1.

The magnet section 50 is made of an electromagnet, and the leading end of the magnet section 50 is situated in the opening 116*a* and formed so as to contact a rear-side surface of the second plate-shaped section 44. A leading-end surface of the magnet section 50 (a surface facing the second plate-shaped section 44) serves as an attracting surface. The magnet section 50 assumes the shape of a substantially square pole (the same also applies to a magnet section 70). Incidentally, the magnets 50, 70 have the same structure as that of an ordinary electromagnet. The magnet has a core made of a magnetic material and a coil wound around the core, and magnetic forces develop as a result of energization of the coil. One magnet section 50 is provided in the upstream grip section 40. The control circuit 90 activates the magnet section 50, whereby the first plate-shaped section 42*a* is attracted by the magnetic force. Thus, clearance between the first plate-shaped section 42*a* and the second plate-shaped section 44 becomes closed. The magnet section 50 is supported by a support 112*a* of the case 110.

Moreover, rod-shaped guide members (first guide members) 52 and 54 are provided above and below the first plate-shaped unit section 42 when viewed from front. Specifically, the guide members 52 and 54 are fixed to the front-side 110-1 of the case 110. The guide members 52 and 54 are placed such that the needle thread J diagonally passes by the rear-side of the first plate-shaped section. The guide member 52 is provided at the left side above the first plate-shaped section 42*a* when viewed from front, and the guide member 54 is provided at the right side below a lower portion of the first plate-shaped section 42*a* when viewed from front. A path for the needle thread J laid on the rear-side of the first plate-shaped section 42*a* can thereby be made longer, so that the needle thread J can be more reliably gripped between the first plate-shaped section 42*a* and the second plate-shaped section 44.

The downstream grip section 60 is placed at an approximately intermediate position on the head 7 in the up-down direction; namely, below the circular movement section 80, and has a grip section main body (a downstream grip section main body) 61 and a magnet section (a downstream drive section or a downstream magnet section) 70 provided on a rear-side of the grip section main body 61.

The grip section main body 61 has the same structure as that of the grip section main body 41; namely, has a first plate-shaped section unit 62 and a second plate-shaped section (a downstream second plate-shaped section) 64 provided at the rear side of the first plate-shaped section 62*a* of the first plate-shaped section 62 and on the front side of the front section 110-1 of the case 110.

As shown in FIG. 4, the first plate-shaped section unit 62 has a first plate-shaped section (a downstream first plate-shaped section) 62*a* assuming the shape of a quadrate plate and a hooking section (attachment member) 62*b* formed so as to protrude from an upper end of the first plate-shaped section 62*a* toward the rear. The hooking section 62*b* assumes the shape of an approximately-L-shaped plate (a shape defined by bending a rectangular plate into an approximately-L-shaped fold). The first plate-shaped section unit 62 is integrally formed from a magnet-attractive material (a material to which a magnet adheres); namely, a magnetic substance (which can also be a ferromagnetic substance). Specifically, the first plate-shaped section unit 62 is made up of; for instance, metal attracted by a magnet, such as iron. In the first plate-shaped section unit 62, the first plate-shaped section 62*a* hangs (or can also dangle) from the front section 110-1 as a result of the hooking section 62*b* being hooked by a hooking hole 110*b* formed in the front section 110-1 of the case 110. The first plate-shaped section 62*a* thereby performs sliding movement in the vertical direction with respect to the front-side surface of the second plate-shaped section 64, whereby a spacing between the first plate-shaped section 62*a* and the second plate-shaped section 64 becomes variable.

The second plate-shaped section 64 has the same structure as that of the second plate-shaped section 44, and is one plate-shaped member provided on the rear side of the first plate-shaped section 62*a* in the first plate-shaped section unit 62 and assumes the shape of an elongated rectangular shape. Specifically, the second plate-shaped section 64 is formed so as to become longer than the length of the first plate-shaped section 62*a* in the right-left direction and become approximately identical in length with (in a rigorous sense, slightly shorter than) the first plate-shaped section 62*a* in the up-down direction. A left end of the second plate-shaped section 64 when viewed from front is situated further leftward than a side of the left side surface of the first plate-shaped section 62*a*, and fixed to the front section 110-1 by a presser plate 66. Moreover, a right end of the second plate-shaped section 44 when viewed from front is situated further rightward than a side of the right side surface of the first plate-shaped section 62*a*, and fixed to the front section 110-1 by the presser plate 66. Namely, the second plate-shaped section 64 is present in parallel to the first plate-shaped section 62*a* at the rear of the first plate-shaped section 62*a* of the first plate-shaped section unit 62. The second plate-shaped section 64 is formed from a magnet-unattractive material (a material to which a magnet does not adhere); namely, a non-magnetic substance; for instance, a synthetic resin film. The second plate-shaped section 64 can also be formed from aluminum or stainless steel.

A sidewise-elongated rectangular opening (a third opening) 116*c* is formed at an approximately-center portion of the front section 110-1 of the case 110 in its vertical direction, and the second plate-shaped section 64 is provided so as to cover the opening 116*c* from the front. Specifically, the opening 116*c* is formed smaller than the second plate-shaped section 64, and the vertical width of the second plate-shaped section 64 is made larger than a leading end of the magnet section 70 in such a way that the leading end of the magnet section 70 can pass through the opening 116*c*.

The hooking hole 110*b* for hooking the hooking section 62*b* of the first plate-shaped section unit 62 is formed at a position above the opening 116*c* on the front section 110-1. The hooking hole 110*b* is formed so as to penetrate through the front section 110-1.

Like the magnet section 50, the magnet section 70 is made of an electromagnet such that the leading end of the magnet section 70 is situated in the opening 116*c* and contacts a rear-side surface of the second plate-shaped section 64. A leading-end surface of the magnet section 70 (a surface facing the second plate-shaped section 64) serves as an attracting surface. The magnet section 70 assumes the shape of a substantially square pole and is formed into (or approximately) the same size and shape as those of the magnet section 50. One magnet section 70 is placed in the downstream grip section 60. The control circuit 90 activates the magnet section 70, whereby the first plate-shaped section 62*a* is attracted by the magnetic force. Thus, clearance between the first plate-shaped section 62*a* and the second plate-shaped section 64 becomes closed. The magnet section 70 is supported by the support 112*b* of the case 110.

Moreover, rod-shaped guide members (first guide members) 72 and 74 are provided above and below the first plate-shaped unit 62 when viewed from front. Specifically, the guide members 72 and 74 are fixed to the front-side section 110-1 of the case 110. The guide members 72 and 74 are placed such that the needle thread J diagonally passes by the rear-side of the first plate-shaped section. The guide member 72 is provided at the left side above an upper portion of the first plate-shaped section 62*a* when viewed from front, and the guide member 74 is provided at the right side below a lower portion of the first plate-shaped section 62*a* when viewed from front. A path for the needle thread J laid on the rear-side of the first plate-shaped section 62*a* can thereby be made longer, so that the needle thread J can be more reliably gripped between the first plate-shaped section 62*a* and the second plate-shaped section 64.

The circular movement section 80 is placed at an approximately intermediate position in the up-down direction between the upstream grip section 40 and the downstream grip section 60. Namely, the circular movement section 80 is placed at a downstream position with respect to the upstream grip section 40 and an upstream position with respect to the downstream grip section 60 in the direction feeding the needle thread. The circular movement section 80 is for circularly moving the needle thread between the grip section main body 41 and the grip section main body 61 (which can also be called a portion (position) of the needle thread situated between the grip section main body 41 and the grip section main body 61). The circular movement section 80 has a circular movement arm 81 and a needle thread motor 86 that rotates the circular movement arm 81.

As shown in FIG. 5, the circular movement arm 81 has a rod-shaped main body section 82 and a hook 84 provided at one leading end of the main body section 82. An output shaft of the needle thread motor 86 is secured to the other end of the main body section 82. The hook 84 assumes the shape of an approximately U-shaped plate and is formed in such a way that the hook 84 can hook (or also "lock") by circular movement of the circular movement arm 81. More specifically, the hook 84 has a groove 84*a* provided in parallel with an axis of the output shaft of the needle thread motor 86. The hook 84 is arranged so as to be able to contact and retain the needle thread J laid in parallel with the axis line of the output shaft of the needle thread motor 86 as a result of the circular movement arm 81 being circularly moved upward around the output shaft (the rotation center) of the needle thread motor 86. Specifically, the circular movement arm 81 is interposed between the magnet section 50 and the magnet section 70 and arranged so as to be able to hook the needle thread. Of the needle thread, a portion hooked (or locked) and circularly moved by the circular movement arm 81 is a first needle thread portion Ja. As a result of upward circular movement of the circular movement arm 81, the needle thread becomes bent via the first needle thread portion Ja. Incidentally, an encircled drawing in FIG. 5 illustrates a structure of only the circular movement arm 81 for ease of comprehension.

The needle thread motor 86 is secured to a support 112*c* of the case 110. The axis of the output shaft of the needle thread motor 86 is oriented in the right-left direction.

A lower limit position (a position designated by 81 (B) in FIG. 3 and FIG. 4) (a second end position at an end in the second direction) achieved in the range of circular movement of the circular movement arm 81 corresponds to a state where the needle thread is in contact with the groove 84*a* of the hook 84 of the circular movement arm 81 when the needle thread is linearly supported by the pair of needle thread support members 88 in a sideway direction (in other words, when the needle thread is supported in a sideway direction by the connection members 88*c* of the pair of needle thread support members 88) [more specifically, the position where the connection members 88*c* of the pair of needle thread support members 88 receive the needle thread is at the (or approximately) same level as the position where the groove 84*a* of the hook 84 receives the needle thread, and the needle thread is in contact with the pair of needle support members 88 and the circularly movement arm 81 at the lower limit position of the circular movement arm 81, so that a portion of the needle thread located between the pair of needle thread support members 88 is straightforward in a sideway direction]. The direction of circular movement of the circular movement arm 81 achieved with respect to the lower limit position is a direction in which a position of the needle thread located between the pair of needle thread support members 88 is pulled in a perpendicular direction (or a substantially-perpendicular direction) from a state where the needle thread is supported sideways by the pair of needle thread support members 88. The upper limit position of the circular movement arm 81 (a position designated by 81(A) in FIG. 3) (a position of a first end which is an end in a first direction) is a position on the end of the range of circular movement of the circular movement arm opposite to the lower limit position.

In the direction (the first direction) in which the circular movement arm 81 ascends, a degree of flexure of the needle thread becomes greater. In a direction (a second direction) in which the circular movement arm 81 descends, the degree of flexure of the needle thread becomes smaller. In FIG. 3, a direction from 81(B) to 81(A) is a direction in which the circular movement arm 81 ascends, and a direction from 81(A) to 81(B) is a direction in which the circular movement arm 81 descends.

Alternatively, at the lower limit position in the range of circular movement of the circular movement arm 81, the position where the groove 84*a* of the hook 84 receives the needle thread can also be situated above the position where the connection members 88*c* of the pair of needle thread support members 88 receive the needle thread. At the lower limit position of the circular movement arm 81, the needle thread is in contact with the pair of needle thread support members 88 and the circular movement arm 81. A portion of the needle thread situated between the pair of needle thread support members 88 can also be made bent around a portion of the needle thread supported by the circular movement arm 81 when viewed from front.

The control circuit 90 controls circular movement of the needle thread motor 86, and the needle thread motor 86 is positionally controlled in accordance with angle-correspondence data (FIG. 18) generated on a per-step basis. Detailed explanations will be provided later.

The needle thread support members 88 are disposed on respective sides of an opening 116*b* on the front section 110-1 of the case 110. The needle thread support member 88 is for supporting the needle thread J in the right-left direction. Specifically, the pair of needle thread support members 88 are provided on both sides of the opening 116*a*, and the respective needle thread support members 88 have the same structure and formed by folding back a wire into a circular-arc. Specifically, each of the needle thread support members 88 has a shape formed by integration of: a circular-arc member 88*a* formed (or approximately) concentrically with the rotation center of the needle thread motor 86; a circular-arc member 88*b* formed at an opposite side of axis (the axis passing through the rotation center) of the output shaft of the needle thread motor 86 with respect to the circular-arc member 88*a* opposite to the axis (the axis passing through the rotation center) in approximately parallel with the circular-arc member 88*a* in a manner (or approximately) concentric with the rotation center of the needle thread motor 86; and the connection member 88*c* made by joining the circular-arc member 88*a* to the circular-arc member 88*b* at their lower end positions in a circular-arc shape. Specifically, the circular-arc member 88*a* and the circular-arc member 88*b* are formed concentrically with the rotation center of the needle thread motor 86 as viewed in side elevation. In one needle thread support member 88, the circular-arc member 88*a* and the circular-arc member 88*b* are formed along planes orthogonal to the axis (the axis passing through the rotation center) of the output shaft of the needle thread motor 86, and formed at spacing therebetween in a direction orthogonal to the axis of the output axis. The circular-arc member 88*a* and the circular-arc member 88*b* are formed at the same position in the right-left direction. Further, the pair of needle thread support members 88 are provided at spacing in the right-left direction. In addition, a portion of the circular-arc member 88*a* and a portion of the circular-arc member 88*c* are provided in the opening 116*b*, and the circular-arc member 88*b* projects in excess of a front surface of the front section 110-1 in front direction. The needle thread is thereby inserted into a position between the circular-arc member 88*a* and the circular-arc member 88*b* from above the pair of needle thread support members 88 and laid on the pair of connection members 88*c*. Thereby, the needle thread J can be interposed between the connection members 88*c* of the pair of needle thread support members 88 in the right-left direction. Even when pulled up by the circular movement arm 81, the needle thread J still stays between the circular-arc member 88*a* and the circular-arc member 88*b*. Specifically, the needle thread support member 88 supports the needle thread at the position of the opening 116*b* [in other words, the position of the opening 116*b* in the up-down direction and the right-left direction (specifically, a lower position in the opening 116*b*)] in the right-left direction. More specifically, the needle thread support member 88 supports the needle thread on the front side of the opening 116*b* (which can also be "at a position on the front side of the opening 116*b*") in the right-left direction when viewed from front. As above, the needle thread support member 88 supports, in the right-left direction, a range on both sides of the first needle thread portion, including the first needle thread portion of the needle thread. The needle thread support member 88 can also support the needle thread in the opening 116*b* (in other words, a position between the front-side surface and the rear-side surface of the front section 110-1 in the front-back direction) in the right-left direction.

A rod-shaped guide member (a first needle thread path inversion member) 100 for guiding the needle thread J delivered from above (in other words, the needle thread delivered from the upstream grip section 40) to the needle thread support members 88 is fixedly provided on the front section 110-1 of the case 110 at a position near a lower portion of the opening 116*b*. The guide member 100 guides in an inverting manner the needle thread delivered from above to the needle thread support members 88.

In accordance with data stored in the storage device 92, the control circuit 90 is a circuit for controlling operation of the respective sections as well as operation of the main shaft motor 20, the needle thread motor 86, the thread hooking rod drive motor 240, the magnet section 50, the magnet section 70, and the frame actuator 24. Specifically, the control circuit 90 generates main shaft data (see FIG. 15) from the embroidery data read from the storage device 92, controlling the main shaft motor 20 in accordance with the thus-generated main shaft data.

From the embroidery data, the control circuit 90 calculates an amount of descent of the circular movement arm in a descending segment (a first segment) of the circular movement arm and an amount of ascent of the circular movement arm in an ascending segment of the circular movement arm (a second segment), thereby generating data for circular movement arm (see FIG. 17).

In the descending segment of the circular movement arm, the amount of descent of the circular movement arm corresponds to an amount of descent for circularly moving the circular movement arm 81 downward. Specifically, the amount of descent is specified by a rotation angle of the needle thread motor 86. As to the amount of descent of the rotational arm, an amount of descent corresponding to a length expressed by Equation 1 provided below is specified.

[Mathematical Formula 1]

$$\text{Amount of descent of circular movement arm} = \left(\sqrt{a^2 + \left(\frac{b}{2}\right)^2 + c}\right) \times 2 \quad \text{Equation 1}$$

$a$: Height of thread hooking rod
$b$: Stitch length
$c$: Cloth thickness

Specifically, as shown in FIG. 21, a length between one end (an end of a position on the lower surface of the cloth) and another end (an end of another position on the lower surface of the cloth) of a stitch hooked (locked) by the thread hooking rod 236 [in other words, the length of the needle thread from one end to the other end (i.e., a length along the needle thread)] is expressed by Equation 1. In the stitch [a stitch n+1 (the n+1$^{th}$ stitch) ("n" is an integer) in FIG. 20] hooked by the thread hooking rod 236, the needle thread of the length represented by Equation 1 [a stitch reference length {a length of a stitch achieved when the needle thread is fixed to the needle thread fixing section (i.e., the needle thread length of a stitch)}] must be assured at a downstream position with respect to the circular movement arms 81. Accordingly, an amount of descent corresponding to the length represented by Equation 1 (in other words, an angle corresponding to the length) (or an angle corresponding to the stitch reference length) is specified. More specifically, a correspondence table between calculation results of Equation 1 (i.e., the needle thread lengths) and rotation angles of the needle thread motor 86 is prepared in advance. An amount of descent of the circular movement arm is calculated from a result of calculation performed according to Equation 1 and the correspondence table. In short, the control circuit 90 calculates the amount of descent of the circular movement arm on a per-stitch basis, thereby preparing the circular-movement-arm data. In Equation 1, "a" (the height of the thread hooking rod) is a heightwise (a direction perpendicular to the cloth surface) length from the upper surface of a cloth U to the thread hooking rod 236 (in a rigorous sense, the position of the upper end of the thread hooking rod 236); "b" (a stitch length) is a length of the stitch achieved along the upper surface of the cloth U; and "c" (a cloth thickness) is a thicknesswise length of the cloth U.

The amount of ascent of the circular movement arm is an amount of ascent for circularly moving the circular movement arm 81 upwardly in the ascending segment (the second segment) of the circular movement arm and, specifically, specified by the rotation angle of the needle thread motor 86. As to the amount of ascent of the circular movement arm, there is specified an amount corresponding to a value determined by subtracting a remaining length L2 of the needle thread (the remaining length of the needle thread is stored in the embroidery data) from the length of the needle thread [a length calculated by Equation 1 (the stitch reference length)] corresponding to the amount of descent of the circular movement arm. In short, a table of correspondence between values determined by subtraction and the rotation angles of the needle thread motor 86 is prepared in advance, and the amount of ascent of the circular movement arm is determined from the value determined by subtraction and the correspondence table. More specifically, the control circuit 90 calculates the amount of ascent of the circular movement arm on a per-stitch basis, preparing the data for circular movement arm.

In operation of a stitch (a second stitch) subsequent to a certain stitch (a first stitch), the circular movement arm 81 is ascent in accordance with the amount of ascent of the circular movement arm, thereby adjusting a remaining length of the needle thread for the first stitch. Accordingly, the amount of ascent of the circular movement arm in the second stitch is set to a value calculated from the remaining length of the needle thread for the first stitch. In FIG. 20, the amount of ascent of the circular movement arm for the stitch n+1 is a rotation angle corresponding to a value determined by subtracting a remaining length of the needle thread for a stitch "n" from the stitch reference length for the stitch "n" (a stitch prior to the stitch n+1). In FIG. 20, in this regard, the stitch "n" is a proximal stitch of stitches already formed in the cloth.

The amount of ascent of the circular movement arm is defined as "a rotation angle corresponding to a value determined by subtracting the remaining length of the needle thread for the stitch "n" from the length of the needle thread corresponding to the amount of descent of the circular movement arm for the stitch "n."" However, the amount of ascent of the circular movement arm can also be defined as a "rotation angle calculated by subtracting an angle corresponding to the remaining length of the needle thread for the stitch "n" from the angle corresponding to the amount of descent of the circular movement arm for the stitch "n."

The control circuit 90 generates angle correspondence data (see FIG. 18) from position data read from the storage device 92 and the prepared data for circular movement arm, controlling the position of the needle thread motor 86 in accordance with the angle correspondence data.

As the position data, there are stored a start position and an end position of the descending segment of the circular movement arm, a start position and an end position of the ascending segment of the circular movement arm, and the start position and the end position of the needle thread withdrawal segment (the third segment) of the circular movement arm. Further, as data for circular movement arm, there are stored the amount of descent of the circular movement arm and the amount of ascent of the circular movement arm on per-stitch basis. Angle correspondence data specifying correspondence between an angle of the main shaft and an angle of the needle thread motor (an angle of the needle thread motor) (a rotational position of the needle thread motor 86) are generated on a per-stitch basis.

On the occasion of generation of the angle correspondence data, the circular movement arm 81 is set to the upper limit position at an end position of a needle thread withdrawal segment. The upper limit position of the circular movement arm 81 serves as an end position in a direction of circular movement achieved when the circular movement arm 81 withdraws the needle thread from a more upstream position with respect to the circular movement arm 81.

In the descending segment of the circular movement arm 81, the angle of the needle thread motor is determined for each main shaft angle according to the start position and the end position of the descending segment and the amount of descent of the circular movement arm in such a way that the needle thread motor 86 rotates downward from the start position to the end position of the descending segment only by the amount of descent of the circular movement arm. The circular movement arm 81 thereby performs circular movement by an angle corresponding to the stitch reference length for the stitch n+1.

In the ascending segment of the circular movement arm 81, the angle of the needle thread motor is determined for each main shaft angle according to the start position and the end position of the ascending segment and the amount of ascent of the circular movement arm in such a way that the needle thread motor 86 rotates upward from the start position to the end position of the ascending segment by the amount of ascent of the circular movement arm. The circular movement arm 81 thereby ascends by an angle corresponding to a length determined by subtracting a remaining length of the needle thread, which is a length of the needle thread projecting out of the cloth surface at the stitch "n," from the stitch reference length for the stitch "n."

In the needle thread withdrawal segment of the circular movement arm 81, the angle of the needle thread motor is determined for each main shaft angle according to the start position and the end position of the needle thread withdrawal segment such that the circular movement arm 81 performs circular movement from the end position of the ascending segment of the circular movement arm 81 to the upper limit position (the position of the first end) of the circular movement arm 81.

On the occasion of generation of the angle correspondence data, a range from a main shaft angle $a_x$ corresponding to a start position of each target segment (e.g., the descending segment, the ascending segment, and the needle thread withdrawal segment) to a main shaft angle $a_y$ corresponding to the position of the end point of the target segment is equally divided by a predetermined interval (unit angle) [in other words, equally divided by 1/N (N is an integer) (equally divided by 1/integer)]. As illustrated in FIG. 25, in a segment A which is a predetermined segment subsequent to the start position (which can also be taken as a "first segment") (e.g., main shaft angles $a_x$ to $_{ax+3}$), an amount of change in angle of the needle thread motor per unit angle gradually increases, whereupon the speed of circular movement of the circular movement arm 81 also increases. In a segment B (which can also be a second segment) subsequent to the segment A (e.g., main shaft angles $a_{x+3}$ to $a_{y-3}$), the amount of change in the angle of the needle thread motor per unit angle becomes constant. In a segment C (which can also be taken as a third segment) (e.g., main shaft angles $a_{y-3}$ to $a_y$) (the end position of the segment C becomes the end position of the target segment) subsequent to the segment B, the amount of change in angle of the needle thread motor per unit angle gradually decreases, whereby the speed of circular movement of the circular movement arm 81 decreases. The angle range of the segment A and the angle range of the segment C are presumed to be shorter than the angle range of the segment B. In the above, the target segment is divided into the segment A, the segment B, and the segment C. However, the segment A can also be followed by the segment C by omitting the segment B.

On the occasion of generation of the angle correspondence data, when an interval exists between an end position of a certain segment and a start position of a subsequent segment in connection with adjacent segments among the descending segment, the ascending segment, and the needle thread withdrawal segment (in other words, when the end position of the certain segment does not coincide with the start position of the next segment), the angle of the needle thread motor achieved at the end position of the certain segment is maintained up to the start position of the next segment. For instance, in an example shown in FIG. 19, the end position of the ascending segment is at about 60 degrees, and the start position of the needle thread withdrawal segment is at about 110 degrees. Thus, an interval exists between the end position of the ascending segment and the start position of the needle thread withdrawal segment. Accordingly, the angle of the needle thread motor achieved at the end position of the ascending segment is maintained from the end position of the ascending segment to the start position of the needle thread withdrawal segment.

In accordance with the position data shown in FIG. 14, the control circuit 90 controls driving operation of the thread hooking rod drive motor 240. Specifically, when the angle of the main shaft has come to an drive start position, driving of the thread hooking rod drive motor 240 is started. When the angle of the main shaft has come to an drive end position, the driving operation of the thread hooking rod drive motor 240 is stopped. In this regard, the control circuit 90 controls the thread hooking rod drive motor 240, whereby the needle thread fixing section fixes the second needle thread portion at least when the sewing needle is inserted into the cloth and when the shuttle hooks (which can also be "captures") the needle thread.

In accordance with the position data shown in FIG. 14, the control circuit 90 controls driving operation of the magnet section 50. Specifically, when the angle of the main shaft has come to the drive start position of the magnet section (the upstream grip section), driving operation of the magnet section 50 is started. When the angle of the main shaft has come to the drive end position of the magnet section (the upstream grip section), the driving operation of the magnet section 50 ends. In a segment where the magnet section 50 is being driven, the upstream grip section 40 enters a closed state.

Moreover, in accordance with the position data shown in FIG. 14, the control circuit 90 controls driving operation of the magnet section 70. Specifically, when the angle of the main shaft has come to the drive start position of the magnet section (the downstream grip section), driving operation of the magnet section 70 starts. When the angle of the main shaft has come to the drive end position of the magnet section (the downstream grip section), the driving operation of the magnet section 70 ends. In a segment where the magnet section 70 is being driven, the downstream grip section 70 enters a closed state.

In accordance with the position data shown in FIG. 14, the control circuit 90 controls driving operation of the frame actuator 24. Specifically, when the angle of the main shaft has come to the drive start position, driving operation of the frame actuator 24 starts. When the angle of the main shaft has come to the drive end position, the driving operation of the frame actuator 24 ends.

Specifically, as shown in FIG. 11, the control circuit 90 has a CPU 90*a*, a PWM (Pulse Width Modulation) circuit 90*b*, and a current sensor 90*c*. In accordance with data from the memory device 92, the CPU 90*a* outputs to the PWM circuit 90*b* data pertaining to a current value to be fed to the motor. The PWM circuit 90*b* converts an amplitude of the current value output from the CPU 90*a* into a pulse signal having a constant amplitude and feeds the pulse signal to the main shaft motor 20 and the needle thread motor 86. The current sensor 90*c* converts a pulse signal output from the PWM circuit 90*b* into a current value, multiplies the current value by a constant to calculate a torque value, and outputs the torque value to the CPU 90*a*.

More specifically, in addition to generating the angle correspondence data used for controlling the needle thread motor 86 in accordance with the embroidery data read from the memory device 92, the control circuit 90 performs control, such as that represented by the timing chart shown in FIG. 19 and flowcharts shown in FIGS. 22 to 24. Detailed operations will be provided later. FIG. 19 shows example operation for one stitch performed in a control segment. A control segment for one stitch is a segment corresponding to one rotation of the main shaft 22. A horizontal axis in FIG. 19 corresponds to an angle of the main shaft motor 20 (a rotational position of the main shaft motor 20).

An encoder 21 for detecting an angle of the main shaft motor 20 (the rotational position of the main shaft motor 20) is interposed between the main shaft motor 20 and the control circuit 90. An encoder 87 (see FIG. 1) for detecting an angle of the needle thread motor 86 (a rotational position of the needle thread motor 86) is interposed between the needle thread motor 86 and the control circuit 90. The control circuit 90 detects angles of the respective motors (the rotational positions of the respective motors) from information output from the respective encoders.

As shown in FIG. 12, the storage device 92 stores embroidery data 92*a* and position data 92*b*. Specifically, the storage device 92 is a storage section for storing the data.

As shown in FIG. 13, the embroidery data 92*a* include, for each stitch, data pertaining to a stitch length (i.e., the length of a stitch width) (which can also be called a stitch width), data pertaining to a stitching direction (i.e., a value representing a stitching direction), and data pertaining to a remaining length of the needle thread (which can also be called a "remaining height of a needle thread"). The embroidery data 92*a* are input from the outside by way of an input/output device 94, and are stored in the storage device 92.

The stitch length used herein refers to a length "b", on an upper surface of the cloth, from one position m1 where the needle thread is inserted into the cloth (a position where the needle thread and the upper surface of the cloth cross) to another position m2 where the needle thread is to be inserted into the cloth (see FIG. 21). Specifically, the stitch length becomes a straight distance from the insertion position m1 to the insertion position m2.

The stitching direction is data pertaining to an angle value corresponding to a predetermined direction (e.g., one direction in the horizontal direction). For instance, in an example shown in FIG. 26, when the predetermined direction is taken as HK, the angle value of a stitch ST0 is taken as a value of an angle $\alpha 4$, and an angle value of a stitch ST1 is taken as a value of an angle $\alpha 1$. The value of the angle $\alpha 1$ is a positive value because the angle is oriented upward with reference to the direction HK. The value of the angle $\alpha 4$ is a negative value because the angle is oriented downward with respect to the direction HK.

The remaining length of the needle thread is a length L2 that extends along the needle thread from the one insertion position m1 to the other insertion position m2 (see FIG. 20). Specifically, the remaining length of the needle thread is a length of the needle thread of the stitch located above the upper surface of the cloth (i.e., the length of the needle thread projecting out of the cloth surface); namely, the length of the needle thread in the stitching forming hollow embroidery.

The position data 92*b* include, as information about angles of the main shaft (namely, information about the rotational position of the main shaft motor 20), drive start positions and drive end positions of the thread hooking rod drive motor 240, the magnet section 50, the magnet section 70, and the frame actuator 24. Further, as to the circular movement arm 81, the position data 92*b* include, as information about angles of the main shaft (i.e., information about the rotational positions of the main shaft motor 20), the start position and the end position of the circular movement arm descending segment (the first segment), the start position and the end position of the circular movement arm ascending segment (the second segment), and the start position and the end position of the needle thread withdrawal segment (a third segment).

The drive start position and the drive end position of the thread hooking rod drive motor 240 are set within an area from a point of the bottom dead center of the shuttle (can also be called the "point of the bottom dead center of the thread take-up lever) (about 290 degrees in FIG. 19) to a needle bar insertion position (about 110 degrees in FIG. 19). The drive end position is provided behind the drive start position (in this regard, a position behind 360 degrees is a position achieved after a return to zero degree is once made). In an example shown in FIG. 19, the drive start position of the thread hooking rod drive motor 240 corresponds to a position of the point of the bottom dead center of the shuttle (about 290 degrees), and the drive end position corresponds to a position of about 90 degrees.

The drive start position of the magnet section 50 is set to an arbitrary position [a position (about 190 degrees) immediately subsequent to the end position of the thread withdrawal segment in FIG. 19] in an area from the end position (about 190 degrees in FIG. 19) of the thread withdrawal segment of the circular movement arm to a position (about 200 degrees in FIG. 19) where the shuttle hooks (or captures) the needle thread. The drive end position of the magnet section 50 is set to an arbitrary position (about 100 degrees in FIG. 19) in an area from the end position (about 60 degrees in FIG. 19) in the circular movement arm ascending segment to a start position (about 110 degrees in FIG. 19) of the thread withdrawal segment of the circular movement arm 81.

Further, the drive start position of the magnet section 70 is set to an arbitrary position (a position of about 90 degrees in FIG. 19) in an area from the end position of the ascending segment of the circular movement arm 81 to a drive end position (in other words, a position where switching takes place from a closed state to an open state of the upstream grip section 40) (about 100 degrees in FIG. 19) of the magnet section 50. A drive end position of the magnet section 70 is set to an arbitrary position (about 200 degrees in FIG. 19) in an area from a drive start position of the magnet section 50 (in other words, a position where switching takes place from the open state to the closed state of the upstream grip section 40) to a position (about 200 degrees in FIG. 19) where the shuttle hooks (or captures) the needle thread.

A drive start position and a drive end position of the frame actuator 24 are set in a segment where the sewing needle stays uninserted into the cloth. Specifically, the drive segment of the frame actuator 24 is set in a segment where the sewing needle is not inserted into the cloth. In FIG. 19, the drive start position is set immediately after (about 260 degrees) a position where the needle bar has come out of the cloth), and the drive end position is set immediately before (about 100 degrees) a position where the needle bar is inserted into the cloth.

The start position and the end position of the circular movement arm achieved in the descending segment are set to arbitrary positions in an area from the top dead center of the shuttle (or the bottom dead center of the needle bar) to the bottom dead center of the thread take-up lever (or a position immediately after the bottom dead center of the thread take-up lever) [in other words, the descending segment is at least a portion of the segment from the top dead center of the shuttle (or the bottom dead center of the needle bar) to the bottom dead center of the thread take-up lever (or a position immediately after the bottom dead center of the thread take-up lever)]. Specifically, the circular movement arm is lowered in accordance with withdrawal of the needle thread performed by the shuttle 12*d* (more specifically, the point 12*d*-1 of the shuttle 12*d*), so that the area between the top dead center of the shuttle and the bottom dead center of the shuttle is taken as the descending segment. In FIG. 19, the start position is set to the position of the top dead center of the shuttle (about 190 degrees), and the end position is set to the position of the bottom dead center of the thread take-up lever (about 300 degrees). In FIG. 19, the bottom dead center of the shuttle is about 290 degrees.

The start position and the end position of the circular movement arm achieved in the ascending segment are set to arbitrary positions in an area from the bottom dead center of the thread take-up lever to the top dead center of the thread take-up lever (or a position immediately after the top dead center of the thread take-up lever) (in other words, the ascending segment is at least a portion of the area from the bottom dead center of the thread take-up lever to the top dead center of the thread take-up lever). Specifically, a remaining length of the needle thread is determined by elevating the circular movement arm in synchronism with pulling-up of the needle thread performed by the thread take-up lever. Accordingly, the ascending segment is an arbitrary area from the bottom dead center of the thread take-up lever to the top dead center of the thread take-up lever (or a position immediately after the top dead center of the thread take-up lever). In FIG. 19, the start position is set to the position of the bottom dead center of the thread take-up lever (about 300 degrees), and the end position is set to the position of the top dead center of the thread take-up lever (about 60 degrees). In other words, in the example shown in FIG. 19, the end position of the descending segment coincides with the start position of the ascending segment.

The start position and the end position in the needle thread take-up segment of the circular movement arm are set to any positions in an overlap between a segment from the end position of the ascending segment of the circular movement arm to the position where the shuttle hooks (or captures) the needle thread and another segment from the drive end position of the magnet section 50 to the drive start position of the magnet section 50 (in other words, the needle thread withdrawal segment is at least an area from the end position of the ascending segment to the position where the shuttle hooks the needle thread). Specifically, in order to withdraw the needle thread from an upstream position with respect to the magnet section 50, the end position must be set to, at least, a position in front of the position where the shuttle hooks the needle thread. Further, since the upstream grip section 40 must be in an open state, the start position is set to a position subsequent to the position where the magnet section 50 is released from an activated state, and the end position is set to a position in front of the drive start position of the magnet section 50. In FIG. 19, the start position is set to a position to a position immediately behind (about 110 degrees) the drive end position of the magnet section 50, and the end position is set immediately before (the position of the bottom dead center of the needle bar) (about 180 degrees) the drive end position of the magnet section 50. The end position is set to a position behind the start position in the descending segment, the ascending segment, and the needle thread withdrawal segment of the circular movement arm.

A start point of one stitch in the embroidery data 92*a* shown in FIG. 13, the data for circular movement arm shown in FIG. 17, and the angle correspondence data shown in FIG. 18 can also be set to any position on a timing chart shown in FIG. 19. At the end position of the needle thread withdrawal segment and the start position of the descending segment of the circular movement arm 81 (moreover, an area between the end position of the needle thread withdrawal segment and the start position of the descending segment when an interval exists between the end position of the needle thread withdrawal segment and the start position of the descending segment), the circular movement arm 81 is situated at the upper limit position. Hence, it can be said to be preferable that the end position of the needle thread withdrawal segment or the start position of the descending segment be set as a start point of one stitch.

The case 110 makes up a housing of the sewing machine 5 (specifically, the head 7) and is secured to the frame 120.

The case 110 has the front section 110-1, an upper section 110-2, the bottom section 110-3, side sections 110-4, 110-5, a rear section 110-6, the supports 112*a* and 112*b* continued from the front section 110-1 and the side sections 110-4 and 110-5, and the support 112*c* continued from the side sections 110-4 and 110-5.

The needle thread guide 104 is attached to an upper end region (a region above the guide member 52) on the front surface of the front section 110-1, and guides the needle thread in an insertable manner. The needle thread guide 106 is attached to the lower end region on the front surface of the front section 110-1, and guides the needle thread in an insertable manner.

The main shaft motor 20, the encoder 21, and the main shaft 22 can also be provided outside the case 110 making up the head 7.

When the path of the needle thread is explained, the needle thread J led from a wound yarn (not shown) contacts the guide member 52 from the needle thread guide 104, passing through a spacing between the first plate-shaped section 42 and the second plate-shaped section 44 of the upstream grip section 40. Subsequently, the needle thread J contacts the guide member 54, subsequently undergoes inversion in the guide member 100, and reaches the needle thread support members 88. The needle thread J passed through the pair of needle thread support members 88 contacts the guide member 72, passes through a spacing between the first plate-shaped section unit 62 and the second plate-shaped section unit 64 of the downstream grip section 60. Then, the needle thread contacts the guide member 74, and reaches the thread take-up lever 12*a* via the tension spring 102, and further reaches the sewing needle 12*ba* of the needle bar 12*b* from the thread take-up lever 12*a* via the needle thread guide 106. Further, the needle thread reaches an interior of the opening 216*bk* and an interior of the opening 216*dk* of the leading-end structure section 216 of the presser foot 12*c*. The needle thread travels from the upstream to the downstream in sequence mentioned above.

Operation of the sewing machine 5 is now described. First, the control circuit 90 generates main shaft data (see FIG. 15) for each stitch in accordance with the embroidery data stored in the storage device 92. Since the storage device 92 stores, for each stitch, information about a stitch length and a stitching direction in relation to embroidery to be created, main shaft data are generated according to the stitch length and the stitching direction for each stitch. As shown in FIG. 15, the main shaft data are data pertaining to a main shaft angle (i.e., the rotational position of the main shaft motor 20) achieved every unit time in a chronological order.

For instance, when the stitch length is large, an amount of change in main shaft angle is decreased. On the contrary, when the stitch length is short, the amount of change in main shaft angle is increased. Moreover, when the stitching direction becomes opposite to the stitching direction employed last time, the amount of change in main shaft angle is decreased. Namely, when an angle between the stitching direction and the preceding stitching direction (an angle α3 in FIG. 26) is small, the amount of change in main spindle angle is decreased. In contrast, when the angle between the stitching direction and the preceding stitching direction is large, the amount of change in main spindle angle is increased.

When the control circuit 90 generates the main shaft data, an entirety of embroidery data made up of a plurality of stitches can also be generated in advance. Alternatively, actual embroidering can also be performed while the main shaft data are being generated, by means of generating main shaft data pertaining to a stitch located several stitches ahead of a stitch which will be actually embroidered by the respective machine elements (the needle bar, the thread take-up lever, the shuttle, and the like).

FIG. 16 shows an example of main shaft data. The main shaft data shown in FIG. 16 pertain to a case where the main shaft keeps rotating with constant velocity. However, when the respective stitches have a constant stitch length and when angles of the stitches are also oriented in the same direction, the only requirement is to adopt such main shaft data. Incidentally, when a certain stitch has a longer stitch length, a time consumed to make one stitch is made longer. By contrast, when a certain stitch has a shorter stitch length, the time for one stitch is made shorter.

In accordance with the embroidery, the control circuit 90 calculates, from the embroidery data, the amount of descendent of the circular movement arm in the descending segment of the circular movement arm and the amount of ascent of the circular movement arm in the ascending segment of the circular movement arm, thereby generating the data for circular movement arm (see FIG. 17). On the occasion of generation of the data for circular movement arm, an entirety of embroidery data made up of a plurality of stitches are generated in advance. Alternatively, actual embroidering can also be performed while the data for circular movement arm are being generated, by means of generating data for circular movement arm pertaining to a stitch located several stitches ahead of a stitch which will be actually embroidered by the respective machine elements (the needle bar, the thread take-up lever, the shuttle, and the like).

In accordance with the position data read from the storage device 92 and the generated data for circular movement arm, the control circuit 90 generates angle correspondence data (see FIG. 18). On the occasion of generation of the angle correspondence data, an entirety of embroidery data made up of a plurality of stitches is generated in advance. Alternatively, actual embroidering can also be performed while the angle correspondence data are being generated, by means of generating angle correspondence data pertaining to a stitch located several stitches ahead of a stitch which will be actually embroidered by the respective machine elements (the needle bar, the thread take-up lever, the shuttle, and the like).

Actual embroidery operation is now described. As shown in FIG. 22, the main shaft angle is first detected (S1). Specifically, a main shaft angle is detected on the basis of information from the encoder 21 connected to the main shaft motor 20. The main shaft angle is detected at a predetermined cycle (in other words, processing shown in FIG. 22 is carried out at a predetermined cycle); for instance, a cycle of one-tenths to one-thousandths of a cycle for one stitch.

In accordance with the detected main shaft angle (S1), it is determined whether or not the thread hooking rod drive motor 240, the magnet section 50, the magnet section 70, the frame actuator 24, and the needle thread motor 86 are in the drive segment (S2). When they are in the drive segment, driving is performed (S3). When they are not in the drive segment, driving is stopped (S4). As to the thread hooking rod drive motor 240, the drive segment corresponds to a segment from the drive start position to a point immediately before the drive end position (the drive end position belongs to the stop segment rather than the drive segment). As to the magnet section 50, the drive segment corresponds to a segment from the drive start position to a point immediately before the drive end position (the drive end position belongs to the stop segment rather than the drive segment). As to the magnet section 70, the drive segment corresponds to a segment from the drive start position to a point immediately before the drive end position (the drive end position belongs to the stop segment rather than the drive segment). As to the circular movement arm 81, the drive segment corresponds to a segment from the start position of the descending segment to a point immediately before the end position of the descending segment (the end position belongs to the stop segment rather than the drive segment); a segment from the start position of the ascending segment to a point immediately before the end position of the ascending segment (the end position belongs to the stop segment rather than the drive segment); and a segment from the start position of the needle thread withdrawal segment to a point immediately before the end position of the needle thread withdrawal segment (the end position belongs to the stop segment rather than the drive segment).

The thread hooking rod drive motor 240 starts driving at the drive start position (about 290 degrees in FIG. 19) and stops driving at the drive end position (about 90 degrees in FIG. 19). In connection with actual movement of the thread hooking rod 236, the thread hooking rod 236 is situated at a position in FIG. 10(*b*) in the stop segment of the thread hooking rod drive motor 240 from about 90 degrees to about 290 degrees; in other words, in a state where the thread hooking rod 236 stays standstill. The thread hooking rod 236 stays fixed at this position while the needle thread is pinched between the thread hooking rod 236 and the plate-shaped section 216*f*-2. Moreover, the thread hooking rod drive motor 240 is driven in an area from the position of about 290 degrees to the position of about 90 degrees. The leading end 236Q of the thread hooking rod 236 rotates in a direction designated by w1 in FIG. 10, and the point of intersection 236P rotates in a direction designated by w2 in FIG. 10. At the position of about 70 degrees, the thread hooking rod 236 is situated at a position in FIG. 10(*a*), thus coming into contact with the needle thread. Specifically, the thread hooking rod drive motor 240 switches between a fixed state (the stopped state of the thread hooking rod drive motor 240 from the position of about 90 degrees to the position of 290 degrees) where the needle thread fixing section fixes the needle thread and a released state (the driving state of the thread hooking rod drive motor 240 from the position of about 290 degrees to the position of about 90 degrees) where the needle thread fixed state by the needle thread fixing section is released.

Operation for one stitch is explained by reference to FIG. 19 and FIG. 20. When the circular movement arm 81 starts descending from the start position (about 190 degrees) of the descending segment of the circular movement arm 81, the shuttle 21*d* reaches the top dead center, thus hooking and withdrawing the needle thread. Accordingly, the needle thread at the position of the circular movement arm 81 is also lowered. The circular movement arm 81 descends by an amount of the descent of the circular movement arm in the data for circular movement arm (an amount of descent of the circular movement arm for stitch n+1 in FIG. 20), and the circular movement arm 81 stops descending at the end position of the descending segment. The needle thread at the position of the circular movement arm 81 thereupon becomes hooked by the hook 84. The needle thread having a length required for the stitch n+1 is prepared between the cloth and the circular movement arm 81.

In the segment where the shuttle 12*d* withdraws the needle thread [from the top dead center of the shuttle (about 190 degrees) to the bottom dead center of the shuttle (about 290 degrees)], the thread hooking rod 236 stays standstill at the position in FIG. 10(*b*), fixing the needle thread along with the needle thread receiving section 216*f*. Hence, there is no potential risk of the shuttle withdrawing the needle thread from the stitch (the stitch "n" in FIG. 20) fixed by the thread hooking rod 236.

In the descending segment of the circular movement arm 81, the magnet section 50 is activated, and the upstream grip section 40 stays closed. Hence, even if the shuttle 12*d* withdraws the needle thread, the needle thread will not be withdrawn from an upstream position with respect to the upstream grip section 40. FIG. 20(*a*) can also be said to be a drawing showing that the shuttle 12*d* hooked the needle thread in the descending segment of the circular movement arm 81 (for instance, a state achieved at the position of about 230 degrees). At a position of about 245 degrees, the sewing needle 12*ba* from its inserted state where the sewing needle 12*ba* is inserted in the cloth U (the processed cloth to be embroidered) is released, and the presser foot 12*c* starts ascending at a position of about 250 degrees. Incidentally, the shuttle 12*d* performs circular movement, withdraws the needle thread J, entwines the needle thread J with the bobbin thread G, thereby creating a stitch.

Subsequently, the thread hooking rod 236 starts rotating at a position of about 290 degrees, whereby the thread hooking rod 236 departs from the fixed stitch (the stitch "n" in FIG. 20). The circular movement arm 81 starts ascending at a position of about 300 degrees. The circular movement arm. 81 ascends by an amount of the ascent of the circular movement arm in the circular movement data (the amount of ascent of the circular movement arm for the stitch n+1 in FIG. 20). As mentioned above, the amount of ascent of the circular movement arm for the stitch n+1 is a rotational angle corresponding to a value that is determined by subtracting the remaining length of the needle thread for the stitch "n" from the length of the needle thread corresponding to the amount of descent of the circular movement arm for the stitch "n."

Thereupon, the thread take-up lever 12*a* also ascends in the ascending segment of the circular movement arm 81. When the thread take-up lever 12*a* ascends, the remaining length of the needle thread for one preceding stitch (the stitch "n" in FIG. 20) becomes shorter by an amount corresponding to the ascent of the circular movement arm 81.

FIG. 20(*b*) is a drawing showing the position of about 300 degrees at which the circular movement arm 81 starts ascending. FIG. 20(*c*) shows that the remaining length of the stitch "n" becomes short as a result of ascending of the circular movement arm 81 and the thread take-up lever 12*a*. When the amount of ascent of the circular movement lever is zero, the circular movement arm 81 does not ascend for the stitch. Even when the thread take-up lever 12*a* ascends, the remaining length of the needle thread for the stitch "n" does not become shorter.

Subsequently, the thread hooking rod 236 contacts the needle thread at a position of about 70 degrees, and the thread hooking rod 236 presses the needle thread (i.e., the second needle thread portion Jb) against the plate-shaped section 216*f* at the position of about 90 degrees, thereby fixing the needle thread while the needle thread is pinched between the thread hooking rod 236 and the plate-shaped section 216*f*-2.

Thereafter, the presser foot 12*c* reaches the bottom dead center at a position of about 100 degrees, contacting the cloth U. The sewing needle of the needle bar 12*b* is then inserted into the cloth U at a position of about 110 degrees. The stitch (the stitch n+1 in FIG. 20) formed as a result of insertion of the needle is hooked (which can also be referred to as "locked") by the needle thread bar 236, so that the needle thread of the stitch straddles the thread hooking rod 236. Specifically, the needle thread is folded back at the position of the thread hooking rod 236. FIG. 20(*d*) can also be said to show a state of the position (about the position of about 100 degrees) immediately before the needle is inserted while the needle thread straddles the thread hooking rod 236. As above, since the needle thread is fixed to the needle thread receiving section 216*f* by the thread hooking rod 236, the needle thread can straddle the sewing needle 12*ba* when the sewing needle 12*ba* is inserted into the cloth U. In addition, even when the sewing needle 12*ba* is inserted into the cloth U, the needle thread will not be pulled out of the stitch "n." More specifically, the remaining length of the needle thread for the stitch "n" will not become shorter.

Subsequently, the circular movement arm 81 ascends from the start position of the needle thread withdrawal segment to the end position of the same, thereby withdrawing the needle thread from an upstream position with respect to the upstream grip section 40. Specifically, the needle thread is withdrawn from the wound yarn (not shown) provided at an upstream position with respect to the needle thread guide 104. On this occasion, the upstream grip section 40 is open, and the downstream grip section 60 is closed. As a result of ascending of the circular movement arm 81, the needle thread is withdrawn from an upstream position with respect to the upstream grip section 40. FIG. 20(*e*) shows that the needle thread is withdrawn from the upstream position with respect to the upstream grip section 40 in the needle thread withdrawal segment of the circular movement arm 81.

Even when the amount of ascent of the circular movement arm 81 (an angle of ascending circular movement) in the ascending segment is small; and even when the length of the upstream needle thread (in other words, the length between the position m3 and the first plate-shaped section unit 42) at an upstream position with respect to a proximal insertion position where the needle thread is inserted into the cloth (a proximal position where the needle thread contacts the cloth) (the position m3 in FIG. 20(*c*)) is short, on account of the needle thread being withdrawn from the upstream position with respect to the upstream grip section 40 in the needle thread withdrawal segment, the amount of ascent of the circular movement arm 81 in the needle thread withdrawal segment becomes greater correspondingly. Hence, the needle thread can be fully withdrawn from the upstream position with respect to the upstream grip section 40, and therefore the needle thread for subsequent stitches will not become deficient.

For instance, in FIG. 19, even when the amount of ascent of the circular movement arm 81 in the ascending segment is small (in other words, the remaining length of the needle thread for the stitch "n" is long), the amount of ascent of the circular movement arm 81 achieved in the needle thread withdrawal segment becomes greater correspondingly, so that the needle thread can be withdrawn from the upstream position with respect to the upstream grip section 40. Hence, the length of the needle thread for the stitch next to the stitch n+1 can be assured. Incidentally, it can be said that the length of the needle thread that can be withdrawn from the upstream position with respect to the upstream grip section 40 as a result of the circular movement arm 81 being circularly moved from the lower limit position to the upper limit position (in other words, circular movement over the range of circular movement) need to be at least a length obtained by adding a length, which is twice as large as the thickness of the cloth, to the length of the needle thread achieved at the maximum stitch length and the maximum remaining length of the needle thread.

When the amount of ascent of the circular movement arm 81 is large in the ascending segment of the circular movement arm 81, the amount of ascent of the circular movement arm 81 in the needle thread withdrawal segment is correspondingly small. However, in the ascending segment, the needle thread is withdrawn from the upstream position with respect to the proximal insertion position where the needle thread is to be inserted into the cloth. Hence, as a result of the circular movement arm 81 being circularly moved up to the upper limit position in the needle thread withdrawal segment, there can resultantly be assured a length which will be obtained when the circular movement arm 81 performs circular movement over the range of circular movement. Hence, the needle thread for subsequent stitches will not become deficient.

For instance, in FIG. 19, when the amount of ascent of the circular movement arm 81 in the ascending segment is large (in other words, the remaining length of the needle thread for the stitch "n" is short), the amount of ascent of the circular movement arm 81 in the needle thread withdrawal segment becomes smaller correspondingly. However, in the ascending segment, the needle thread is withdrawn to the upstream position with respect to the proximal insertion position m3 where the needle thread is to be inserted into the cloth, so that the length of the needle thread for the stitch next to the stitch n+1 can be assured.

After the end position (about 180 degrees) of the needle thread withdrawal segment of the circular movement arm 81 is achieved, the start position (about 190 degrees) of the descending segment of the circular movement arm 81 is then achieved. Subsequently, the above operations are repeated on a per-stitch basis. FIG. 20(*f*) shows a state of the end position (the position of about 180 degrees) of the needle thread withdrawal segment. As above, three-dimensional embroidery can be performed.

In FIG. 20 and FIG. 21, when an extension of the needle thread J is plotted in a rectangular shape denoting the first plate-shaped section units 42 and 62, it shows that the corresponding grip is open. In contrast, when the extension of the needle thread J is not plotted in the rectangular shapes, it shows that the corresponding grip is closed.

FIG. 19 shows operation of the respective sections corresponding to the main shaft angles. However, since the main shaft 22 rotates in one direction, the respective sections operate as shown in FIG. 19 even in time sequence. Specifically, even when there occurs a change in time equivalent to one stitch, the sequence of operation of the respective sections remains unchanged. Accordingly, the horizontal axis shown in FIG. 19 (the horizontal axis representing the main spindle angle) can also be grasped as a time axis. Respective positions on the horizontal axis can also be grasped as time positions. In addition, the segments, such as the descending segment, the ascending segment, and the needle thread withdrawal segment, can also be taken as time segments. The "descending segment (the first segment)" can also be taken as a "descending period (a first period)." The ascending segment (the second segment)" can also be taken as an "ascending period (a second period)." The "needle thread withdrawal segment (the third segment)" can also be taken as a "needle thread withdrawal period (a third period)."

Control of the needle thread motor 86 is performed as follows. Specifically, data pertaining to angles of the needle thread motor are read from the angle correspondence data (S11 in FIG. 23). More specifically, a main shaft angle closest to the main shaft angel detected in step S1 is read from the angle correspondence data (FIG. 18), and the angle of the needle thread motor corresponding to the main shaft angle is read. When data pertaining to two main shaft angles adjacent to the main shaft angle detected in step S1 are in the angle correspondence data, the angle of the needle thread motor can also be calculated according to a ratio of the two main spindle angles to the detected main spindle angle.

Next, an amount of change per unit time is detected on the basis of the thus-read angle of the needle thread motor, thereby calculating speed data (S12 in FIG. 23: a speed data calculation step). In short, the speed data are calculated by dividing the amount of change in angle data by a time. Specifically, a relationship between the main shaft angle and the angle of the needle thread motor is specified by the angle correspondence data show in FIG. 18, and the relationship between a time and the main shaft angle is specified by the main shaft data shown in FIG. 15. The amount of change in angle of the needle thread motor per unit time is thereby detected. Specifically, the speed data are calculated by differentiating the angle data. In this respect, when no match exists between the main shaft angle data of the main shaft data and the main shaft angle data of the angle correspondence data, the essential requirement is to calculate a time from; for instance, a ratio of difference between the main spindle angle of the main spindle data and two main shaft angles (the main shaft angles of the main shaft data) adjacent to the main shaft angle in the angle correspondence data.

Subsequently, the amount of change in speed data per unit time is detected, thereby calculating torque data (S13 in FIG. 23: a torque data calculation step). Namely, the torque data are calculated by dividing the amount of change in speed data by a time. Specifically, in step S12, the speed data pertaining to the needle thread motor are calculated on a per-time basis, and hence the torque data are calculated by differentiating the speed data. In this regard, the CPU 90*a* previously holds the speed data required to calculate the amount of change in speed.

Torque compensation data are calculated from the torque data calculated in step S13 (S14 shown in FIG. 23). Specifically, torque data are multiplied by an inertia ratio, and torque derived from a mechanical loss is added to a value which is determined by multiplying the torque data by the inertial ratio, thereby calculating the torque compensation data. The inertia ratio is a constant previously determined according to a mass of each of the machine elements, and others. Further, the torque derived from the mechanical loss is a value previously determined in correspondence with each of the machine elements.

Data (a count value of the encoder) output from the encoder 87 (the encoder corresponding to the needle thread motor 86) are subtracted from the angle data read in step S11 (S15 shown in FIG. 24: a location deviation calculation step). A value calculated in step S15 can be said to be a value of location deviation.

The value calculated in step S15 is now multiplied by a predetermined constant, thereby calculating a speed value (S16 in FIG. 24).

A current motor speed value is calculated by differentiating the output from the encoder 87 (S17 in FIG. 24). Specifically, an amount of change in encoder count value per unit time is calculated, thereby calculating a current motor speed value.

Next, the current motor speed value calculated in step S17 is subtracted from the speed value calculated in step S17, and the speed data calculated in step S12 are added to a subtraction result (S18 in FIG. 24: a speed deviation calculation step). A value calculated in step S18 can be said to be a value of speed deviation.

The value calculated in step S18 is multiplied by a predetermined constant, thereby calculating a torque value (S19 shown in FIG. 24).

The torque compensation data calculated in step S14 are added to the torque value calculated in step S19 (S20 in FIG. 24). Subsequently, the torque value from the current sensor 90*c* is subtracted from the value calculated in step S20 (S21 in FIG. 24: a torque deviation calculation step). The value calculated in step S21 can be said to be a value of torque deviation.

The value calculated in step S21 is multiplied by a predetermined constant, thereby calculating a voltage value to be output to the PWM circuit 90*b* (a voltage command to the PWM circuit) (S22 in FIG. 24). The voltage value is output to the PWM circuit 90*b* (S23 in FIG. 24).

The PWM circuit 90*b* outputs a pulse signal as a voltage signal in accordance with an input signal, thereby supplying an electric current to the needle thread motor 86 (S24 shown in FIG. 24: a current supply step).

As above, processing provided in the flowchart shown in FIG. 22 to FIG. 24 is carried out at a predetermined cycle, thereby controlling the needle thread motor 86.

A method for controlling the main shaft motor 20 is implemented in the same way as position control of the needle thread motor 86.

First, angle data (which can also be position data) are read from the main shaft data (S11 in FIG. 23: a read step). Specifically, an angle (a main shaft angle) corresponding to a time which will be an object of processing is detected from the main shaft data, and data pertaining to the angle is read. Step S11 in FIG. 23 is identical with step S1 in FIG. 22.

Speed data are calculated by detecting an amount of change in the detected main shaft angle per unit time (S12 in FIG. 23: a speed data calculation step). On the occasion of calculation of the speed data, the speed data are calculated by dividing the amount of change in angle data by a time. Specifically, the speed data are calculated by differentiating the angle data.

The torque data are calculated by detecting the amount of change in speed data per unit time (S13 in FIG. 23: a torque data calculation step). The torque compensation data are calculated from the torque data calculated in step S13 (S14 in FIG. 23). The data from the encoder 21 (a count value of the encoder) are subtracted from the angle data read in step S11 (S15 in FIG. 24: a position deviation calculation step. A value calculated in step S15 can be said to be a value of position deviation). The value calculated in step S15 is multiplied by a predetermined constant, thereby calculating a speed value (S16 in FIG. 24). The output from the encoder 21 is differentiated, thereby calculating the current motor speed value (S17 in FIG. 24: namely, an amount of change in count value of the encoder per unit time is calculated, thereby calculating the current motor speed value). The current motor speed value calculated in step S17 is subtracted from the speed value calculated in step S16. The speed data calculated in step S12 are added to a subtraction result (S18 in FIG. 24: a speed deviation calculation step, the value calculated in step S18 can be said to be a value of speed deviation). The value calculated in step S18 is multiplied by a predetermined constant, thereby calculating a torque value (S19 in FIG. 24). A torque value from the current sensor 90*c* is subtracted from the torque value calculated in step S19, and the torque compensation data calculated in step S14 are added to a subtraction result (S20 in FIG. 24). Subsequently, the torque value from the current sensor 90*c* is subtracted from the value calculated in step S20 (S21 in FIG. 24: a torque deviation calculation step, the value calculated in step S21 can be said to be a value of torque deviation). The value calculated in step S21 is multiplied by a predetermined constant, thereby calculating a voltage value to be output to the PWM circuit 90*b* (a voltage command to the PWM circuit) (S22 in FIG. 24), and the voltage value is output to the PWM circuit 90*b* (S23 in FIG. 24). The PWM circuit 90*b* outputs a pulse signal as a voltage signal in accordance with the input signal, thus feeding an electric current to the main shaft motor (S24 in FIG. 24: a current supply step).

Control of the main shaft motor 20 is performed by performing processing represented by flowcharts in FIG. 23 and FIG. 24 at a predetermined cycle.

As above, the sewing machine 5 of the present embodiment creates hollow embroidery by fixing the needle thread with the thread hooking rod 236 and the needle thread receiving section 216*f*. Neither a plate-shaped member used for superposing the needle thread on the cloth to be embroidered nor dissolution of the plate-shaped member is necessary. Further, the length of the needle thread (i.e., a remaining length of the needle thread) can be adjusted on a per-stitch basis by an angle of circular movement of the circular movement arm 86 in the second segment, so that elaborate hollow embroidery can be obtained. Further, excessive stretch of cloth, which would otherwise be caused by making stitches, can be prevented by making the length of the needle thread (i.e., the remaining length of the needle thread) longer. Hence, an embroidered cloth does not become wavy (or uneven). In addition, stitches can be made soft. Specifically, when the stitches are formed firm by shortening the length of the needle thread, the embroidered cloth may become wavy (or uneven). In particular, when the cloth has a small thickness, there is a high probability of occurrence of being wavy. In the case of the present embodiment, the embroidered cloth can be prevented from becoming wavy.

The above description states that, in the presser foot 12*c*, the main body structure section 214 of the base 212 has a through hole 214*a* for insertion of the shaft 215; and that the elongated opening 232*k* is provided in the sideway plate 232 of the swayingly reciprocating mechanism section 230. As shown in FIG. 27 and FIG. 28, there can also be adopted an inverse structure in which a through hole 232*a* for insertion of the shaft 215 is provided in the sideway plate 232 of the swayingly reciprocating mechanism section 230; in which the shaft 215 is fixed to the sideway plate 232; and in which the elongated opening 214*d* is formed in the main body structure section 214. Specifically, the shaft 215 is inserted into the sideway plate 232 so as not to be able to move in a direction orthogonal to the axis of the shaft 215 with respect to the sideway plate 232. Further, the shaft main body 215*b* is inserted into the opening 214*d*, thus being able to slide in a longitudinal direction of the opening 214*d*. Even in this case, the rear side of the sideway plate 232 rotates as a result of rotation of the rotary disc 238. As a result of rotation of the rear side of the sideway plate 232, the sideway plate 232 reciprocally moves in the front-back direction while swaying in the right-left direction.

In the presser foot 12*c*, the leading-end structure section 216 is arranged so as to face the front side of the presser foot 12*c*. However, the leading-end structure section 216 can also be arranged so as to face another orientation other than the front side of the presser foot 12*c*. For instance, the leading-end structure section 216 can also be arranged on the left side surface (a side X1) such that the base end 218 faces the right side surface (a side X2). Alternatively, the leading-end structure section 216 can also be arranged on the right side surface (the side X2) such that the base end 218 faces the left side surface (the side X1).

In the above explanations, the thread hooking rod drive motor 240 for driving the thread hooking rod 236 is provided on the presser foot 12*c* but can also be provided on the case 110. Specifically, as shown in FIG. 29, the thread hooking rod drive motor 240 is supported by a support 112*d* of the case 110. The output shaft 240*a* of the thread hooking rod drive motor 240 is inserted into an opening (not shown) formed in the sideway plate 218*b* of the base end 218 of the base 212, and a shaft-like gear 240*b* is coaxially joined to the output shaft 240*a*. A plurality of cogs are formed projectingly on a circumference of the gear 240*b*. Openings (not shown) for meshing with the gear 240*b* are formed in the rotary disc 238. The thread hooking rod drive motor 240 rotates, whereupon the gear 240*b* also rotates. Thus, the rotary disc 238 is rotated. Incidentally, even when the presser foot 12*c* moves up and down with respect to the case 110, the gear 240*b* performs sliding action with respect to the rotary disc 238. Hence, a mesh between the gear 240*b* and the rotary disc 238 is maintained. The gear 240*b* is a transmission section for transmitting the torque of the thread hooking rod drive motor 240 to the rotary disc 238.

As above, the thread hooking rod drive motor 240 is configured separately from the presser foot 12*c*, whereby the weight of the presser foot 12*c* can be reduced. Thus, up-down movements of the presser foot 12*c* can be facilitated.

In the descriptions, the needle thread fixing section made up of the swayingly reciprocating mechanism section 230 (particularly, the thread hooking rod 236) and the needle thread receiving section 216*f* is provided on the presser foot 12*c*. However, the structure for fixing the needle thread can also be provided as a structure differing from the presser foot.

Specifically, the needle thread fixing unit 12*f* shown in FIG. 20 is provided separately from the presser foot. The needle thread fixing unit 12*f* is analogous to a structure achieved by omitting the structure except for the needle thread receiving section 216*f* of the leading-end structure section 216, from the structure of the presser foot 12*c*.

Namely, as shown in FIG. 30, the needle thread fixing unit 12*f* has the main body (needle thread fixing section main body) 210, the swayingly reciprocating mechanism section (which can also be a rotation mechanism section) 230 that reciprocally moves while swaying with respect to the main body 210; and the thread hooking rod drive motor 240 for actuating the swayingly reciprocating mechanism section 230.

The main body 210 has the base 212 and the shaft 220 fixed to the base 212.

The base 212 has the main body structure section 214 and the base end 218 continued from the rear-side end of the main body structure section 214. The main body structure section 214 has a sideway plate 214*a* assuming the shape of a substantially-L-shaped plate, and the quadrate vertical plate 214*b* downwardly continued from the end on the right side of the leading end of the sideway plate 214*a*, and a needle thread receiving section 214*c* attached to an interior surface of the vertical plate 214*b*. The structure of the base 212 other than the needle thread receiving section 214*c*; namely, the sideway plate 214*a*, the vertical plate 214*b*, and the base end 218, makes up the needle thread fixing section main body 212-1 that supports the needle thread receiving section 214*c*.

The needle thread receiving section 214*c* has the same structure as that of the needle thread receiving section 216*f*. The needle thread receiving section 214*c* has an elastic section 214*c*-1 provided on an interior surface of the vertical plate 214*b* and a plate-shaped section (a needle thread receiving section main body) 214*c*-2 fixed to an end of the elastic section 214*c*-1 opposite to the vertical plate 214*b*. The elastic section 214*c*-1 is a coil spring, and one end of the elastic section 214*c*-1 is fixed to the vertical plate 214*b*. The other end of the elastic section 214*c*-1 is fixed to a plate-shaped section 214*c*-2. The needle thread receiving section 214*c* pinches the needle thread along with the thread hooking rod 236. When the needle thread pushed by the thread hooking rod 236 toward the needle thread receiving section 214*c* contacts the plate-shaped section 214*c*-2, the needle thread becomes pinched between the thread hooking rod 236 and the plate-shaped section 214*c*-2.

The base end 218 is analogous in configuration to the base end 218 of the presser foot 12*c*, and hence its explanations are omitted.

The swayingly reciprocating mechanism section 230 in the needle thread fixing unit 12*f* is analogous in configuration to the swayingly reciprocating mechanism section 230 in the presser foot 12*c*. Further, the thread hooking rod motor 240 in the needle thread fixing unit 12*f* is analogous in configuration to the thread hooking rod 240 in the presser foot 12*c*, and hence their explanations are omitted. In this regard, in the swayingly reciprocating mechanism section 230, the thread hooking rod support 231 is made up of the sideway plate 232 and the vertical plate 234. The swayingly reciprocating mechanism section 230 (particularly, the thread hooking rod support 231 and the thread hooking rod 236) and the needle thread receiving section 214*c* make up "a needle thread fixing section that fixes a second needle thread portion of the needle thread situated between a cloth and the thread take-up lever at a position apart from a cloth surface and at a position deviating toward the cloth surface from a position where the sewing needle is to be inserted." Since the needle thread fixing unit 12*f* does not need to move up and down in contrast with the presser foot 12*c* and hence is fixedly provided. Specifically, the shaft 220 of the needle thread fixing unit 12*f* is fixed to the case 110.

In relation to a configuration in FIG. 30, a presser foot 12*c*' having a structure differing from that of the needle thread fixing unit 12*f* moves up and down so as to pass through a spacing (a spacing between the needle thread receiving section 214*c* and the thread hooking rod 236 in FIG. 30) on the left side surface (the side X1) of the thread needle receiving section 214*c*. The presser foot 12*c*' is analogous in configuration to an existing presser foot and has a ring-shaped presser foot main body 12*c*'-1 and a rod-shaped (or plate-shaped) support 12*c*'-2 for supporting the presser foot main body 12*c*'-1. The presser foot 12*c*' descends, whereby the presser foot main body 12*c*'-1 contacts the cloth. Since the sewing needle is inserted into the opening 12*c*'-k formed in the presser foot 12*c*', the needle thread is fixed between the thread hooking rod 236*f* and the needle thread receiving section 214*c* at a position deviating from the position where the sewing needle is inserted, toward the cloth surface, even in the configuration shown in FIG. 30.

In the above description, the elastic sections 216*f*-1 and 214*c*-1 are mentioned as the coil springs. However, they can also be other elastic bodies, like leaf springs. In addition, in order to enhance the force for pinching the needle thread between the plate-shaped section 216*f*-2 (214*c*-2) and the thread hooking rod 236, a magnet (specifically, permanent magnet) can also be attached to the plate-shaped section 216*f*-2 (214*c*-2), or the plate-shaped section 216*f*-2 (214*c*-2) can also be made up of a magnet (specifically, a permanent magnet). Namely, the thread hooking rod 236 is made up of a magnetic substance [in other words, a material (e.g., metal) attracted by a magnet, such as iron], whereby the needle thread can be intensely gripped and fixed between the plate-shaped section 216*f*-2 (214*c*-2) and the thread hooking rod.

The above description states that the needle thread is fixed by the thread hooking rod 236 and the needle thread receiving section 216*f* by swiveling the thread hooking rod 236 through use of the crank mechanism. However, the needle thread can also be fixed by reciprocally moving the thread hooking rod in both the right-left direction and the front-back direction, through use of a device for causing reciprocal actuation in the front-back direction (a front-back-direction drive device) and another device for causing reciprocal actuation in the right-left direction (a right-left-direction drive device). For instance, the front-back-direction drive device is equipped with the right-left-direction drive device, and the thread hooking rod 236 is attached to the right-left-direction drive device. While the thread hooking rod is situated at the left side and the front side with respect to the needle thread (this state is taken as an "initial state"), the thread hooking rod is moved toward the right side by the right-left-direction drive device, thereby fixing the needle thread with the thread hooking rod 236 and the needle thread receiving section 216*f*. Subsequently, the front-back-direction drive device moves the right-left-direction device toward the rear side, thereby releasing the needle thread from its fixed state. Subsequently, the right-left-direction drive device moves the thread hooking rod toward the left side. Then, the front-back-direction drive device moves the right-left-direction drive device to the front side, whereby the right-left-direction drive device returns to its initial state. In this regard, an actuator, such as a solenoid, is mentioned as a device for performing reciprocal actuation.

Although the presser foot 12*c* is mentioned as being moved up and down by the torque of the main shaft 22. However, a presser foot motor that is a motor for moving the presser foot 12*c* up and down can also be separately provided. Further, presser foot data specifying angles of the main shaft and the rotational position of the presser foot motor are provided, thereby operating the presser foot motor in accordance with the presser foot data and thus moving the presser foot 12*c* up and down.

In the description, the direction of the circular movement axis of the circular movement arm 81 is mentioned as the right-left direction, and the range on both sides of the first needle thread portion Ja including the first needle thread portion Ja of the needle thread is supported in the right-left direction by the needle thread support member 88. However, the direction of the circular movement axis of the circular movement arm 81 is not limited to that mentioned above. The direction of the circular movement axis of the circular movement arm 81 can also be oriented to the up-down direction. A portion of the needle thread, which lies in the vertical direction, between the upstream grip section main body 41 and the downstream grip section main body 61 can also be taken as a first needle thread portion and circularly moved. In this case, the portion of the needle thread hooked by the circular movement arm 81 in the up-down direction is circularly moved in the sideway direction.

In the drawing, a Y1-Y2 direction is a direction perpendicular to the X1-X2 direction, and a Z1-Z2 direction is a direction perpendicular to the X1-X2 direction and the Y1-Y2 direction.

DESCRIPTION OF THE REFERENCE NUMERALS

5 SEWING MACHINE
7 HEAD
10 MACHINE ELEMENT GROUP
12*a* THREAD TAKE-UP LEVER
12*b* NEEDLE BAR
12*ba* SEWING NEEDLE
12*bb* PIN HOLE
12*c* PRESSER FOOT
12*d* SHUTTLE
12*e* SEWING FRAME
12*f* NEEDLE THREAD FIXING UNIT
14*a* NEEDLE BAR CONNECTING STUD
14*b* NEEDLE BAR UP-DOWN MEMBER
14*c* BASE NEEDLE BAR
20 MAIN SHAFT MOTOR
21 ENCODER
22 MAIN SHAFT
24 FRAME ACTUATOR
40 UPSTREAM GRIP SECTION
41, 61 GRIP SECTION MAIN BODY
42, 62 FIRST PLATE-SHAPED SECTION UNIT
42*a*, 62*a* FIRST PLATE-SHAPED SECTION
44, 64 SECOND PLATE-SHAPED SECTION
50, 70 MAGNET SECTION
52, 54, 72, 74, 100 GUIDE MEMBER
60 DOWNSTREAM GRIP SECTION
80 CIRCULAR MOVEMENT SECTION
81 CIRCULAR MOVEMENT ARM
82 MAIN BODY SECTION
84 HOOK
86 NEEDLE THREAD MOTOR
88 NEEDLE THREAD SUPPORT MEMBER
90 CONTROL CIRCUIT
92 STORAGE DEVICE
102 TENSION SPRING
110 CASE
110*a*, 110*b* HOOKING HOLE
120 FRAME
210 MAIN BODY
212 BASE
212-1 NEEDLE THREAD FIXING SECTION MAIN BODY

214 MAIN BODY STRUCTURE SECTION
214*a* THROUGH HOLE
215 SHAFT
216 LEANDING-END STRUCTURE SECTION
216*a*, 216*c*, 216*e*, 218*a*, 234 VERTICAL PLATE
216*b*, 216*d*, 218*b*, 232 SIDEWAY PLATE
216*bk*, 216*dk* OPENING
216*f*-1 ELASTIC SECTION
216*f*-2 PLATE-SHAPED SECTION
218 BASE END
230 SWAYIHNGLY RECIPROCATING MECHANISM SECTION
231 THREAD HOOKING ROD SUPPORT
236 THREAD HOOKING ROD
238 ROTARY DISC
240 THREAD HOOKING ROD DRIVE MOTOR

The invention claimed is:

1. A sewing machine comprising:

a thread take-up lever formed in a swayable manner;

a sewing needle which is supported on a vertically-movable needle bar and into which the needle thread is to be inserted;

a shuttle that makes stitches by hooking the needle thread inserted into the sewing needle;

an upstream grip section that has an upstream grip section main body which grips the needle thread in a pinching manner and an upstream drive section which switches the upstream grip section main body between a closed state where the needle thread is gripped and an open state where the gripped needle thread is released;

a downstream grip section that is disposed at a downstream position on a needle thread path with respect to the upstream grip section and an upstream position with respect to the thread take-up lever, and that has a downstream grip section main body which grips the needle thread in a pinching manner and a downstream drive section which switches the downstream grip section main body between the closed state where the needle thread is gripped and the open state where the gripped needle thread is released;

a circular movement section that bends the needle thread via a first needle thread portion of the needle thread located between the upstream grip section main body and the downstream grip section main body by circularly moving the first needle thread portion, and that has a circular movement arm to contact the needle thread, and a needle thread motor which circularly moves the circular movement arm in a first direction in which a degree of bend of the needle thread becomes greater and a second direction opposite to the first direction and which circularly moves the circular movement arm in a range of circular movement between a first end position that is an end in the first direction and a second end position that is an end in the second direction;

a needle thread fixing section that fixes a second needle thread portion of the needle thread situated between a cloth and the thread take-up lever at a position apart from a cloth surface and at a position deviating toward the cloth surface from a position where the sewing needle is to be inserted;

a needle thread fixing drive section that performs switching between a fixed state where the needle thread is fixed by the needle thread fixing section and a released state where the needle thread fixed by the needle thread fixing section is released; and a control section that controls operation of the upstream drive section, operation of the downstream drive section, operation of the needle thread motor, and operation of the needle thread fixing drive section;

that, in a first segment which is at least a portion of a segment from a top dead center of the shuttle to a bottom dead center of the shuttle, circularly moves the circular movement arm, by control of the needle thread motor, in the second direction through an angle corresponding to a stitch reference length which is a needle thread length of a stitch achieved while an $n+1^{th}$ stitch next to a proximal $n^{th}$ stitch ("n" is an integer), among stitches already made in the cloth, is fixed to the needle thread fixing section;

that, in a second segment which is at least a portion of a segment from the bottom dead center of the thread take-up lever to the top dead center of the thread take-up lever, circularly moves the circular movement arm, by control of the needle thread motor, in the first direction through an angle corresponding to a length which is obtained by subtracting a remaining length of the needle thread, which is a length of the needle thread projecting out of the cloth surface in the $n^{th}$ stitch, from the stitch reference length of the $n^{th}$ stitch;

that, in a third segment which is at least a portion of the segment from an end position of the second segment to a position where the shuttle hooks the needle thread, circularly moves the circular movement arm, by control of the needle thread motor, up to the first end position in the first direction;

that controls the upstream drive section, thereby bringing the upstream grip section into a closed state at any position in a segment from an end position of the third segment section to a position where the shuttle hooks the needle thread, and brings the upstream grip section into an open state at any position in a segment from the end position of the second segment to a start position of the third segment;

that controls the downstream drive section, thereby bringing the downstream grip section into a closed state at any position in a segment from the end position of the second segment section to a position where the upstream grip section is switched from the closed state to the open state, and brings the downstream grip section into an open state at any position in a segment from a position where the upstream grip section is switched from the open state to the closed state to a position where the shuttle hooks the needle thread; and that controls the needle thread fixing drive section, thereby bringing the second needle thread portion into a fixed state by means of the needle thread fixing section at least when the sewing needle is inserted into the cloth and when the shuttle hooks the needle thread.

2. The sewing machine according to claim 1, further comprising a presser foot which moves between a cloth surface contact position where the presser foot contacts the cloth surface and a cloth surface apart position where the presser foot is apart from the cloth surface, and the presser foot is provided with the needle thread fixing section.

3. The sewing machine according to claim 2, wherein the presser foot has a presser foot main body having a cloth surface contact section that contacts the cloth surface when the presser foot is at the cloth surface contact position;

the needle thread fixing section has a rod-shaped thread hooking rod, a thread hooking rod support that supports the thread hooking rod, and a needle thread receiving section provided at a position on the cloth surface contact section deviating toward the cloth surface with respect to the insertion position where the sewing needle is to be inserted and which fixes the needle thread by pinching the needle thread, hooked by the thread hooking rod, along with the thread hooking rod;

the thread hooking rod support moves with respect to the presser foot main body such that the thread hooking rod swivels as a result of driving of the needle thread fixing drive section; and at a time of swiveling of the thread hooking rod, driving of the needle thread fixing drive section is stopped at least in a segment from when the sewing thread is inserted into the cloth to when the shuttle hooks the needle thread, thereby achieving a fixed state where the thread hooking rod fixes the needle thread by pinching together with the needle thread receiving section.

4. The sewing machine according to claim 3, wherein the thread hooking rod support reciprocally moves in a second sideway direction orthogonal to a first sideway direction, while swaying in the first sideway direction with respect to the presser foot main body, by means of a crank mechanism to be driven by the needle thread fixing drive section; and the thread hooking rod swivels as a result of the thread hooking rod support reciprocally moving in the second sideway direction while swaying in the first sideway direction.

5. The sewing machine according to claim 3, wherein the needle thread receiving section has an elastic section provided at a position on the cloth surface contact section deviating toward the cloth surface with respect to the insertion position where the sewing needle is to be inserted, and a needle thread receiving section main body that is attached to the elastic section and that fixedly pinches the needle thread together with the thread hooking rod.

6. The sewing machine according to claim 3, wherein the presser foot main body has a main body structure section that is continued from the cloth surface contact section and faces the thread hooking rod support; a shaft is inserted into one of the main body structure section and the thread hooking rod support; an elongated opening with the shaft inserted is opened in a remaining one of the two; and the thread hooking rod swivels by rotationally moving an end area of the thread hooking rod support opposite the thread hooking rod.

7. The sewing machine according to claim 3, wherein the needle thread fixing drive section is a motor fixed to the presser foot main body; and the thread hooking rod support is reciprocally moved in the second sideway direction, while swaying in the first sideway direction with respect to the presser foot main body, by means of torque of the motor.

8. The sewing machine according to claim 3, wherein the needle thread fixing drive section is a motor fixed to a case making up a housing of the sewing machine; and the thread hooking rod support is reciprocally moved in the second sideway direction by means of torque of the motor while swaying in the first sideway direction with respect to the presser foot main body.

9. The sewing machine according to claim 1, wherein the needle thread fixing section has a rod-shaped thread hooking rod, a thread hooking rod support that supports the thread hooking rod, a needle thread receiving section that fixes the needle thread hooked by the thread hooking rod by pinching together with the thread hooking rod, and the sewing machine has a needle thread fixing main body that supports the needle thread receiving section; and the thread hooking rod support moves with respect to the needle thread fixing main body such that the thread hooking rod swivels by means of driving of the needle thread fixing drive section.

10. The sewing machine according to claim 9, wherein the needle thread receiving section has an elastic section provided on the needle thread fixing main body and the needle thread receiving section main body that is attached to the elastic section and fixedly pinches the needle thread together with the thread hooking rod.

11. The sewing machine according to claim 1, further comprising:

a storage section that stores embroidery data including data pertaining to a stitch length and a remaining length of the needle thread for each stitch; wherein the control section generates from the embroidery data, on a per-stitch basis, angle correspondence data that specify an angle of the needle thread motor representing a rotational position of the needle thread motor, for each angle of a main shaft motor representing a rotational position of the main shaft motor that rotates the main shaft for transmitting torque to the thread take-up lever, and the control section also controls, on the basis of the angle correspondence data, a position of the needle thread motor to an angle of the needle thread motor corresponding to the angle of the main shaft motor, as the angle of the main shaft motor changes as a result of rotation of the main shaft motor.

12. The sewing machine according to claim 1, further comprising:

a storage section that stores embroidery data including data pertaining to a stitch length and a remaining length of the needle thread for each stitch; wherein the control section generates data for circular movement arm for storing, on a per-stitch basis, data pertaining to an angle corresponding to a stitch reference length used in the first segment and also storing, on a per-stitch basis, data pertaining to angle data corresponding to a length determined by subtracting a remaining length of the needle thread from the stitch reference length used in the second segment; and the control section generates from the embroidery data and the data for circular movement arm, on a per-stitch basis, angle correspondence data which specify an angle of the needle thread motor representing a rotational position of the needle thread motor, for each angle of a main shaft motor representing a rotational position of the main shaft motor that rotates the main shaft for transmitting torque to the thread take-up lever, and the control section also controls, on the basis of the angle correspondence data, a position of the needle thread motor to an angle of the needle thread motor corresponding to the angle of the main shaft motor, as the angle of the main shaft motor changes as a result of rotation of the main shaft motor.

13. The sewing machine according to claim 1, further comprising:

a needle thread support member that supports in a sideway direction a range on both sides of the first needle thread portion of the needle thread including the first needle thread; and wherein a direction of a circulatory movement axis of the circular movement arm is a sideway direction;

a first direction in the direction of circular movement of the circular movement arm is an upward direction of circular movement; and a second direction is a downward direction of circular movement.

14. A sewing machine comprising:

a thread take-up lever that is formed in a swayable manner and that includes a swaying axis provided in a right-left direction and a needle thread hooking section which hooks a needle thread provided closer to a front side than the swaying axis;

a sewing needle that is supported by a vertically-movable needle bar and into which the needle thread is to be inserted;

a shuttle that makes stitches by hooking the needle thread inserted into the sewing needle;

an upstream grip section having an upstream grip section main body which grips the needle thread in a pinching manner and an upstream drive section which switches the upstream grip section main body between a closed state where the needle thread is gripped and an open state where the gripped needle thread is released;

a downstream grip section that is disposed at a downstream position on a needle thread path with respect to the upstream grip section and an upstream position with respect to the thread take-up lever, and that has a downstream grip section main body which grips the needle thread in a pinching manner and a downstream drive section which switches the downstream grip section main body between the closed state where the needle thread is gripped and the open state where the needle thread is released from the gripped state;

a circular movement section that bends the needle thread via a first needle thread portion of the needle thread located between the upstream grip section main body and the downstream grip section main body by circularly moving the first needle thread portion, and that has a circular movement arm which contacts the needle thread and whose circular movement axis is oriented in a right-left direction, and a needle thread motor which circularly moves the circular movement arm in a first direction in which a degree of bend of the needle thread becomes greater and a second direction opposite to the first direction and which circularly moves the circular movement arm in a range of circular movement between a first end position corresponding to an end in the first direction and a second end position corresponding to an end in the second direction;

a needle thread support member that supports, in a right-left direction, a range on both sides of the first needle thread portion of the needle thread including the first needle thread;

a presser foot that moves between a cloth surface contact position where the presser foot contacts the cloth surface and a cloth surface apart position where the presser foot is apart from the cloth surface;

that has a presser foot main body and a needle thread fixing section which fixes a second needle thread portion of the needle thread situated between a cloth and the thread take-up lever, at a position apart from upper surface of the cloth and at a position deviating toward the upper surface of the cloth surface from an insertion position where the sewing needle is to be inserted, wherein the presser foot main body has a cloth surface contact section that contacts the cloth surface when the presser foot is at the cloth surface contact position and a main body structure section formed closer to a rear side than the cloth surface contact section, and wherein the needle thread fixing section has a rod-shaped thread hooking rod, a thread hooking rod support that supports the thread hooking rod and reciprocally moves in a front-back direction by means of a crank mechanism with respect to the main body structure section while swaying in a right-left direction, and a needle thread receiving section which fixes the needle thread together with the thread hooking rod and which has an elastic section provided at a position on the cloth surface contact section deviating toward the upper surface of the cloth with respect to the insertion position where the sewing needle is to be inserted, and a needle thread receiving section main body which is attached to the elastic section and which fixedly pinches the needle thread together with the thread hooking rod, wherein the thread hooking rod swivels when the thread hooking rod support reciprocally moves in the front-back direction while swaying in the right-left direction, that moves between a cloth surface contact position where the presser foot contacts the cloth surface and a cloth surface apart position where the presser foot is apart from the cloth surface;

a needle thread fixing drive section that actuates the crank section and performs switching between a fixed state where the needle thread fixing section fixes the needle thread and a released state where the needle thread fixed by the needle thread fixing section is released;

a storage section that stores embroidery data including data pertaining to a stitch length and a remaining length of the needle thread for each stitch; and a control section that controls operation of the upstream drive section, operation of the downstream drive section, operation of the needle thread motor, and operation of the needle thread fixing drive section;

that, in a first segment that is at least a portion of a segment from a top dead center of the shuttle to a bottom dead center of the shuttle, circularly moves the circular movement arm, by control of the needle thread motor, in the second direction through an angle corresponding to a stitch reference length which is a needle thread length of a stitch achieved while an $n+1^{th}$ stitch next to a proximal $n^{th}$ stitch ("n"

is an integer), among stitches already made in the cloth, is fixed to the needle thread fixing section;

that, in a second segment that is at least a portion of a segment from the bottom dead center of the thread take-up lever to the top dead center of the thread take-up lever, circularly moves the circular movement arm, by control of the needle thread motor, in the first direction through an angle corresponding to a length which is obtained by subtracting a needle thread remaining length, which is a length of the needle thread projecting out of the cloth surface in the $n^{th}$ stitch, from the stitch reference length achieved at the $n^{th}$ stitch;

that, in a third segment that is at least a portion of the segment from an end position of the second segment to a position where the shuttle hooks the needle thread, circularly moves the circular movement arm, by control of the needle thread motor, up to the first end position in the first direction;

that, on occasion of control of the needle thread motor, generates from the embroidery data, on a per-stitch basis, angle correspondence data that specify an angle of the needle thread motor representing a rotational position of the needle thread motor, for each angle of a main shaft motor representing a rotational position of the main shaft motor which rotates the main shaft for transmitting torque to the thread take-up lever, and also controls, on the basis of the angle correspondence data, a position of the needle thread motor to an angle of the needle thread motor corresponding to the angle of the main shaft motor, as the angle of the main shaft motor changes as a result of rotation of the main shaft motor;

that controls the upstream drive section, thereby bringing the upstream grip section into a closed state at any position in a segment from an end position of the third segment section to a position where the shuttle hooks the needle thread, and brings the upstream grip section into an open state at any position in a segment from the end position of the second segment to a start position of the third segment;

that controls the downstream drive section, thereby bringing the downstream grip section into a closed state at any position in a segment from the end position of the second segment section to a position where the upstream grip section is switched from the closed state to the open state, and brings the downstream grip section into an open state at any position in a segment from a position where the upstream grip section is switched from the open state to the closed state to a position where the shuttle hooks the needle thread; and that controls the needle thread fixing drive section, whereby the needle thread fixing drive section stops driving, and the thread hooking rod fixedly pinches the needle thread together with the needle thread receiving section, in at least a segment from when the sewing needle is inserted into the cloth to when the shuttle hooks the needle thread.

15. The sewing machine according to claim 14, wherein the control section generates data for circular movement arm for storing, on a per-stitch basis, data pertaining to an angle corresponding to a stitch reference length used in the first segment and also storing, on a per-stitch basis, data pertaining to angle data corresponding to a length determined by subtracting a remaining length of the needle thread from the stitch reference length used in the second segment; and generates angle correspondence data from the embroidery data and the data for circular movement arm.

16. The sewing machine according to claim 1, wherein, in the second segment, the control section circularly moves the circular movement arm in the first direction through an angle that is obtained by subtracting the angle corresponding to the remaining length of the needle thread which is a length of the needle thread projecting out of the cloth surface in the $n^{th}$ stitch, from an angle corresponding to the stitch reference length in the $n^{th}$ stitch, instead of circularly moving the circular movement arm in the first direction through an angle corresponding to a length which is obtained by subtracting the remaining length of the needle thread, which is the length of the needle thread projecting out of the cloth surface in the $n^{th}$ stitch, from the stitch reference length in the $n^{th}$ stitch.

17. The sewing machine according to claim 4, wherein the needle thread receiving section has an elastic section provided at a position on the cloth surface contact section deviating toward the cloth surface with respect to the insertion position where the sewing needle is to be inserted, and a needle thread receiving section main body that is attached to the elastic section and that fixedly pinches the needle thread together with the thread hooking rod.

18. The sewing machine according to claim 4, wherein the presser foot main body has a main body structure section that is continued from the cloth surface contact section and faces the thread hooking rod support; a shaft is inserted into one of the main body structure section and the thread hooking rod support; an elongated opening with the shaft inserted is opened in a remaining one of the two; and the thread hooking rod swivels by rotationally moving an end area of the thread hooking rod support opposite the thread hooking rod.

19. The sewing machine according to claim 4, wherein the needle thread fixing drive section is a motor fixed to the presser foot main body; and the thread hooking rod support is reciprocally moved in the second sideway direction, while swaying in the first sideway direction with respect to the presser foot main body, by means of torque of the motor.

20. The sewing machine according to claim 4, wherein the needle thread fixing drive section is a motor fixed to a case making up a housing of the sewing machine; and the thread hooking rod support is reciprocally moved in the second sideway direction by means of torque of the motor while swaying in the first sideway direction with respect to the presser foot main body.

* * * * *